US008232986B2

(12) United States Patent
Kim et al.

(10) Patent No.: US 8,232,986 B2
(45) Date of Patent: Jul. 31, 2012

(54) LIGHT EMITTING DISPLAY AND METHOD FOR DRIVING THE SAME

(75) Inventors: Jin Hyoung Kim, Goyang-si (KR); Woo Jin Nam, Seongnam-si (KR); Ho Min Lim, Gumi-si (KR); Su Jin Baek, Gumi-si (KR); Jung Yoon Yi, Suwon-si (KR); Seung Tae Kim, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 810 days.

(21) Appl. No.: 12/337,512

(22) Filed: Dec. 17, 2008

(65) Prior Publication Data

US 2009/0284519 A1 Nov. 19, 2009

(30) Foreign Application Priority Data

May 17, 2008 (KR) ..... 10-2008-0045840

(51) Int. Cl.
*G09G 5/00* (2006.01)

(52) U.S. Cl. ..... 345/213; 345/76; 345/82; 345/211; 345/212; 345/214; 345/215

(58) Field of Classification Search ..... 345/76, 345/82, 211–215
See application file for complete search history.

(56) References Cited

U.S. PATENT DOCUMENTS

2006/0043375 A1* 3/2006 Takasugi et al. ..... 257/72
2006/0139253 A1* 6/2006 Choi et al. ..... 345/76

FOREIGN PATENT DOCUMENTS

CN 1794327 A 6/2006

OTHER PUBLICATIONS

Office Action issued in corresponding Chinese Patent Application No. 200810182593.2, mailed Nov. 1, 2010.

* cited by examiner

*Primary Examiner* — Nitin Patel
*Assistant Examiner* — Saifeldin Elnafia
(74) *Attorney, Agent, or Firm* — Brinks Hofer Gilson & Lione

(57) ABSTRACT

Disclosed herein are a light emitting display which can compensate for a threshold voltage of a driving switching element, and a method for driving the same. A light emitting display includes a pixel circuit that outputs a driving current corresponding to a data voltage from a data line using a scan signal, a first driving voltage and a second driving voltage; and a light emitting element that emits light by the driving current from the pixel circuit.

4 Claims, 48 Drawing Sheets

LIGHT EMITTING DISPLAY AND METHOD FOR DRIVING THE SAME

RELATED APPLICATIONS

This application claims the benefit of Korean Patent Application No. 10-2008-0045840, filed on May 17, 2008 which is hereby incorporated by reference as if fully set forth herein.

BACKGROUND

1. Field of the Disclosure

The present disclosure relates to a light emitting display, and more particularly, to a light emitting display which is capable of compensating for a threshold voltage of a driving switching element, and a method for driving the same.

2. Discussion of the Related Art

Recently, various flat panel displays which are small in volume and weight compared with a cathode ray tube have been developed, and a light emitting display which has a high luminous efficiency, excellent brightness, wide viewing angle and high response speed, among the flat panel displays, has been especially highlighted.

A light emitting element has a structure where a light emitting layer, which is a thin film emitting light, is disposed between a cathode electrode and an anode electrode, and a characteristic where excitons are generated in the light emitting layer by injecting electrons and holes into the light emitting layer and recombining them therein and light is emitted from the light emitting layer when the generated excitons falls to their low energy states.

The light emitting layer of the light emitting element is composed of an inorganic material or organic material, and the light emitting element is classified into an inorganic light emitting element and an organic light emitting element according to the material type of the light emitting layer.

The amount of current flowing to the light emitting element is different depending on the level of a threshold voltage of a driving transistor.

However, a deviation may occur in the threshold voltage of the driving transistor in a manufacturing process of the light emitting display, resulting in unevenness in the amount of current flowing to the light emitting element and, in turn, unevenness in brightness.

BRIEF SUMMARY

A light emitting display includes: a pixel circuit that outputs a driving current corresponding to a data voltage from a data line using a scan signal, a first driving voltage and a second driving voltage; and a light emitting element that emits light by the driving current from the pixel circuit, wherein the pixel circuit includes: a switching transistor turned on/off in response to the scan signal from a scan line, the switching transistor interconnecting the data line and a first node when turned on; a control transistor turned on/off in response to a control signal from a control signal line, the control transistor interconnecting a second node and a third node when turned on; a driving transistor turned on/off in response to a voltage on the second node, the driving transistor interconnecting the third node and a second driving voltage line when turned on, the second driving voltage line transmitting the second driving voltage; a first storage capacitor connected between the first node and the second node; and a second storage capacitor connected between the first node and the second driving voltage line.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE DRAWINGS AND THE PRESENTLY PREFERRED EMBODIMENTS

Reference will now be made in detail to the preferred embodiments of the present invention, examples of which are illustrated in the accompanying drawings. Wherever possible, the same reference numbers will be used throughout the drawings to refer to the same or like parts.

Figure 1:
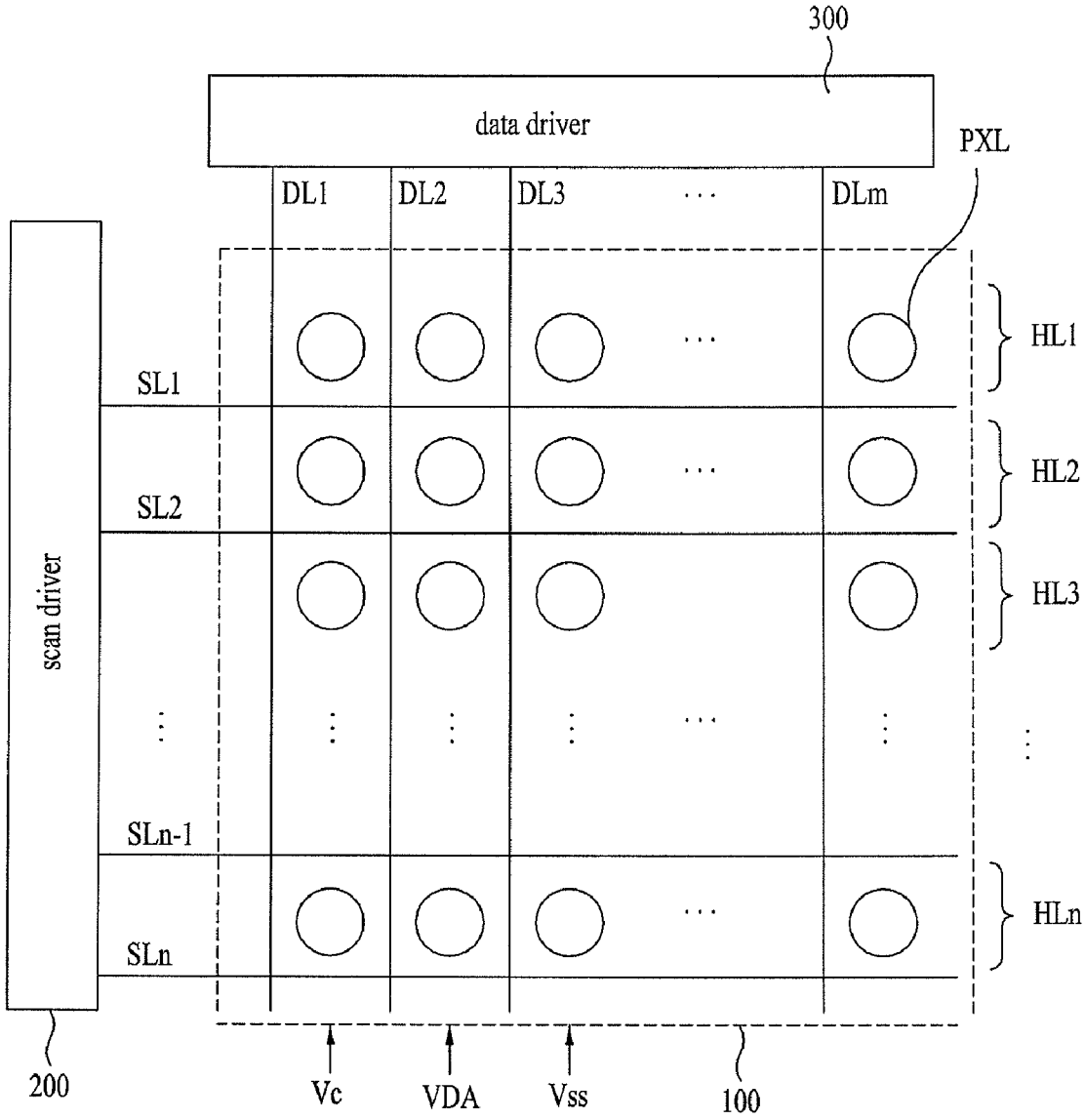
FIG. 1 is a schematic view of a light emitting display according to an embodiment of the present invention.

FIG. 1 is a schematic view of a light emitting display according to an embodiment of the present invention.

Referring to FIG. 1, a light emitting display comprises a display panel 100 including m (where m is a natural number) data lines DL1 to DLm supplied with data voltages Data, n (where n is a natural number different from m) scan lines SL1 to SLn supplied with scan signals, a first driving voltage line (not shown) supplied with a first driving voltage VDD, a second driving voltage line (not shown) supplied with a second driving voltage VSS, a control signal line (not shown) supplied with a control signal Vc and a plurality of pixel cells PXL, a scan driver 200 for driving the scan lines SL1 to SLn, and a data driver 300 for supplying the data voltages Data to the data lines DL1 to DLm, respectively.

The scan driver 200 generates scan signals using a start pulse and a clock signal, not shown, and sequentially supplies the generated scan signals to the scan lines SL1 to SLn, respectively. The characteristics of these scan signals will be described later in more detail.

The data driver 300 generates data voltages Data in response to data control signals, not shown, and supplies the generated data voltages to the data lines DL1 to DLm, respectively. At this time, the data driver 300 supplies data voltages Data of one horizontal line respectively to the data lines DL1 to DLm in every one horizontal period.

Here, m pixel cells PXL of one horizontal line are connected in common to one scan line and respectively to m data lines. For example, first to mth pixel cells PXL arranged along a first horizontal line HL1 are connected in common to the first scan line SL1 and respectively to the first to mth data lines DL1 to DLm. In other words, the first pixel cell PXL of the first horizontal line HL1 is connected to the first data line DL1, the second pixel cell PXL of the first horizontal line HL1 is connected to the second data line DL2, the third pixel cell PXL of the first horizontal line HL1 is connected to the third data line DL3, . . . , and the mth pixel cell PXL of the first horizontal line HL1 is connected to the mth data line DLm.

The first and second driving voltage lines and the control signal line are connected in common to all the pixel cells PXL.

The structure of each pixel cell PXL will hereinafter be described in more detail.

Figure 2:
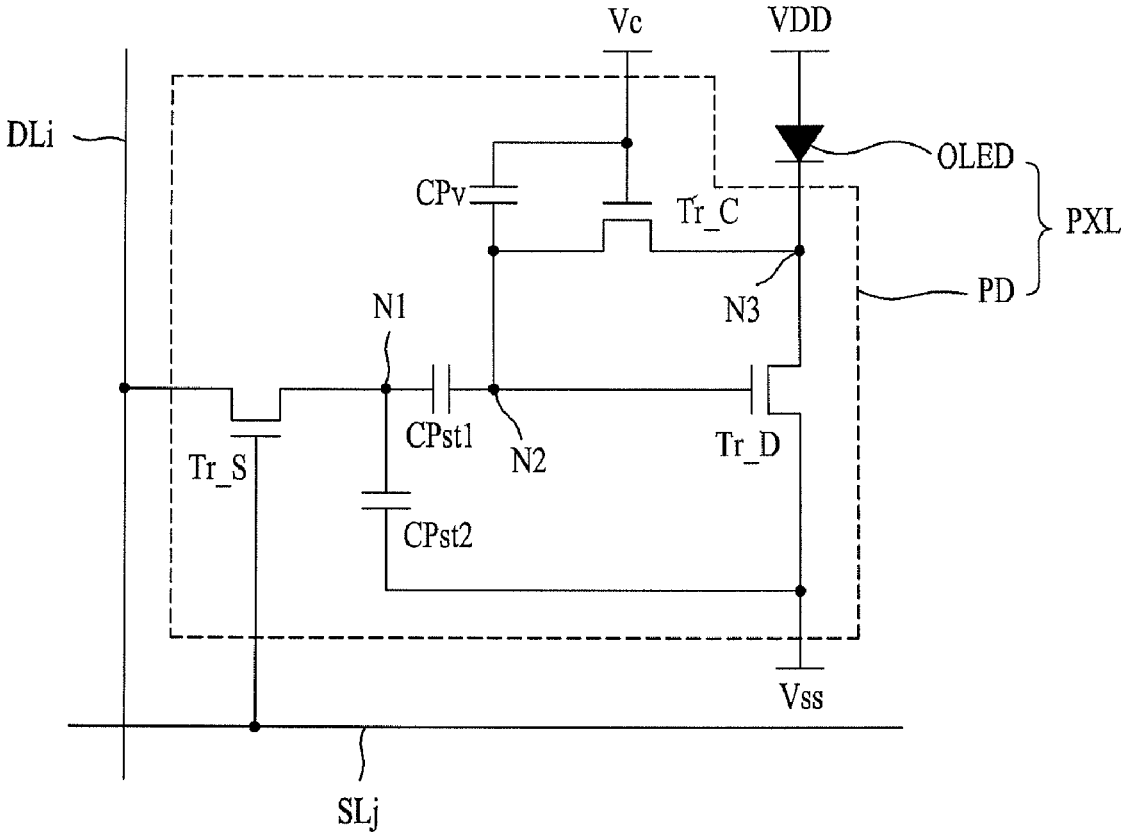
FIG. 2 is a circuit diagram of an arbitrary pixel cell in FIG. 1.

FIG. 2 is a circuit diagram of an arbitrary pixel cell PXL in FIG. 1.

The pixel cell PXL includes, as shown in FIG. 2, a pixel circuit PD for outputting driving current corresponding to a data voltage Data from a data line using a plurality of transistors, a scan signal, a first driving voltage VDD and a second driving voltage VSS, and a light emitting element OLED for emitting light by the driving current from the pixel circuit PD.

The pixel circuit PD includes first and second storage capacitors CPst1 and CPst2 and a variable capacitor CPv in addition to the aforementioned transistors. These transistors include a switching transistor Tr_S, a control transistor Tr_C, and a driving transistor Tr_D.

The switching transistor Tr_S is turned on/off in response to the scan signal from the scan line, and interconnects the data line and a first node N1 when turned on. To this end, the switching transistor Tr_S has a gate electrode connected to the scan line, a drain electrode (or source electrode) connected to the data line, and a source electrode (or drain electrode) connected to the first node N1.

The control transistor Tr_C is turned on/off in response to the control signal from the control signal line, and interconnects a second node N2 and a third node N3 when turned on. To this end, the control transistor Tr_C has a gate electrode connected to the control signal line, a drain electrode (or source electrode) connected to the second node N2, and a source electrode (or drain electrode) connected to the third node N3.

The driving transistor Tr_D is turned on/off in response to a voltage on the second node N2, and interconnects the third node N3 and the second driving voltage line when turned on. To this end, the driving transistor Tr_D has a gate electrode connected to the second node N2, a drain electrode (or source electrode) connected to the third node N3, and a source electrode (or drain electrode) connected to the second driving voltage line.

The first storage capacitor CPst1 is connected between the first node N1 and the second node N2. This first storage capacitor CPst1 stably maintains the voltage on the second node N2 and prevents the voltage on the second node N2 from being mixed with a voltage on the first node N1.

The second storage capacitor CPst2 is connected between the first node N1 and the second driving voltage line. This second storage capacitor CPst2 prevents the voltage on the first node N1 from varying when the first node N1 floats as the switching transistor Tr_S is turned off.

The variable capacitor CPv is connected between the control signal line and the second node N2. This variable capacitor CPv offsets, by capacitance thereof, an error deviation which is caused during a compensation operation of the pixel cell by parasitic capacitances of the switching transistor Tr_S and control transistor Tr_C and parasitic capacitances Cgs and Cgd and channel capacitance of the driving transistor Tr_D, so as to prevent the voltage on the first node N1 from varying. Consequently, the variable capacitor CPv contributes to improving a compensation characteristic.

The light emitting element OLED has a cathode electrode connected to the third node N3, an anode electrode connected to the first driving voltage line, and a light emitting layer formed between the cathode electrode and the anode electrode. The light emitting layer may be an organic light emitting layer or an inorganic light emitting layer. This light emitting element OLED emits light by driving current from the driving transistor Tr_D.

A detailed description will hereinafter be given of the scan signal, data voltage Data, first driving voltage VDD, second driving voltage VSS and control signal Vc which are supplied to the pixel cell PXL with the above-stated configuration.

First Embodiment

Figure 3:
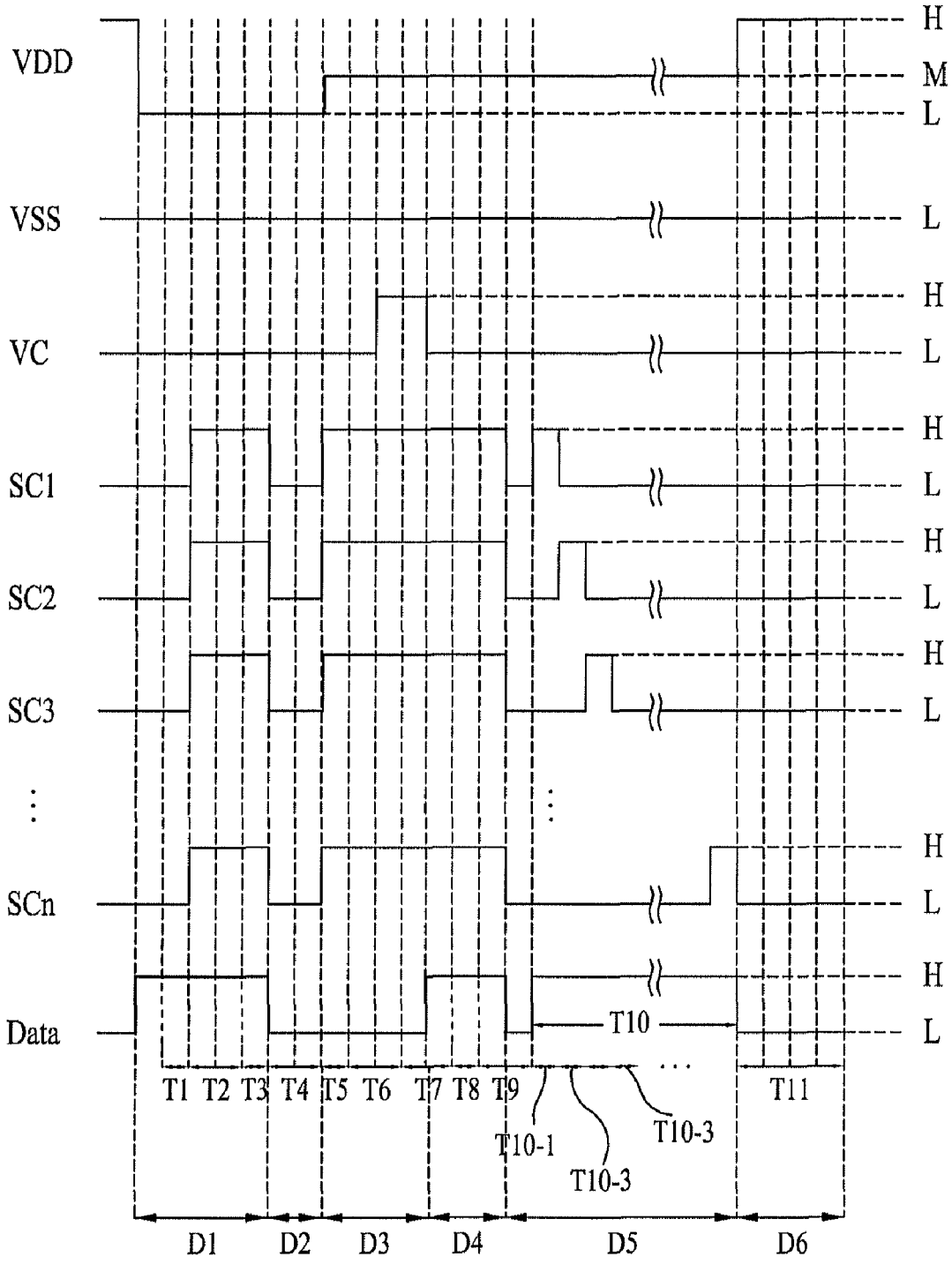
FIG. 3 is a waveform diagram of various signals which are supplied to a display panel including a plurality of pixel cells each having a structure as in FIG. 2, according to a first embodiment of the present invention.

FIG. 3 is a waveform diagram of various signals which are supplied to the display panel 100 including a plurality of pixel cells PXL each having a structure as in FIG. 2, according to a first embodiment of the present invention.

A light emitting display according to the first embodiment of the present invention includes, as shown in FIG. 3, a first initialization period D1, a threshold voltage detection setup period D2, a threshold voltage detection period D3, a second initialization period D4, an actual data input period D5, and a light emitting period D6.

The first driving voltage VDD is an alternating current (AC) signal having different levels of three steps, as shown in FIG. 3. That is, the first driving voltage VDD is a signal having a high voltage H of a relatively high level, a low voltage L of a relatively low level, and a middle voltage M of a level between the high voltage H and the low voltage L. This first driving voltage VDD periodically exhibits the low voltage L, the middle voltage M and the high voltage H.

The high voltage H may be set to about 15V, the middle voltage M may be set to about 0V and the low voltage L may be set to about −10V, and these values may be freely changed depending on circuit configurations.

The first driving voltage VDD is maintained at the low voltage L for the first initialization period D1 and the threshold voltage detection setup period D2, and at the middle voltage M from the start of the threshold voltage detection period D3 until the end of the actual data input period D5. Also, the first driving voltage VDD is maintained at the high voltage H for the light emitting period D6.

The second driving voltage VSS is a direct current (DC) signal that is maintained at a low voltage L for all the periods, as shown in FIG. 3.

The control signal Vc is maintained at a high voltage H for a part of the threshold voltage detection period D3 and at a low voltage L for the other periods, as shown in FIG. 3. This control signal Vc is inputted in common to all the pixel cells PXL of the display panel 100 like the first driving voltage VDD and second driving voltage VSS, differently from scan signals SC1 to SCn inputted respectively to the horizontal lines.

Each scan signal is maintained at a high voltage H for a part of the first initialization period D1, the threshold voltage detection period D3 and the second initialization period D4 and also sequentially maintained at the high voltage H for the actual data input period D5. That is, as shown in FIG. 3, the first scan signal SC1 is maintained at the high voltage H for a (10-1)th period T10-1 that is a first preceding period of the actual data input period D5, the second scan signal SC2 is maintained at the high voltage H for a (10-2)th period T10-2 that is a second preceding period of the actual data input period D5, and the third scan signal SC3 is maintained at the high voltage H for a (10-3)th period T10-3 that is a third preceding period of the actual data input period D5.

The data voltage Data is maintained at a high voltage H for the first initialization period D1, the second initialization period D4 and the actual data input period D5 and at a low voltage L for the other periods.

The high voltages H of the aforementioned respective signals may have the same level or different levels. Similarly, the low voltages L of the respective signals may have the same level or different levels.

Hereinafter, the operations of the pixel cells PXL supplied with the above-stated signals will be described in detail.

FIGS. 4A to 4K are circuit diagrams illustrating the operation of the light emitting display according to the first embodiment of the present invention.

Here, because the operations of all the pixel cells PXL are the same, the operation of the first pixel cell PXL connected to the first scan line SL1 and the first data line DL1 will be representatively described.

Figure 4A:
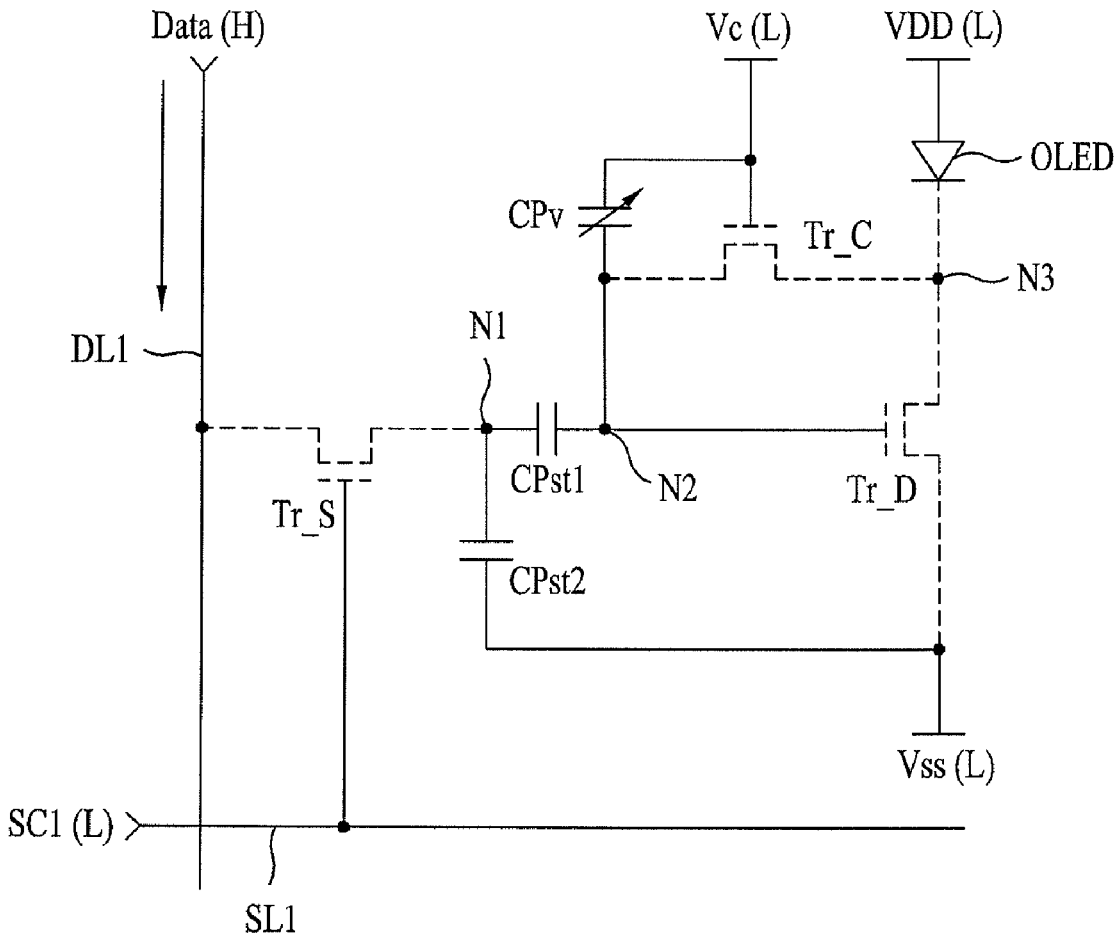
FIGS. 4A to 4K are circuit diagrams illustrating the operation of a light emitting display according to the first embodiment of the present invention.

First, a description will be given of an operation in a first period T1 with reference to FIGS. 4A and 3.

In the first period T1, as shown in FIG. 3, only the data voltage Data is maintained at the high voltage H and the first driving voltage VDD, second driving voltage VSS, control signal Vc and scan signals are all maintained at the low voltage L. The data voltage Data is supplied to the first data line DL1 to charge the first data line DL1 to the high voltage H, as shown in FIG. 4A. In this first period T1, all the transistors and the light emitting element OLED are all kept turned off.

Because data of the high voltage H is supplied to the first data line DL1 for the first period T1 before the switching transistor Tr_S is turned on, the first data line DL1 will be adequately charged to a target voltage in a second period T2 to be described later.

On the other hand, because the first driving voltage VDD was adequately maintained at the low voltage L in a period immediately prior to the first period T1, a voltage on the third node N3 is very low in this period and the first period T1. That is, due to a parasitic capacitor of the light emitting element OLED formed between the first driving voltage line supplied with the first driving voltage VDD and the third node N3, when the first driving voltage VDD falls to the low voltage L, the voltage on the third node N3 falls, too.

Next, a description will be given of an operation in the second period T2 with reference to FIGS. 4B and 3.

In the second period T2, as shown in FIG. 3, the data voltage Data and all the scan signals are maintained at the high voltage H and the first driving voltage VDD, second driving voltage VSS and control signal Vc are maintained at the low voltage L. That is, in the second period T2, the scan signals are changed from the low voltage L to the high voltage H.

Figure 4B:
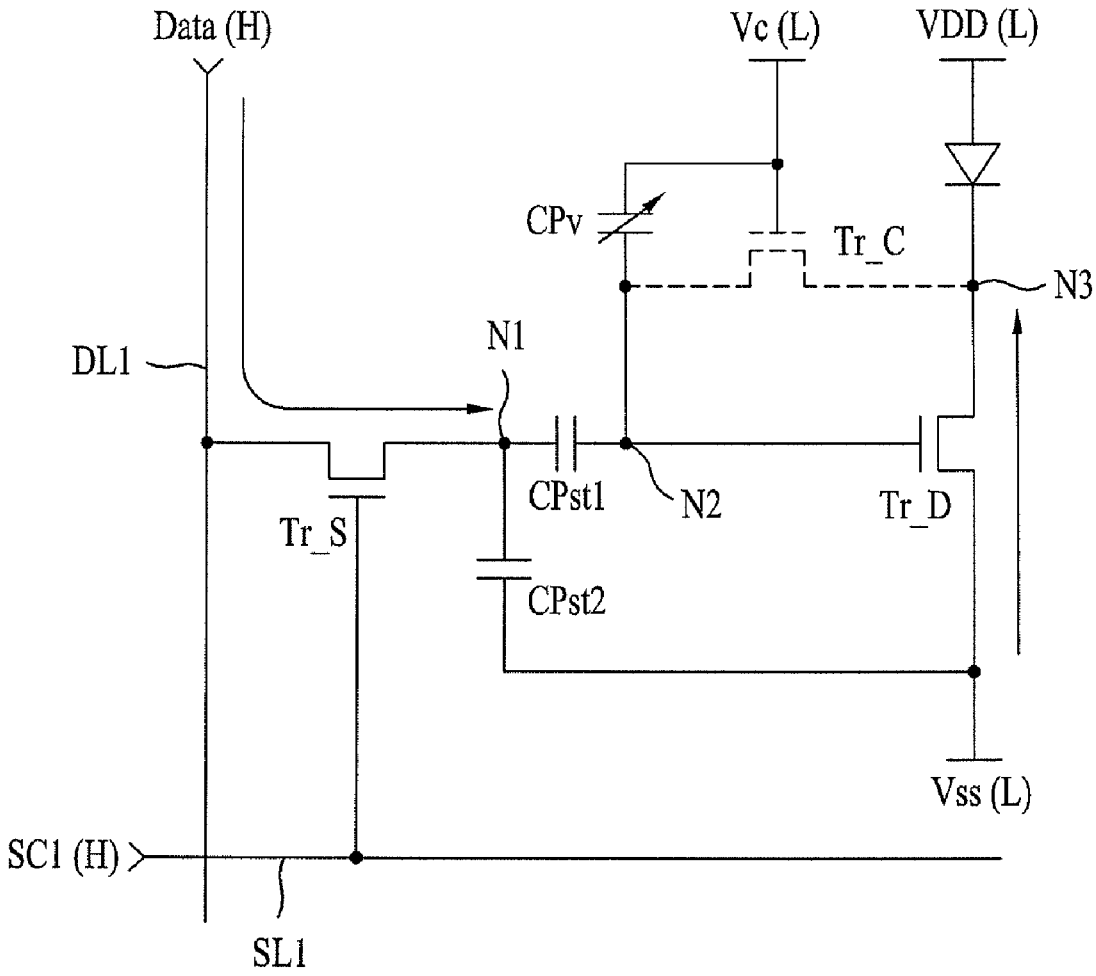

Because all the scan signals including the first scan signal SC1 assume the high voltage H, the switching transistor Tr_S, supplied with the first scan signal SC1 through the gate electrode thereof, is turned on as shown in FIG. 4B. Then, the data voltage Data (the data voltage Data of the high voltage H) from the first data line DL1 is supplied to the first node N1 through the turned-on switching transistor Tr_S. As a result, the first node N1 is charged to the high voltage H. At this time, the voltage on the second node N2 is raised by the first storage capacitor CPst1 connected between the first node N1 and the second node N2. Accordingly, the driving transistor Tr_D, connected to the second node N2 through the gate electrode thereof, is turned on. Then, the second driving voltage VSS of the low voltage L is supplied to the third node N3 through the turned-on driving transistor Tr_D. Consequently, the third node N3 is initialized.

Next, a description will be given of an operation in a third period T3 with reference to FIGS. 4C and 3.

In the third period T3, as shown in FIG. 3, all the scan signals are maintained at the high voltage H and the data voltage Data, first driving voltage VDD, second driving voltage VSS and control signal Vc are maintained at the low voltage L. That is, in the third period T2, the data voltage Data is changed from the high voltage H to the low voltage L.

Figure 4C:
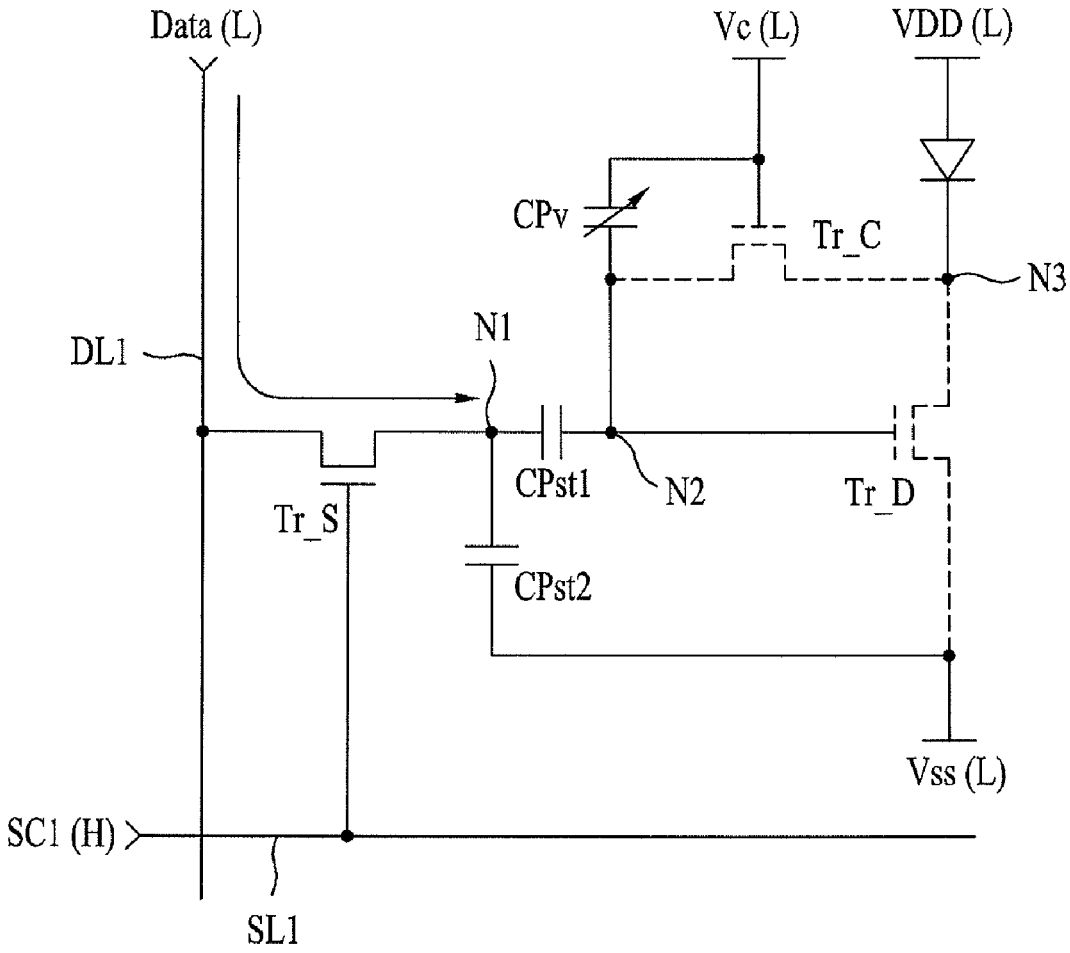

Because all the scan signals including the first scan signal SC1 assume the high voltage H, the switching transistor Tr_S is kept turned on, as shown in FIG. 4C. The data voltage Data (the data voltage Data of the low voltage L) from the first data line DL1 is supplied to the first node N1 through the turned-on switching transistor Tr_S. As a result, the first node N1 is discharged to the low voltage L. At this time, the voltage on the second node N2 is also dropped by the first storage capacitor CPst1 connected between the first node N1 and the second node N2. Accordingly, the driving transistor Tr_D, connected to the second node N2 through the gate electrode thereof, is turned off.

In this manner, in the first initialization period D1 including the first to third periods T1 to T3, the third node N3 is initialized to the low voltage L. That is, the third node N3 is initialized to the second driving voltage VSS. This second driving voltage VSS is set to about 0V and the third node N3 thus rises from a negative voltage to about 0V.

Next, a description will be given of an operation in a fourth period T4 with reference to FIGS. 4D and 3.

In the fourth period T4, as shown in FIG. 3, the second driving voltage VSS, the control signal Vc, all the scan signals and the data voltage Data are maintained at the low voltage L and the first driving voltage VDD is changed from the low voltage L to the middle voltage M.

Figure 4D:
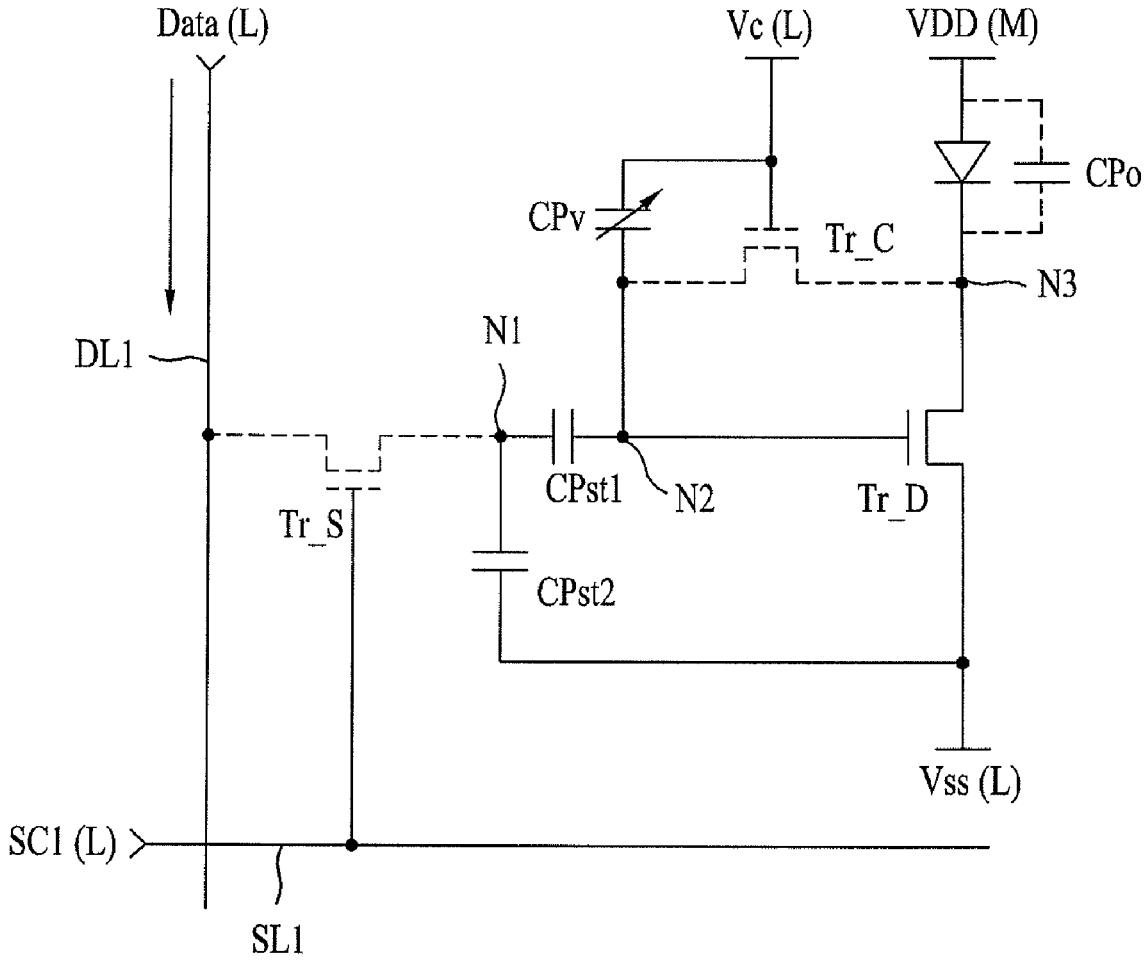

Because all the scan signals including the first scan signal SC1 assume the low voltage L, the switching transistor Tr_S is turned off as shown in FIG. 4D. As a result, the first node N1 floats.

On the other hand, as the first driving voltage VDD rises from the low voltage L to the middle voltage M, the voltage on the third node N3 rises, too. That is, the voltage on the third node N3 is raised by the parasitic capacitor of the light emitting element OLED formed between the first driving voltage line supplied with the first driving voltage VDD and the third node N3. At this time, a voltage resulting from the subtraction of a threshold voltage Vth of the light emitting element OLED from the first driving voltage VDD of the high voltage H is applied across the third node N3.

This third node N3 is the drain electrode of the driving transistor Tr_D, and the enlargements of a gate voltage and drain voltage of the driving transistor Tr_D are advantageous to detecting a threshold voltage Vth of the driving transistor Tr_D in the future. In this connection, the drain voltage of the driving transistor Tr_D can be raised by raising the first driving voltage VDD from the low voltage L to the middle voltage M in the fourth period T4, which is the threshold voltage detection setup period D2.

Here, if the drain voltage of the driving transistor Tr_D rises within a narrow range under the condition that the first node N1 floats, the gate voltage of the driving transistor Tr_D rises within a narrow range owing to a coupling phenomenon. This coupling phenomenon results from a parasitic capacitor formed between the gate electrode and drain electrode of the driving transistor Tr_D.

In this manner, in the fourth period T4, the voltages on the second and third nodes N2 and N3 rise.

Next, a description will be given of an operation in a fifth period T5 with reference to FIGS. 4E and 3.

In the fifth period T5, as shown in FIG. 3, the first driving voltage VDD is maintained at the middle voltage M and the second driving voltage VSS, control signal Vc and data voltage Data are maintained at the low voltage L, whereas all the scan signals are changed from the low voltage L to the high voltage H.

Figure 4E:
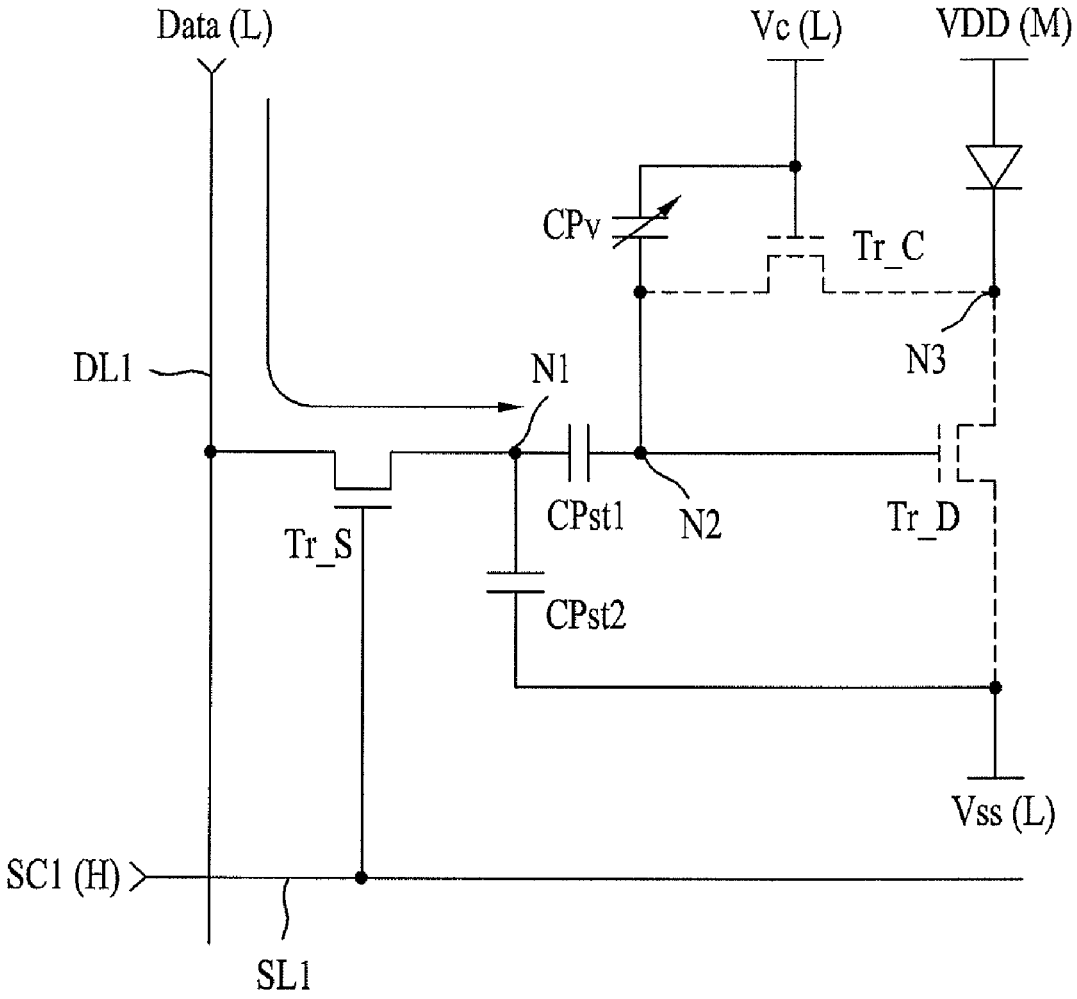

As the first scan signal SC1 rises to the high voltage H, the switching transistor Tr_S is turned on as shown in FIG. 4E. Then, the data voltage Data (the data voltage Data of the low voltage L) from the first data line DL1 is supplied to the first node N1 through the turned-on switching transistor Tr_S. Because this first node N1 has been maintained at the data voltage Data of the low voltage L under the condition of floating until the previous period, the voltages on the first node N1 and second node N2 are subject to no variation in the fifth period T5.

Next, a description will be given of an operation in a sixth period T6 with reference to FIGS. 4F and 3.

In the sixth period T6, as shown in FIG. 3, the first driving voltage VDD is maintained at the middle voltage M, the second driving voltage VSS and data voltage Data are maintained at the low voltage L and all the scan signals are maintained at the high voltage H, whereas the control signal Vc is changed from the low voltage L to the high voltage H.

Figure 4F:
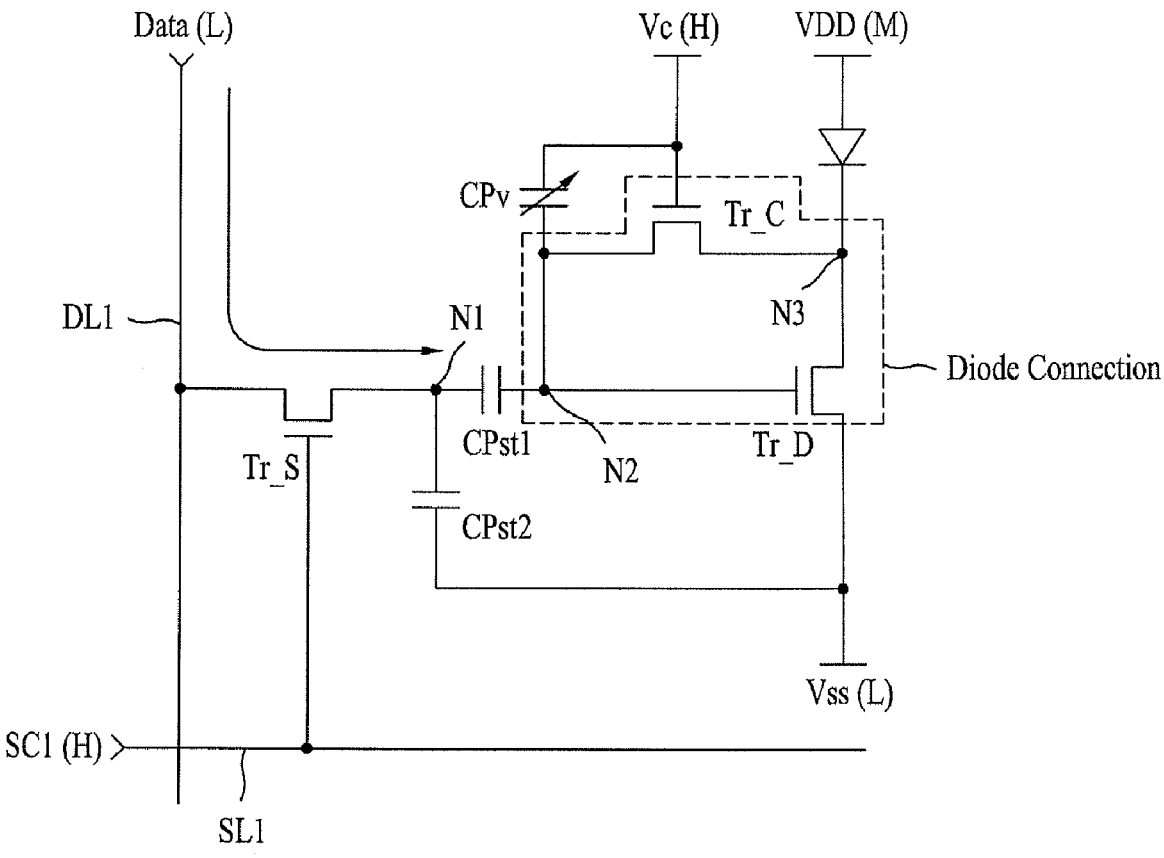

As the control signal Vc rises to the high voltage H, the control transistor Tr_C is turned on as shown in FIG. 4F. Then, the second node N2 and the third node N3 are short-circuited to each other through the turned-on control transistor Tr_C, resulting in a short circuit being formed between the gate electrode and drain electrode of the driving transistor Tr_D. As a result, the voltage on the second node N2 and the voltage on the third node N3 are mixed with each other and the mixed voltage is equally charged on the second and third nodes N2 and N3. This mixed voltage must be set to be higher than the threshold voltage Vth of the driving transistor Tr_D. To this end, in the previous period, each of the voltage on the second node N2 and the voltage on the third node N3 was set to be higher than the threshold voltage Vth.

The driving transistor Tr_D with its gate electrode and drain electrode short-circuited is turned on to operate as a diode. At this time, the mixed voltage gradually decreases toward the threshold voltage Vth of the driving transistor Tr_D, and the driving transistor Tr_D is turned off at the moment that the mixed voltage becomes equal to the threshold voltage Vth. Consequently, at the moment that the driving transistor Tr_D is turned off, the threshold voltage Vth of the driving transistor Tr_D is stored on each of the second and third nodes N2 and N3.

In this manner, in the threshold voltage detection period D3 including the sixth period T6, the threshold voltage Vth of the driving transistor Tr_D is stored on each of the second and third nodes N2 and N3. In this threshold voltage detection period D3, the threshold voltage Vth of the driving transistor Tr_D is stored on each of the second and third nodes N2 and N3 of each of all the pixel cells PXL. Since the driving transistors Tr_D of the respective pixel cells PXL may be different in characteristic from one another depending on manufacturing environments thereof, the threshold voltages Vth stored on the second and third nodes N2 and N3 of the respective pixel cells PXL may be different in level from one another.

Next, a description will be given of an operation in a seventh period T7 with reference to FIGS. 4G and 3.

In the seventh period T7, as shown in FIG. 3, the first driving voltage VDD is maintained at the middle voltage M, the second driving voltage VSS and data voltage Data are maintained at the low voltage L and all the scan signals are maintained at the high voltage H, whereas the control signal Vc is changed from the high voltage H to the low voltage L.

Figure 4G:
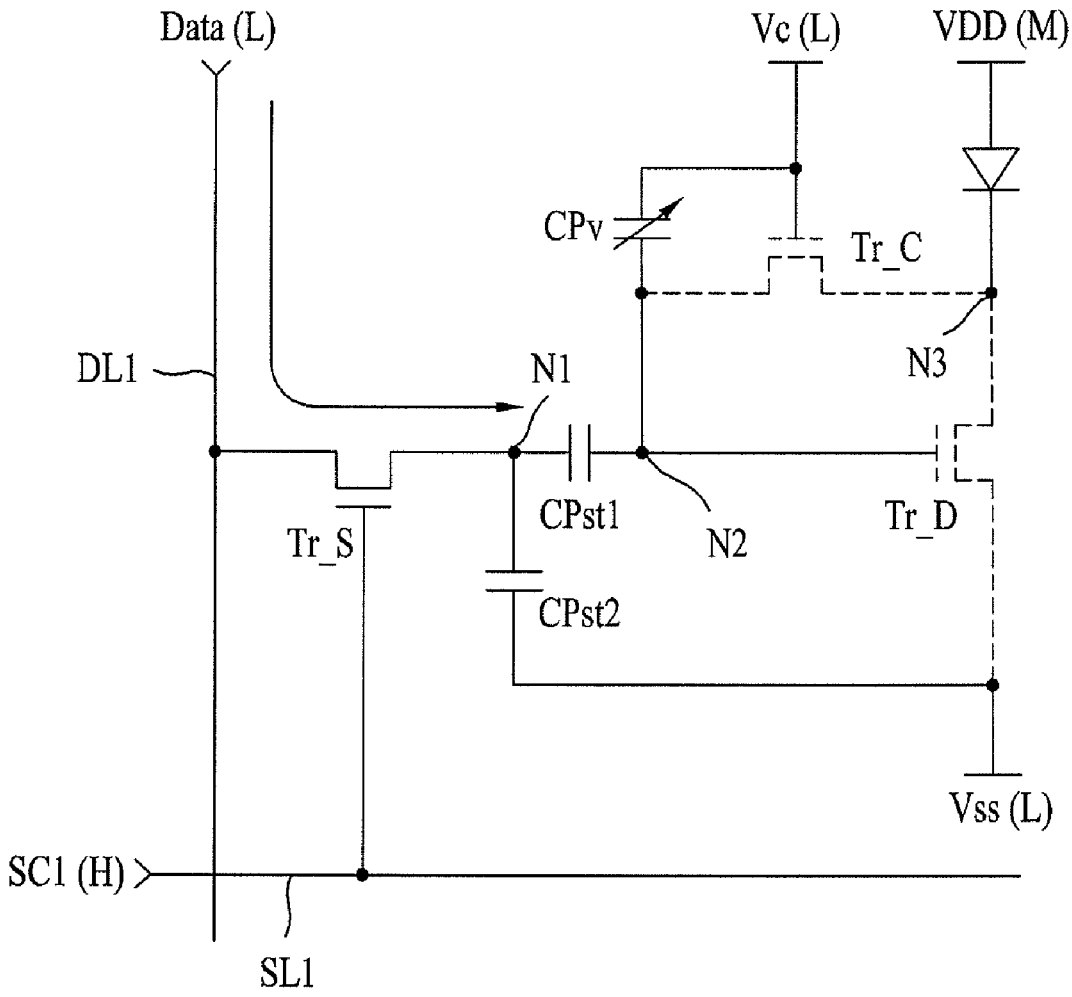

As the control signal Vc falls to the low voltage L, the control transistor Tr_C is turned off as shown in FIG. 4G. Also, in this seventh period T7, the threshold voltage Vth of the driving transistor Tr_D is kept stored on each of the second and third nodes N2 and N3.

Figure 4H:
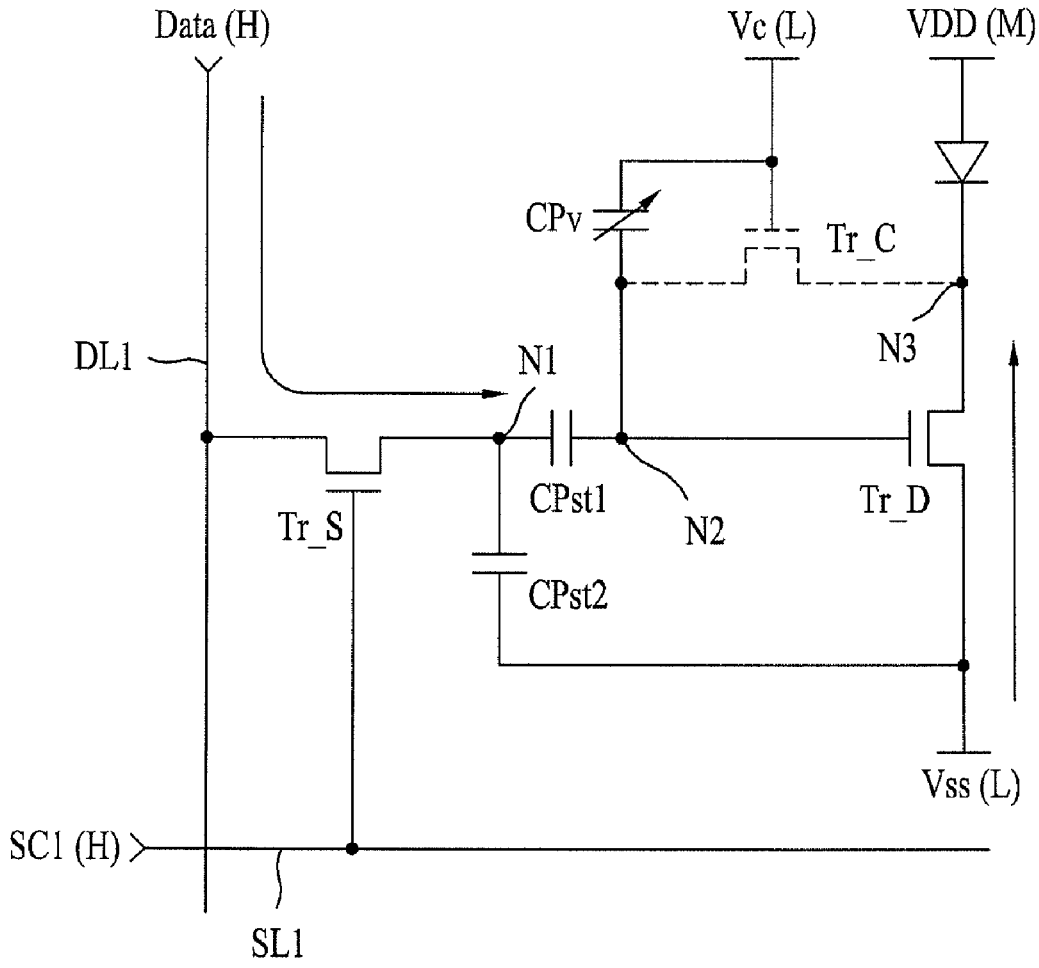

Next, a description will be given of an operation in an eighth period T8 with reference to FIGS. 4H and 3.

In the eighth period T8, as shown in FIG. 3, the first driving voltage VDD is maintained at the middle voltage M, the second driving voltage VSS and control signal Vc are maintained at the low voltage L and all the scan signals are maintained at the high voltage H, whereas the data voltage Data is changed from the low voltage L to the high voltage H.

As the data voltage Data rises to the high voltage H, both the voltage on the first node N1 and the voltage on the second node N2 rise. As a result, the driving transistor Tr_D is turned on, and the second driving voltage VSS of the low voltage L is supplied to the third node N3 through the turned-on driving transistor Tr_D. Accordingly, all the third nodes N3 of all the pixel cells PXL are initialized to the same voltage level.

This eighth period T8 is a period in which the third node N3 is pre-initialized to set up the driving of the light emitting element OLED by input of actual data.

Since the threshold voltages Vth of the driving transistors Tr_D of the respective pixel cells PXL may be different in level from one another as stated above, the voltage levels of the third nodes N3 of the respective pixel cells PXL on which these threshold voltages Vth are stored may be different from one another with respect to all the pixel cells PXL. In this connection, it is preferable to initialize all the third nodes N3 of all the pixel cells PXL to the same second driving voltage VSS by supplying data of the high voltage H to all the pixel cells PXL in the eighth period T8.

Figure 4I:
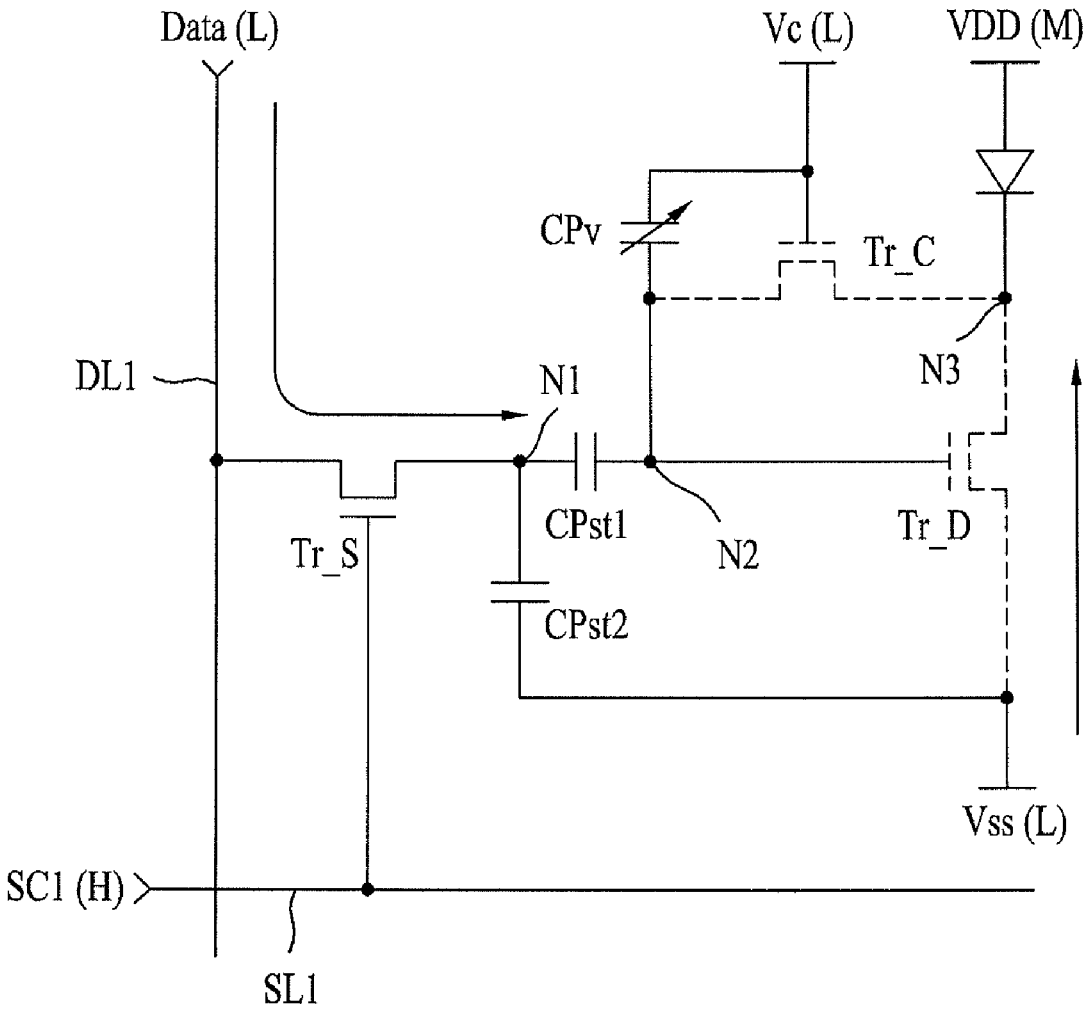

Next, a description will be given of an operation in a ninth period T9 with reference to FIGS. 4I and 3.

In the ninth period T9, as shown in FIG. 3, the first driving voltage VDD is maintained at the middle voltage M, the second driving voltage VSS and control signal Vc are maintained at the low voltage L and all the scan signals are maintained at the high voltage H, whereas the data voltage Data is changed from the high voltage H to the low voltage L.

As the data voltage Data falls to the low voltage L, both the voltage on the first node N1 and the voltage on the second node N2 fall. Also, the second node N2 returns to the previously set threshold voltage Vth. As a result, the driving transistor Tr_D is turned off. Consequently, the third node N3 is initialized to the second driving voltage VSS and the second node N2 stores the threshold voltage Vth.

Figure 4J:
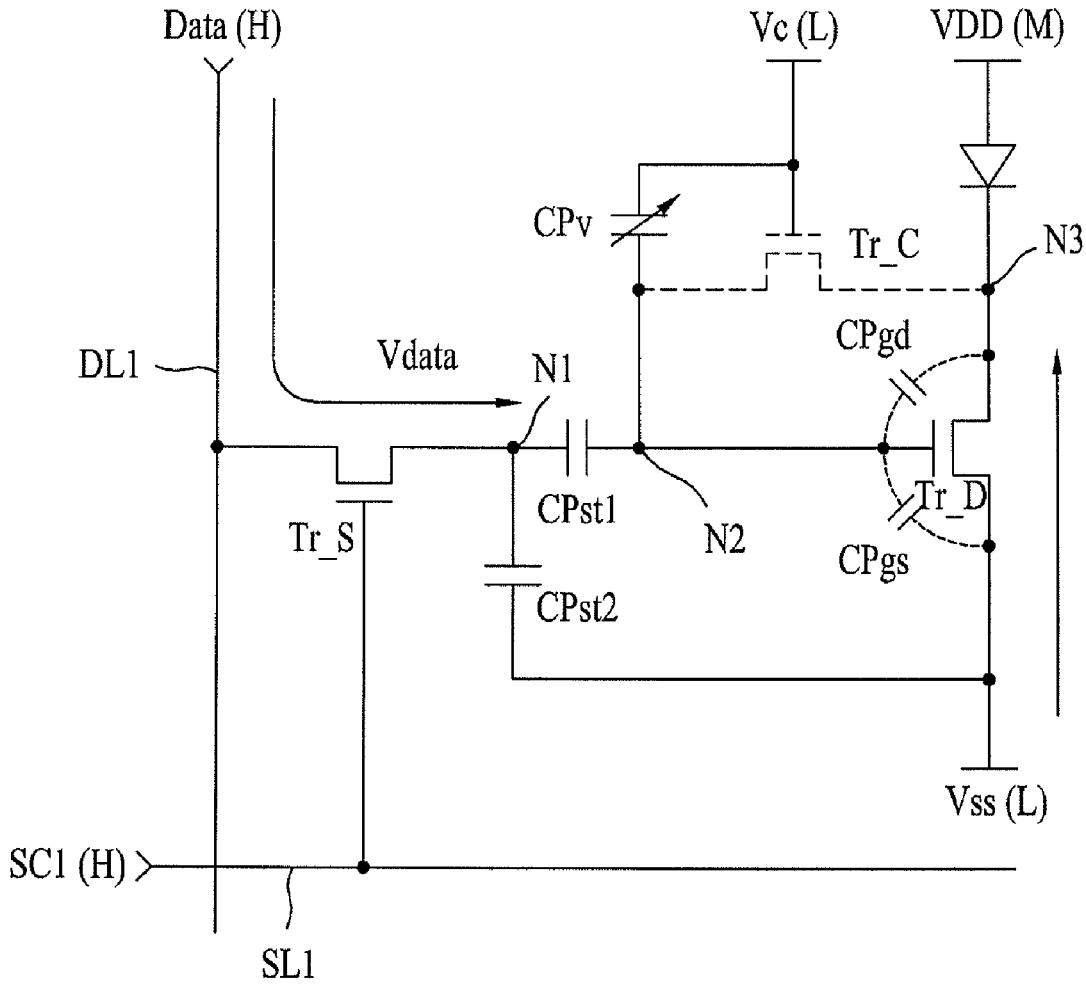

Next, a description will be given of an operation in a tenth period T10 with reference to FIGS. 4J and 3.

In the tenth period T10, as shown in FIG. 3, the first driving voltage VDD is maintained at the middle voltage M and the second driving voltage VSS and control signal Vc are maintained at the low voltage L.

Also, all the scan signals are sequentially maintained at the high voltage H for certain periods. That is, the tenth period T10 is the actual data input period D5 and includes (10-1)th to (10-n)th periods T10-1 to T10-n. The first to nth scan signals SC1 to SCn are sequentially maintained at the high voltage H for corresponding ones of the (10-1)th to (10-n)th periods T10-1 to T10-n.Also, data supplied to the m data lines for the tenth period T10 are actual data to be actually expressed, each of which is maintained at the high voltage H of 0 to several ten V for the tenth period T10.

Only the first scan line SL1, among the plurality of scan lines, is driven in the (10-1)th period T10-1, only the second scan line SL2, among the plurality of scan lines, is driven in the (10-2)th period T10-2, only the third scan line SL3, among the plurality of scan lines, is driven in the (10-3)th period T10-3, . . . , and only the nth scan line SLn, among the plurality of scan lines, is driven in the (10-n)th period T10-n.

When each scan line is driven, all pixel cells PXL of one horizontal line connected to the corresponding scan line are driven. As a result, when one scan line is driven, actual data are supplied to pixel cells PXL of one horizontal line connected to that scan line.

A process of supplying the actual data will hereinafter be described in connection with the first pixel cell PXL as an example.

The first pixel cell PXL is supplied with data of the high voltage H in the (10-1)th period T10-1. This data is supplied to the first node N1 over the first data line DL1. As a result, the voltage on the first node N1 rises to the data voltage Data, and the voltage on the second node N2 also rises as the voltage on the first node N1 rises. That is, the voltage on the second node N2 is raised by the first storage capacitor CPst1 connected between the first node N1 and the second node N2. At this time, the voltage on the second node N2 further rises by the level of the voltage inputted to the first node N1.

This will hereinafter be described in more detail. Here, for the convenience of description, the actual data supplied to the first node N1 will be denoted by reference character Vdata.

Since the threshold voltage Vth of the driving transistor Tr_D detected in the above-stated threshold voltage detection period D3 is kept stored on the second node N2, the voltage on the second node N2 is defined as the sum of the actual data and the threshold voltage Vth as the actual data is applied to the first node N1. However, because the voltage on the second node N2 is influenced by various parasitic capacitors existing in the driving transistor Tr_D and the first storage capacitor CPst1, it can be defined by the following equation 1.

$$Vn2 = Vth + \frac{Cst1}{Cst1 + Cgs + Cgd + Cv} \cdot Vdata \quad \text{[Equation 1]}$$

In the above equation 1, Vn2 signifies the voltage on the second node N2, Cst1 signifies the capacitance of the first storage capacitor CPst1, Cgs signifies the capacitance of a parasitic capacitor Cgs existing between the gate electrode and source electrode of the driving transistor Tr_D, and Cgd signifies the capacitance of a parasitic capacitor Cgd existing between the gate electrode and drain electrode of the driving transistor Tr_D.

The voltage level of the second node N2 may deviate from an originally intended compensated value (threshold voltage Vth+actual data voltage Data) due to the parasitic capacitors Cgs and Cgd as stated above, resulting in some degradation in threshold voltage Vth compensation capability. However, this problem can be solved by the variable capacitor CPv. That is, the variable capacitor CPv is designed to have a proper size and a variable capacitance to compensate for a voltage deviation of the second node N2 which occurs due to the parasitic capacitances of the parasitic capacitors Cgs and Cgd. In detail, the variable capacitor CPv minimizes the parasitic capacitances by offsetting them by a compensation capacitance opposite thereto.

In the actual data input period D5, a voltage corresponding to the sum of the threshold voltage Vth of the driving transistor Tr_D and the actual data voltage Data is sequentially stored on the second node N2 of each of all the pixel cells PXL on a horizontal line basis. That is, a driving voltage (the threshold voltage Vth of the driving transistor Tr_D+the actual data voltage Data) is stored on the second node N2 of each of the m pixel cells PXL arranged along the first horizontal line HL1 in the (10-1)th period T10-1, a driving voltage is then stored on the second node N2 of each of the m pixel cells PXL arranged along the second horizontal line HL2 in the (10-2)th period T10-2, a driving voltage is then stored on the second node N2 of each of the m pixel cells PXL arranged along the third horizontal line HL3 in the (10-3)th period T10-3, . . . , and a driving voltage is then stored on the second node N2 of each of the m pixel cells PXL arranged along the nth horizontal line HLn in the (10-n)th period T10-n. Accordingly, the driving transistors Tr_D of all the pixel cells PXL are sequentially turned on on a horizontal line basis. At this time, because the first driving voltage VDD is maintained at the low voltage L, no driving current is generated although the driving transistor Tr_D is turned on. Consequently, the light emitting element OLED emits no light in the tenth period T10.

Figure 4K:
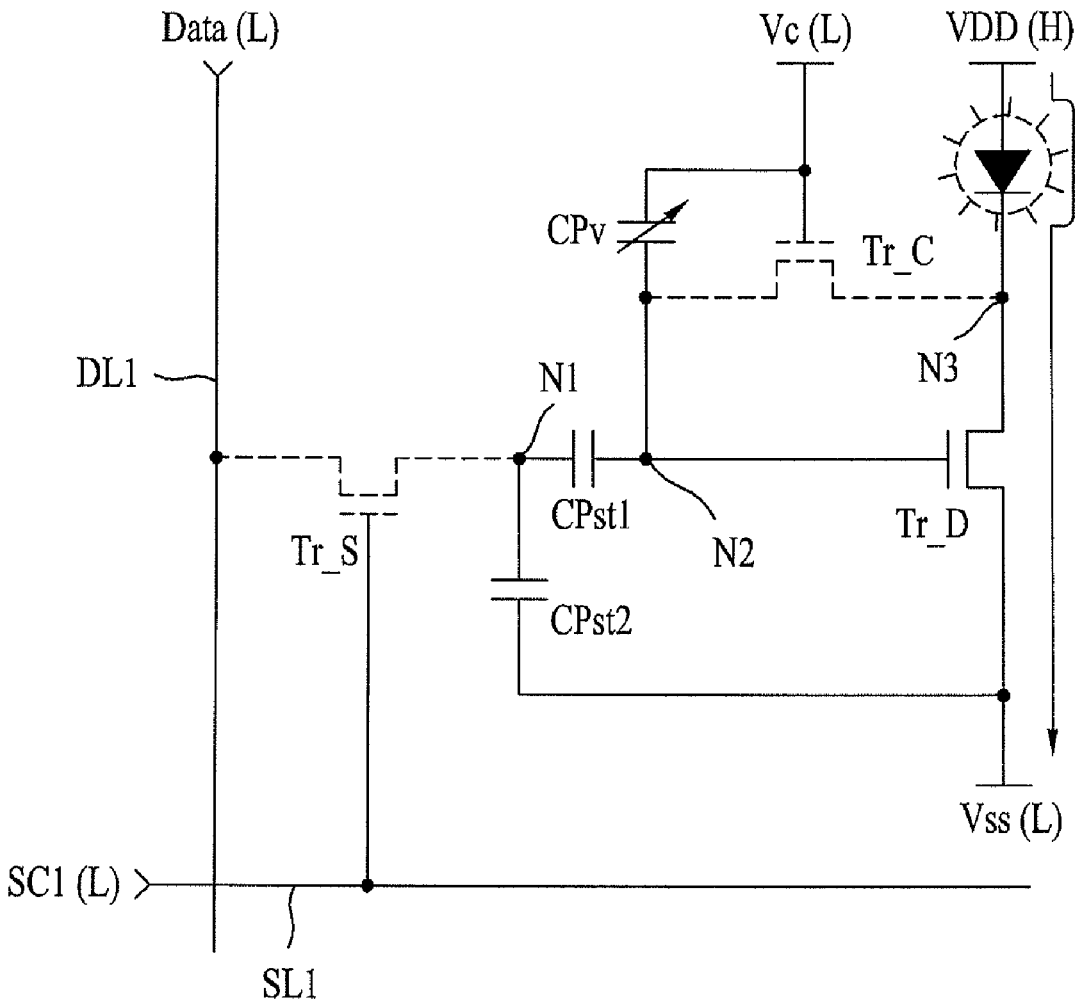

Next, a description will be given of an operation in an eleventh period T1 1 with reference to FIGS. 4K and 3.

In the eleventh period T11, as shown in FIG. 3, the second driving voltage VSS, control signal Vc and all the scan signals are maintained at the low voltage L, whereas the data voltage Data is changed from the high voltage H to the low voltage L. Particularly, this eleventh period T11 is the light emitting period D6 in which the light emitting elements OLED of all the pixel cells PXL emit light. To this end, in the eleventh period T11, the first driving voltage VDD is changed from the middle voltage M to the high voltage H.

As the first driving voltage VDD rises to the high voltage H, the turned-on driving transistor Tr_D of each of all the pixel cells PXL allows driving current to flow through the drain electrode and source electrode thereof. As each driving current is transmitted to the cathode electrode of the corresponding light emitting element OLED through the anode electrode thereof, the light emitting element OLED of each pixel cell PXL emits light with a brightness corresponding to the amount of the driving current supplied thereto.

At this time, the driving current supplied to each light emitting element OLED can be defined by the following equation 2.

$$I_{OLED} = \frac{\beta}{2} \cdot (Vgs - Vth)^2 = \frac{\beta}{2} \cdot (V_{n2} - Vss - Vth)^2 = \frac{\beta}{2} \cdot \left( \frac{Cst1}{Cst1 + Cgs + Cgd + Cv} \cdot Vdata - Vss \right)^2. \quad \text{[Equation 2]}$$

Here, $I_{OLED}$ signifies current flowing from the drain electrode of the driving transistor Tr_D to the source electrode thereof, Vgs signifies a gate-source voltage of the driving transistor Tr_D, and β signifies a constant.

Second Embodiment

Figure 5:
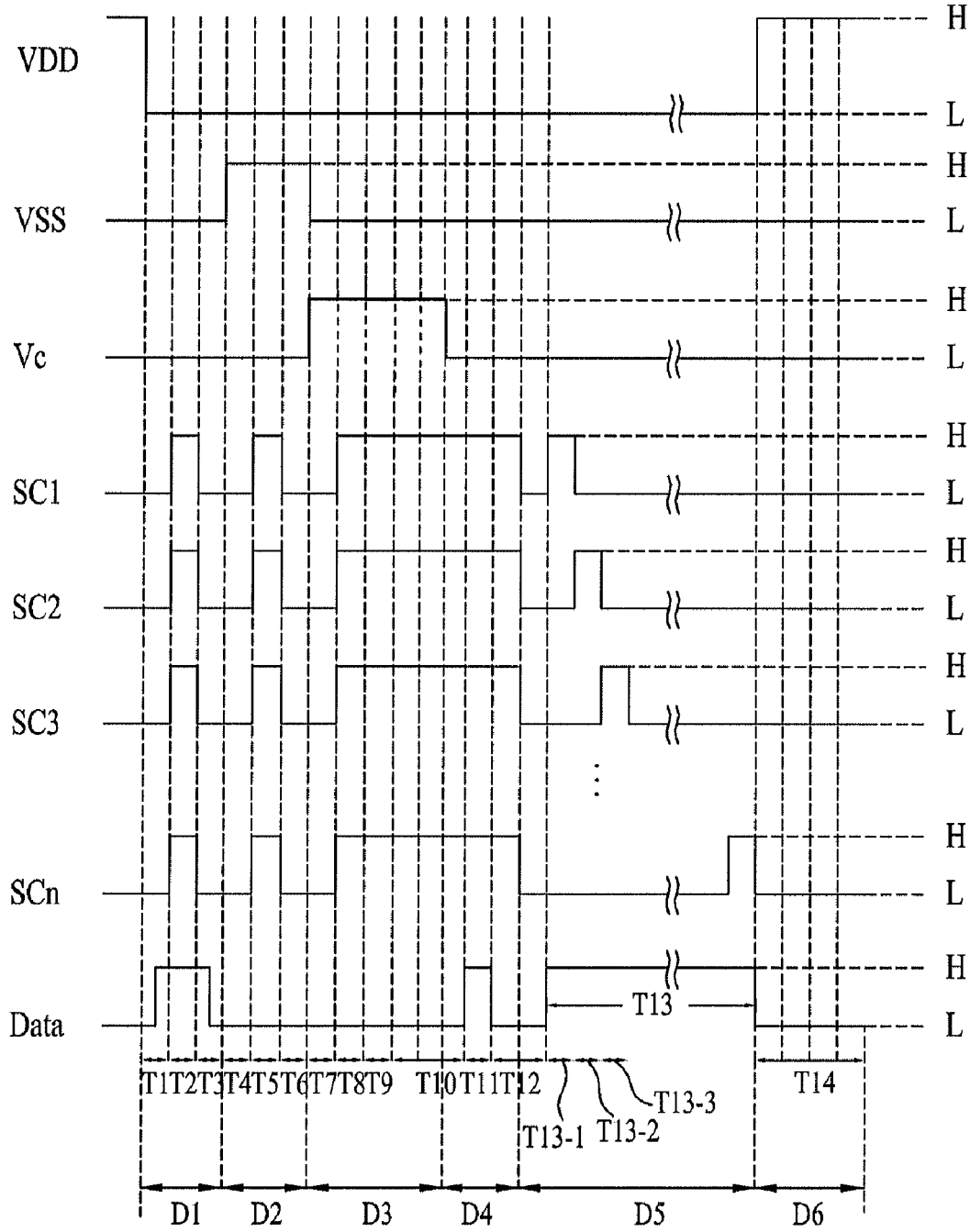
FIG. 5 is a waveform diagram of various signals which are supplied to a display panel including a plurality of pixel cells each having a structure as in FIG. 2, according to a second embodiment of the present invention.

FIG. 5 is a waveform diagram of various signals which are supplied to the display panel 100 including a plurality of pixel cells PXL each having a structure as in FIG. 2, according to a second embodiment of the present invention.

A light emitting display according to the second embodiment of the present invention includes, as shown in FIG. 5, a first initialization period D1, a threshold voltage detection setup period D2, a threshold voltage detection period D3, a second initialization period D4, an actual data input period D5, and a light emitting period D6.

The first driving voltage VDD is an AC signal having different levels of two steps, as shown in FIG. 5. That is, the first driving voltage VDD is a signal having a high voltage H of a highest level and a low voltage L of a lowest level. This first driving voltage VDD periodically exhibits the low voltage L and the high voltage H.

The high voltage H of the first driving voltage VDD may be set to about 15V and the low voltage L thereof may be set to about −10V, and these values may be freely changed depending on circuit configurations.

The first driving voltage VDD is maintained at the low voltage L for the first initialization period D1, while at the high voltage H for the light emitting period D6.

The second driving voltage VSS is an AC signal having different levels of two steps, as shown in FIG. 5. That is, the second driving voltage VSS is a signal having a high voltage H of a relatively high level and a low voltage L of a relatively low level. This second driving voltage VSS periodically exhibits the low voltage L and the high voltage H.

The high voltage H of the second driving voltage VSS may be set to about 15V and the low voltage L thereof may be set to about 0V, and these values may be freely changed depending on circuit configurations.

The second driving voltage VSS is maintained at the high voltage H for only the threshold voltage detection setup period D2 and at the low voltage L for the other periods.

The control signal Vc is maintained at a high voltage H in the threshold voltage detection period D3 and at a low voltage L in the other periods, as shown in FIG. 5.

Each scan signal is maintained at a high voltage H for the first initialization period D1, threshold voltage detection setup period D2, threshold voltage detection period D3 and second initialization period D4 and also sequentially maintained at the high voltage H for the actual data input period D5. That is, as shown in FIG. 5, the first scan signal SC1 is maintained at the high voltage H for a (13-1)th period T13-1 that is a first preceding period of the actual data input period D5, the second scan signal SC2 is maintained at the high voltage H for a (13-2)th period T13-2 that is a second preceding period of the actual data input period D5, and the third scan signal SC3 is maintained at the high voltage H for a (13-3)th period T13-3 that is a third preceding period of the actual data input period D5.

The data voltage Data is maintained at a high voltage H for the first initialization period D1, the second initialization period D4 and the actual data input period D5 and at a low voltage L for the other periods.

The high voltages H of the aforementioned respective signals may have the same level or different levels. Similarly, the low voltages L of the respective signals may have the same level or different levels.

Hereinafter, the operations of the pixel cells PXL supplied with the above-stated signals will be described in detail.

Figure 6A:
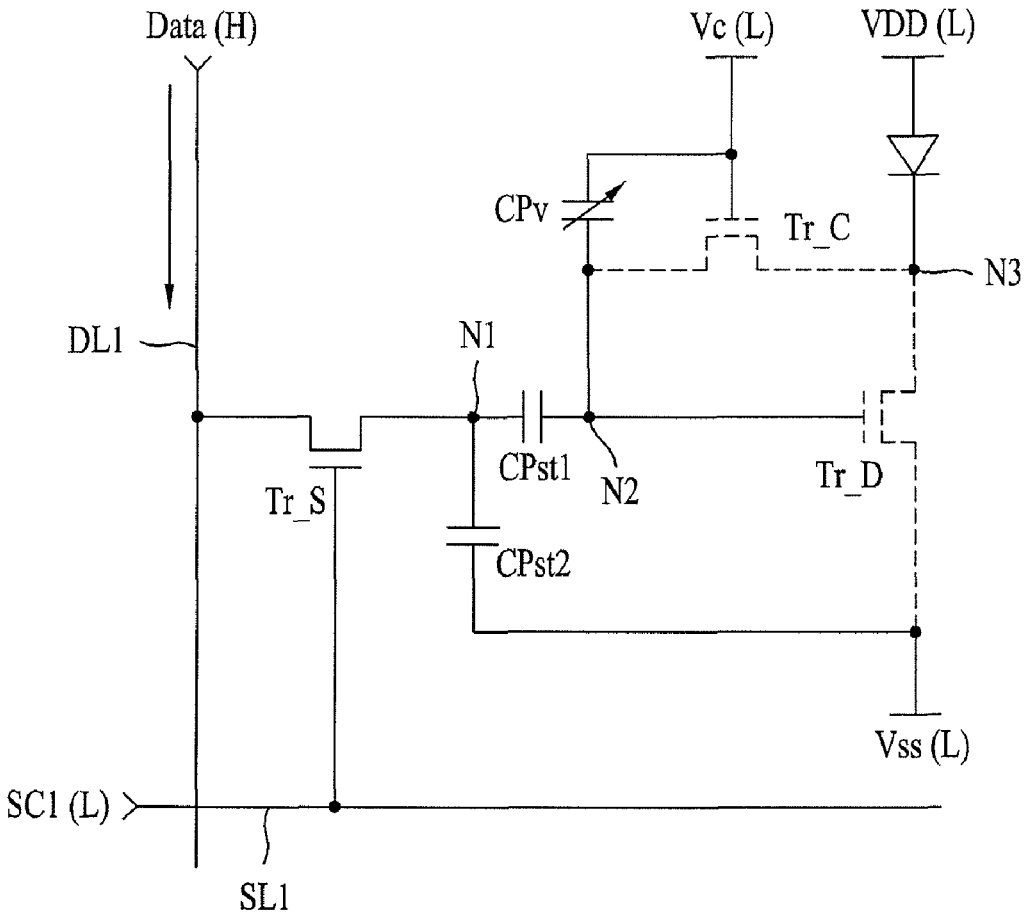
FIGS. 6A to 6N are circuit diagrams illustrating the operation of a light emitting display according to the second embodiment of the present invention.
Figure 6B:
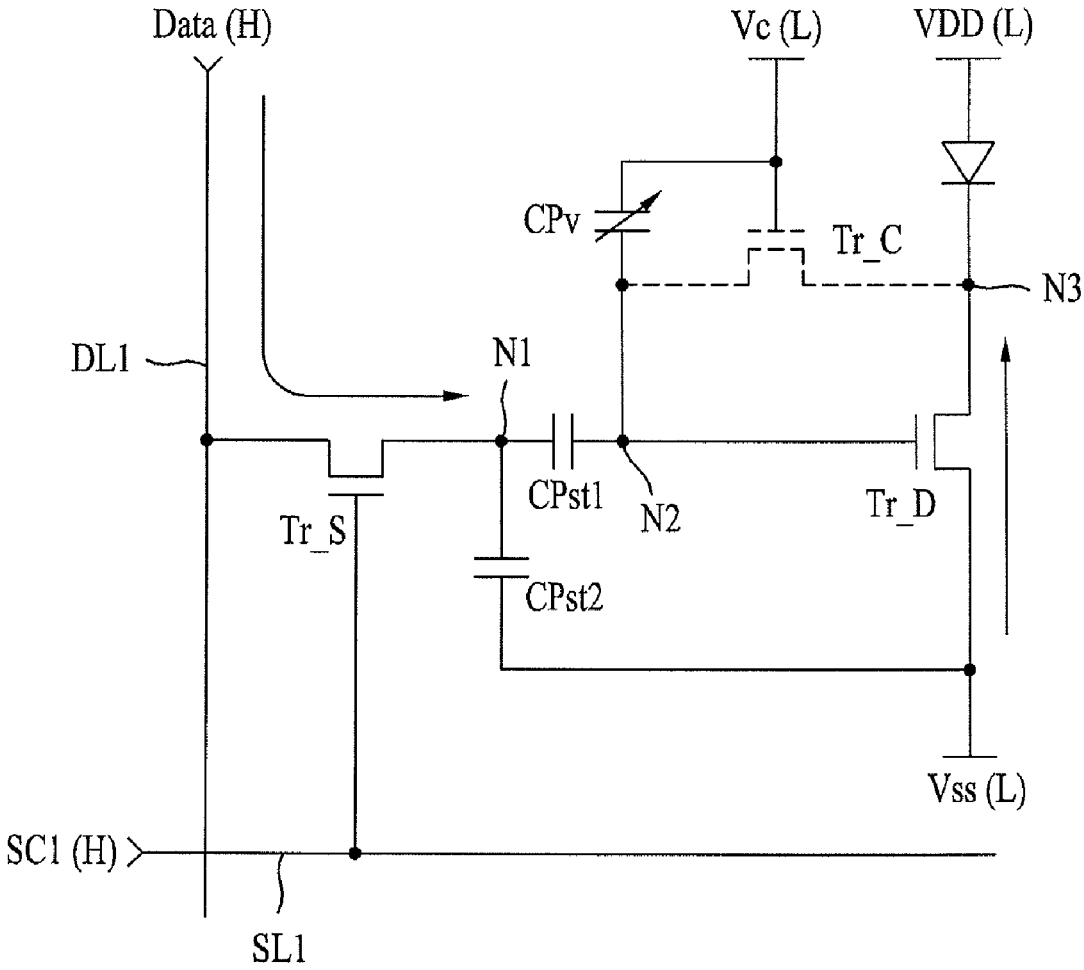
Figure 6C:
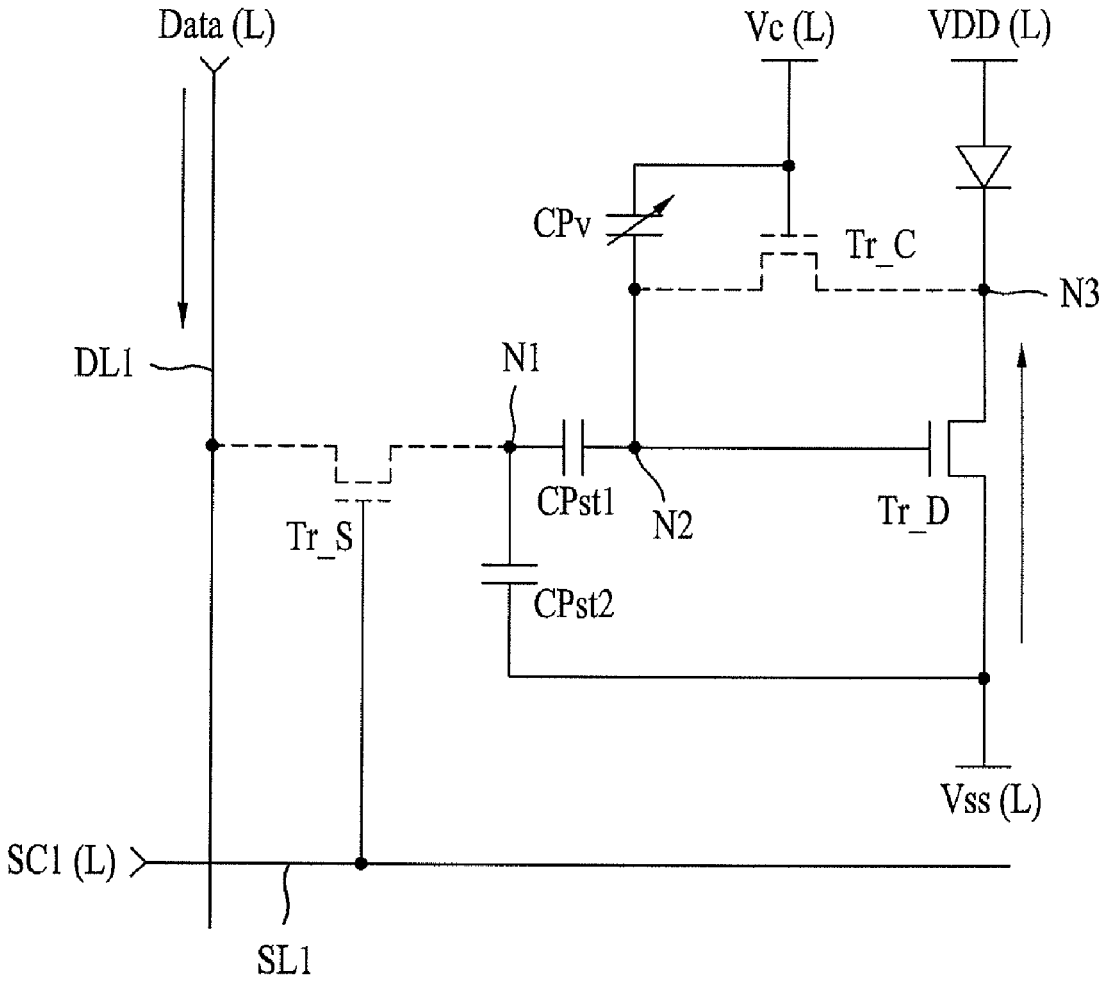
Figure 6D:
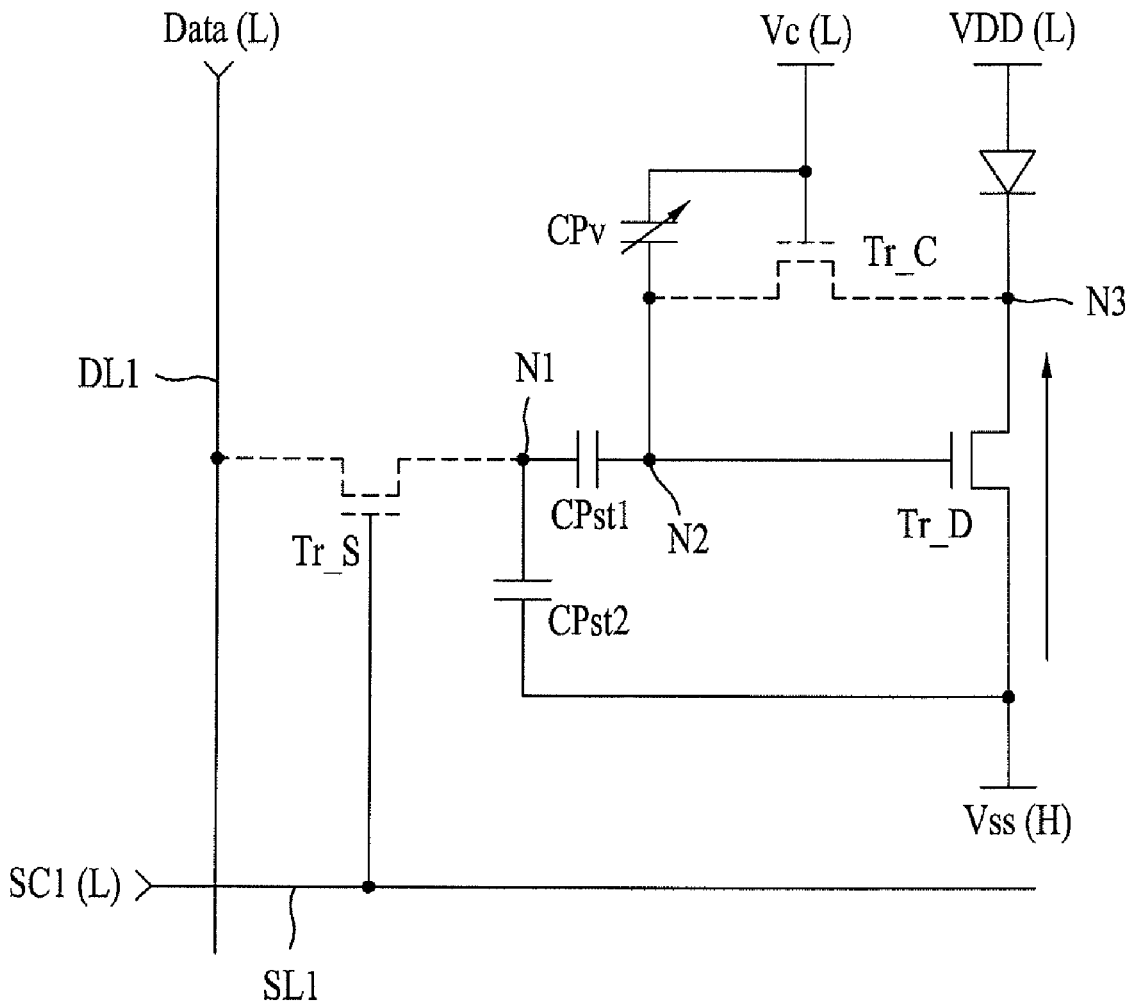
Figure 6E:
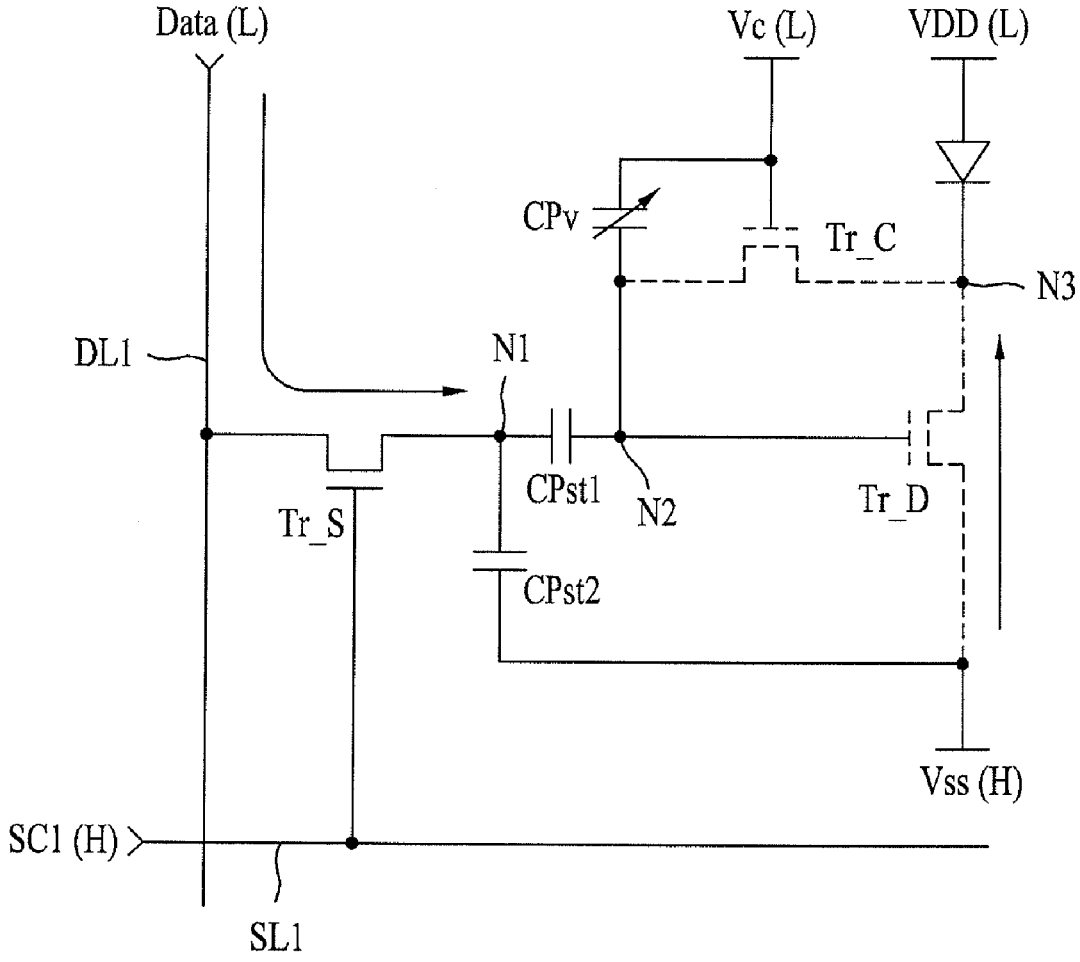
Figure 6F:
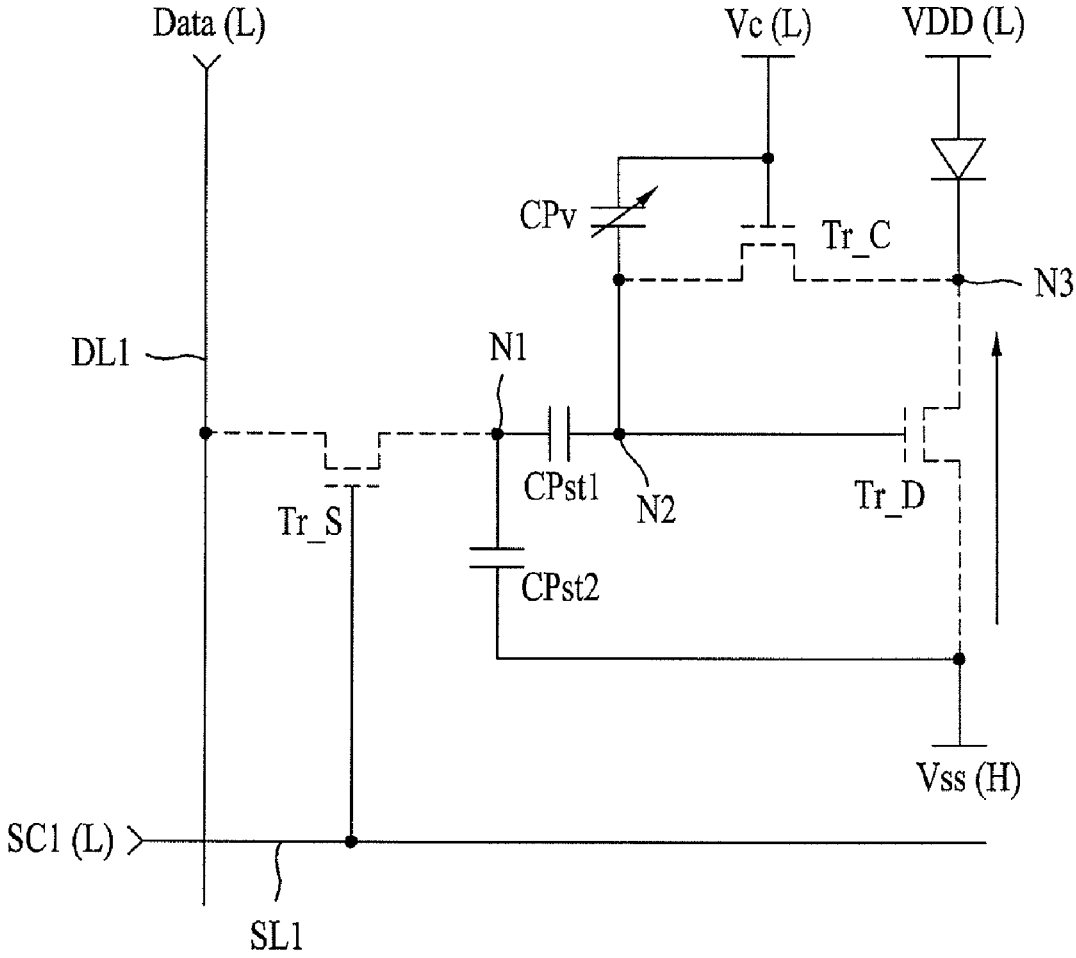
Figure 6G:
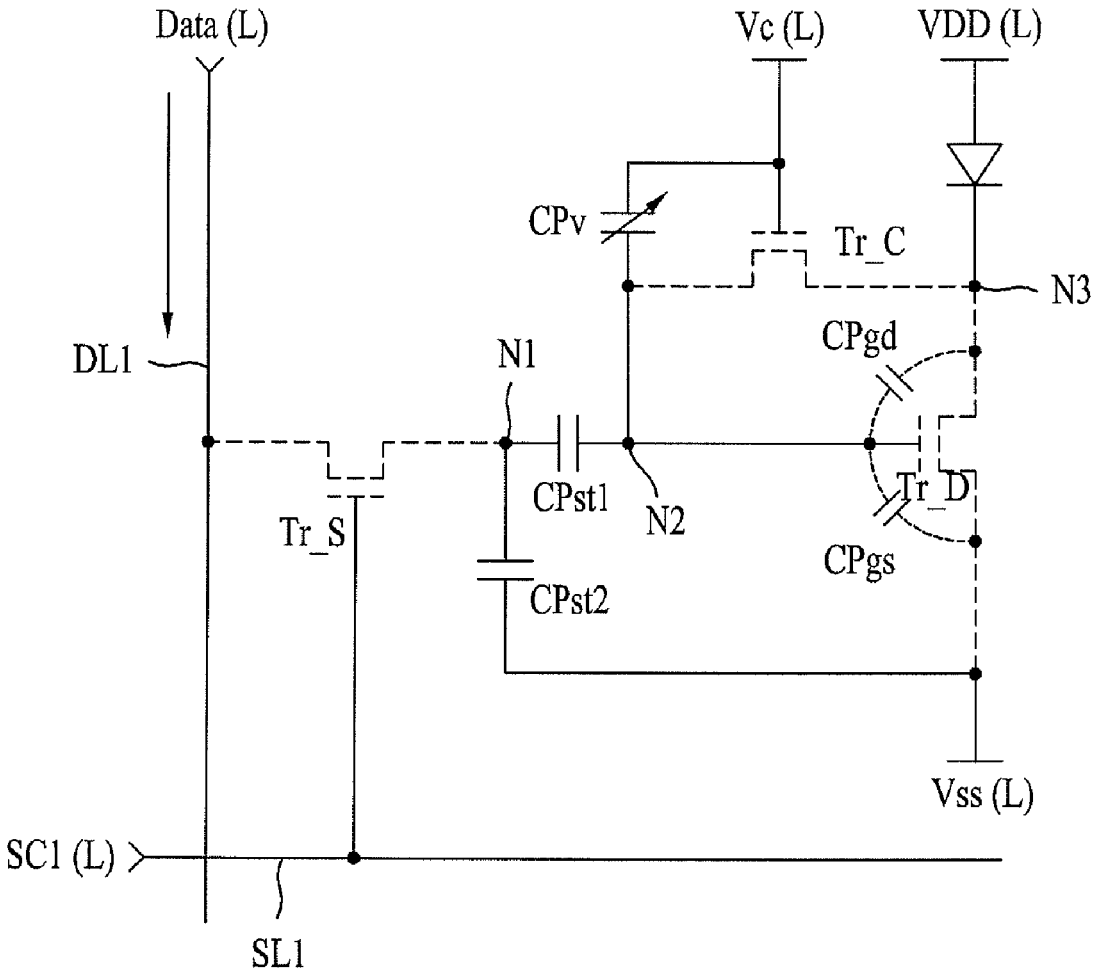
Figure 6H:
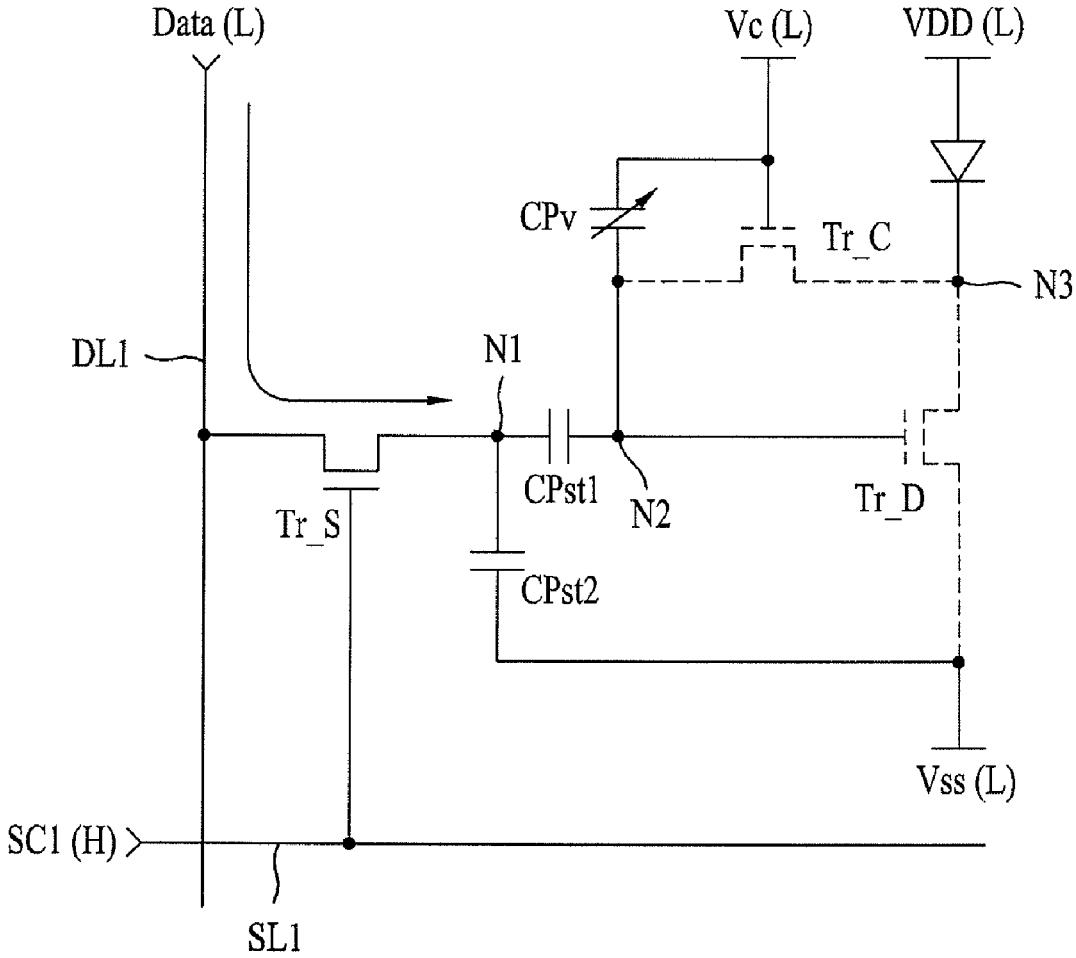
Figure 6I:
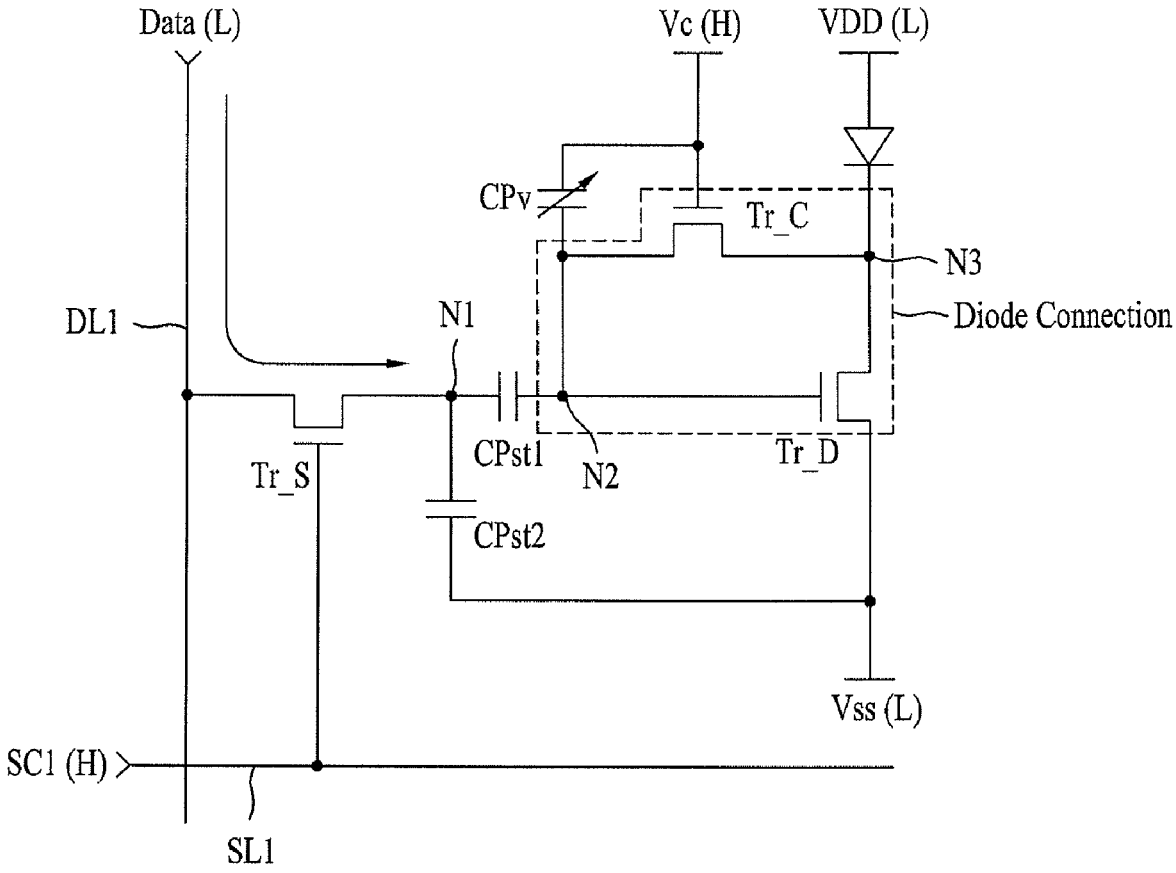
Figure 6J:
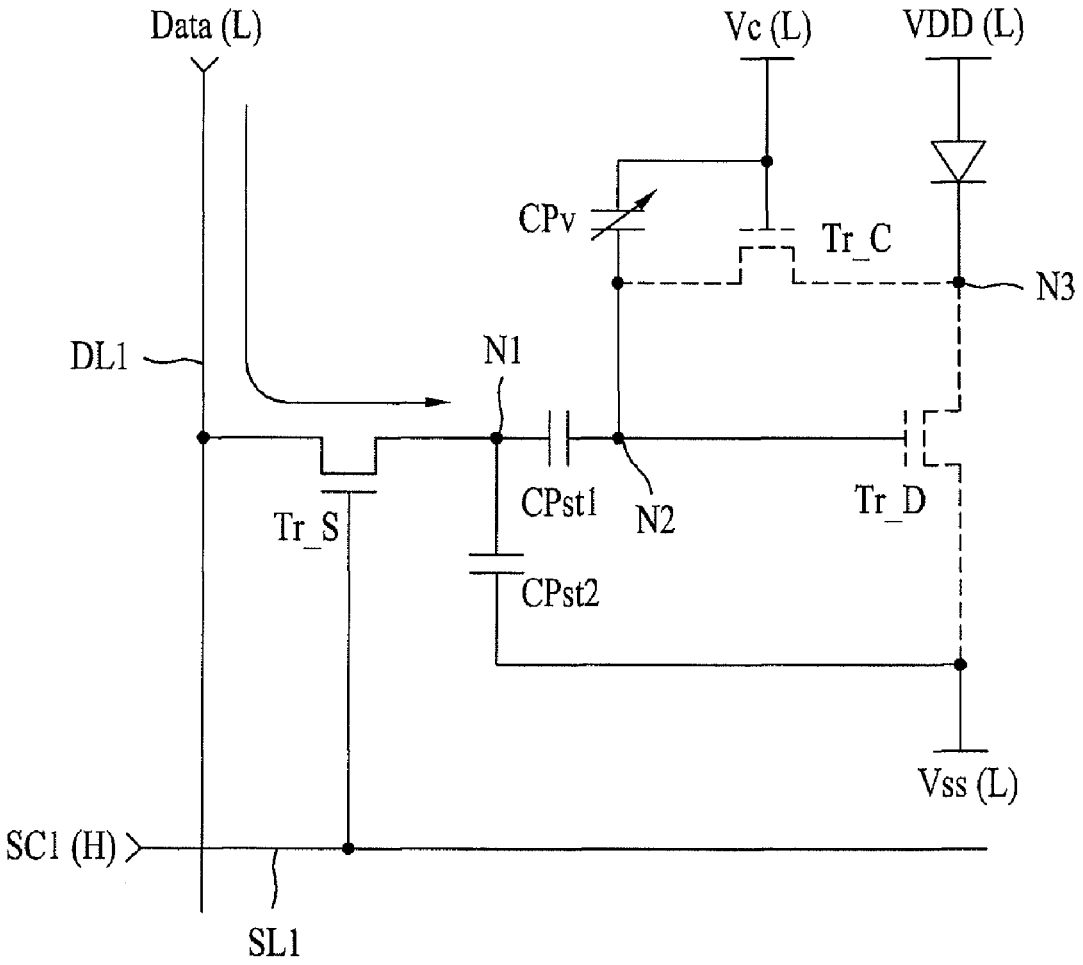
Figure 6K:
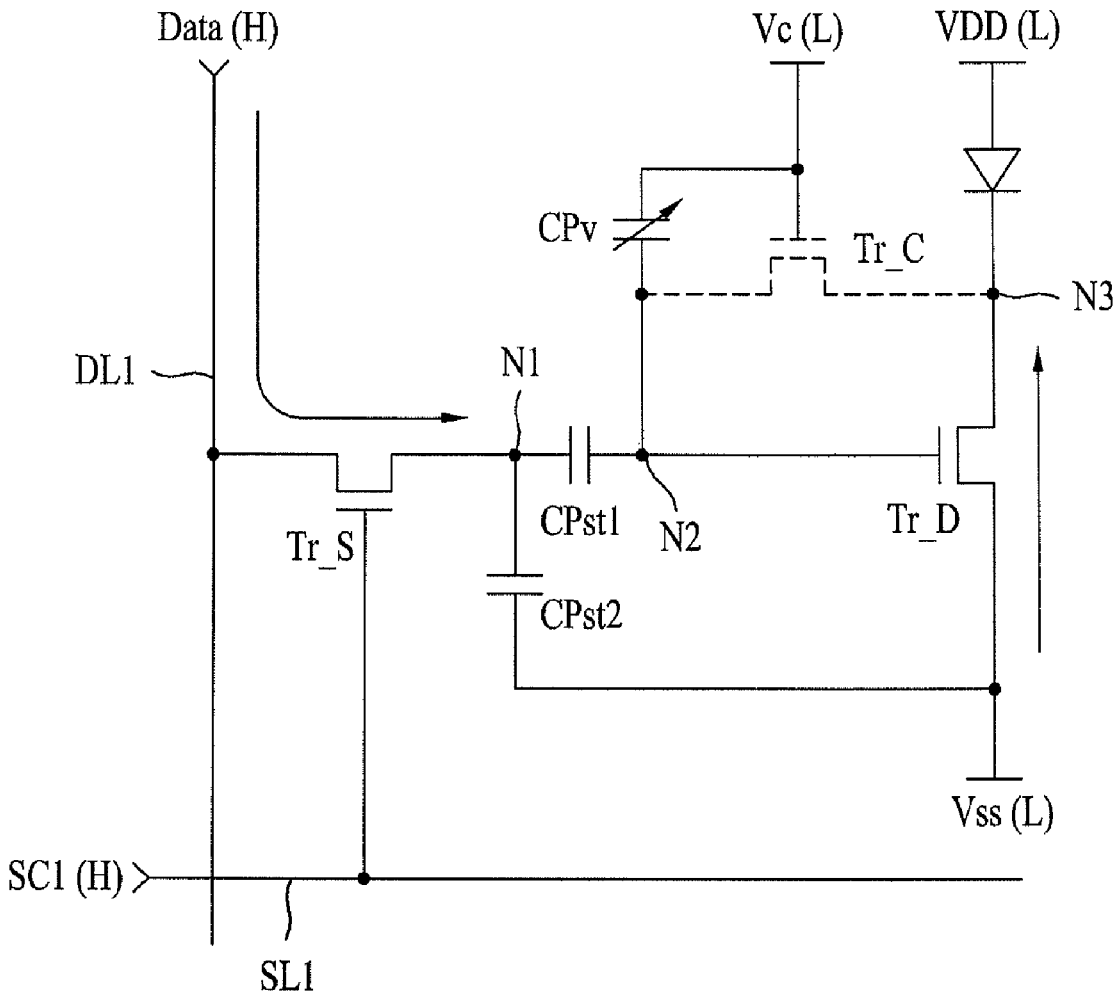
Figure 6L:
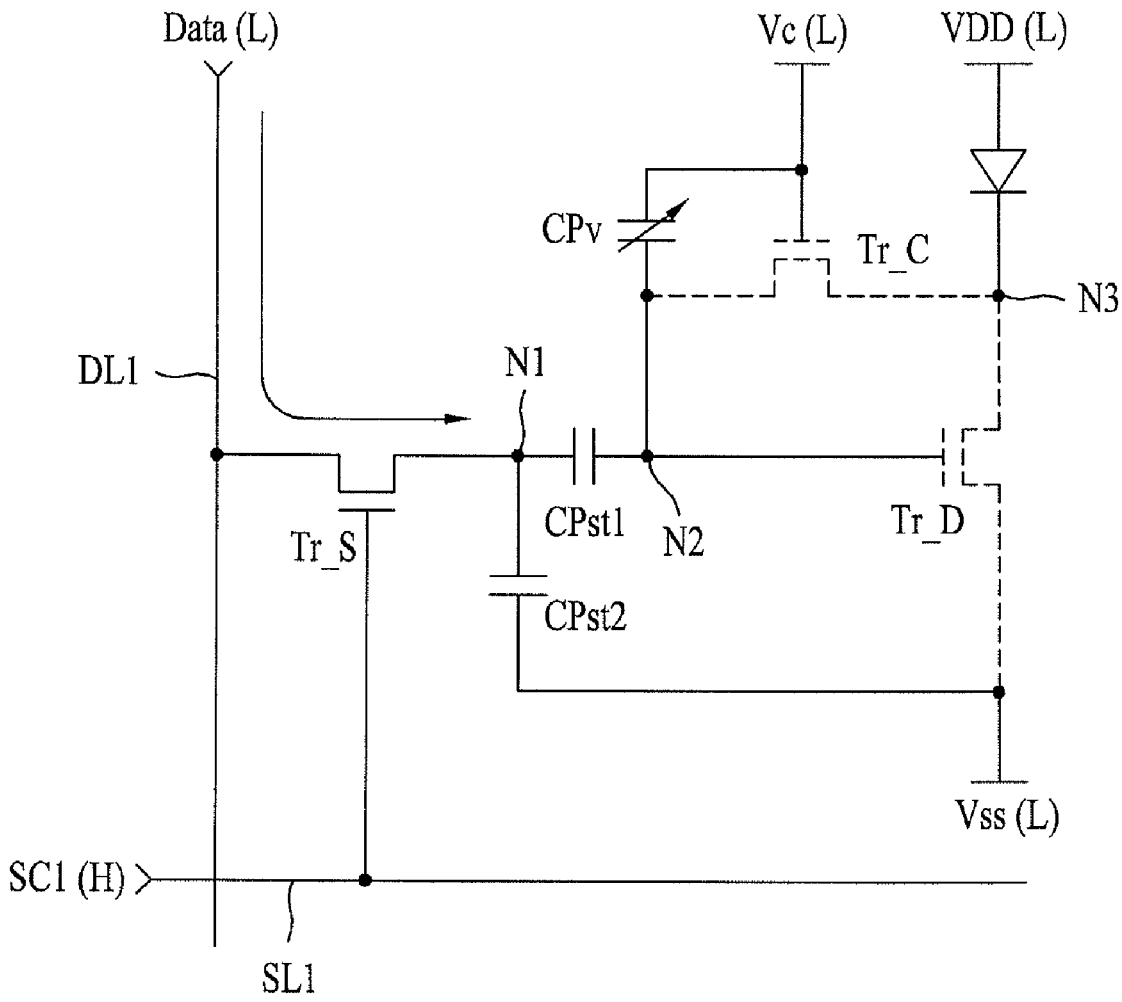
Figure 6M:
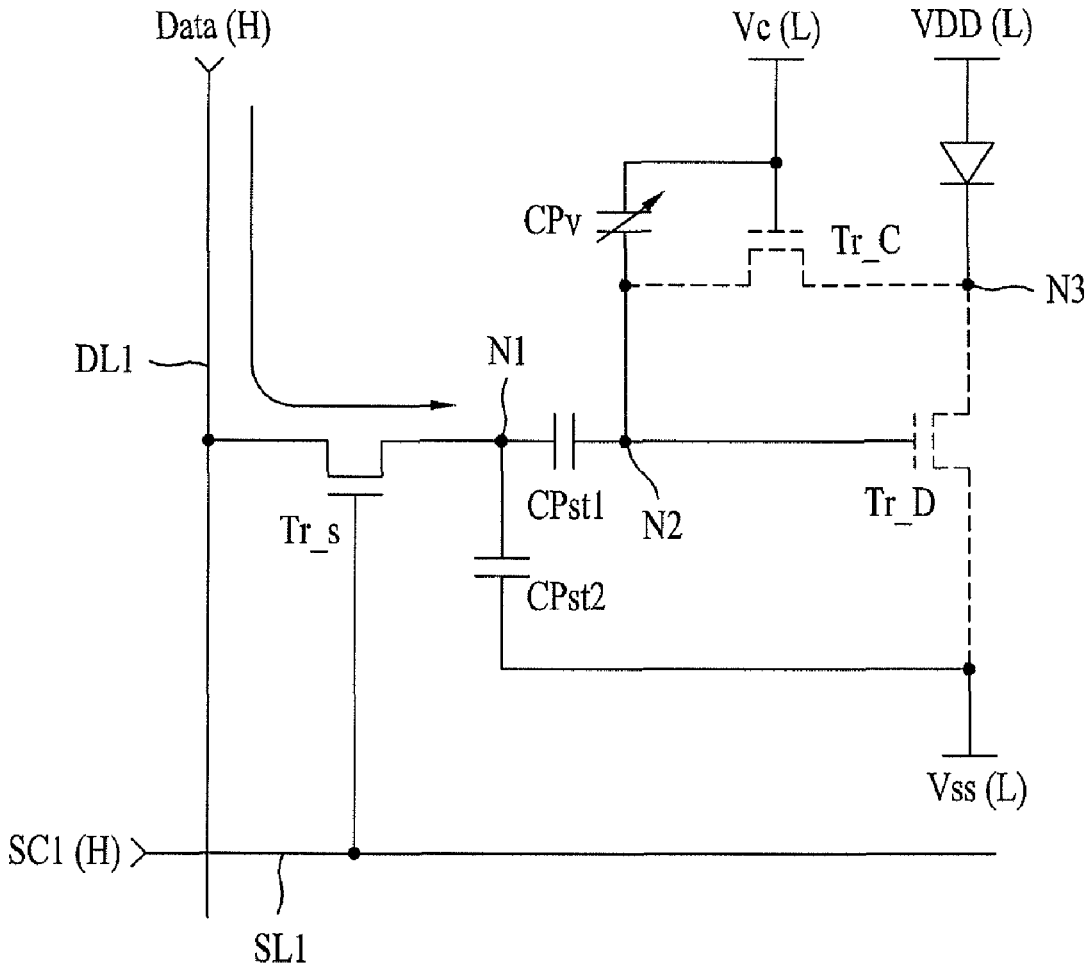
Figure 6N:
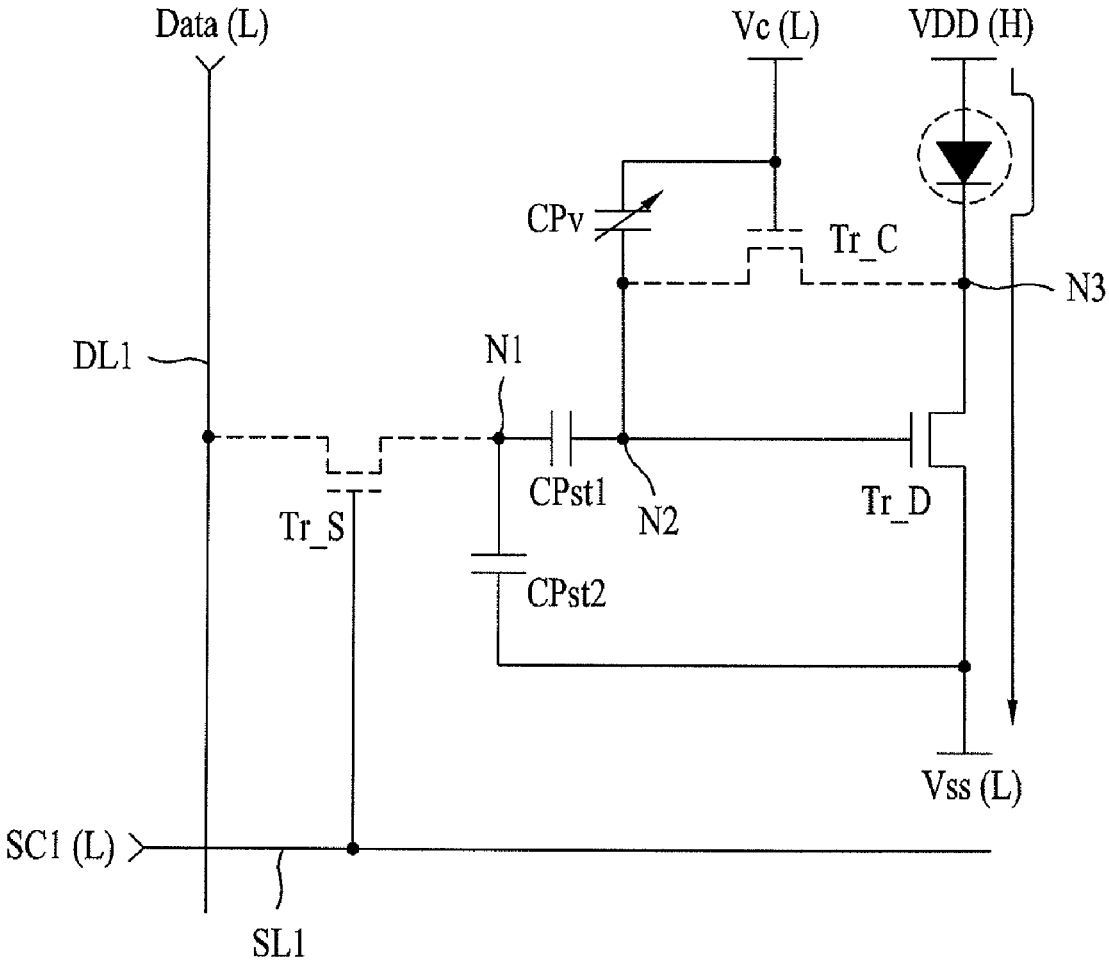

FIGS. 6A to 6N are circuit diagrams illustrating the operation of the light emitting display according to the second embodiment of the present invention.

Here, because the operations of all the pixel cells PXL are the same, the operation of the first pixel cell PXL connected to the first scan line SL1 and the first data line DL1 will be representatively described.

First, a description will be given of an operation in a first period T1 with reference to FIGS. 6A and 5.

In the first period T1, as shown in FIG. 5, the data voltage Data is changed from the low voltage L to the high voltage H, and the first driving voltage VDD, second driving voltage VSS, control signal Vc and scan signals are all maintained at the low voltage L. The data voltage Data is supplied to the first data line DL1 to charge the first data line DL1 to the high voltage H, as shown in FIG. 6A. In this first period T1, all the transistors and the light emitting element OLED are all kept turned off.

Because the data voltage Data of the high voltage H is supplied to the first data line DL1 for the first period T1 before the switching transistor Tr_S is turned on, the first data line DL1 will be adequately charged to a target voltage in a second period T2 to be described later.

Next, a description will be given of an operation in the second period T2 with reference to FIGS. 6B and 5.

In the second period T2, as shown in FIG. 5, the data voltage Data and all the scan signals are maintained at the high voltage H and the first driving voltage VDD, second driving voltage VSS and control signal Vc are maintained at the low voltage L. That is, in the second period T2, the scan signals are changed from the low voltage L to the high voltage H.

Because all the scan signals including the first scan signal SC1 assume the high voltage H, the switching transistor Tr_S, supplied with the first scan signal SC1 through the gate electrode thereof, is turned on as shown in FIG. 6B. Then, the data voltage Data (the data voltage Data of the high voltage H) from the first data line DL1 is supplied to the first node N1 through the turned-on switching transistor Tr_S. As a result, the first node N1 is charged to the high voltage H. At this time, the voltage on the second node N2 is raised by the first storage capacitor CPst1 connected between the first node N1 and the second node N2. Accordingly, the driving transistor Tr_D, connected to the second node N2 through the gate electrode thereof, is turned on. Then, the second driving voltage VSS of the low voltage L is supplied to the third node N3 through the turned-on driving transistor Tr_D. Consequently, the third node N3 is initialized. Here, the second driving voltage VSS is set to about 0V and the third node N3 is thus maintained at about 0V.

Next, a description will be given of an operation in a third period T3 with reference to FIGS. 6C and 5.

In the third period T3, as shown in FIG. 5, the first driving voltage VDD, second driving voltage VSS and control signal Vc are maintained at the low voltage L. Also, the data voltage Data is changed from the high voltage H to the low voltage L. Also, all the scan signals are changed from the high voltage H to the low voltage L.

Because all the scan signals including the first scan signal SC1 assume the low voltage L, the switching transistor Tr_S is turned off, as shown in FIG. 6C. As a result, the first node N1 floats. Accordingly, the data voltage Data of the high voltage H is applied across the second node N2, thereby causing the driving transistor Tr_D to be kept turned on.

Next, a description will be given of an operation in a fourth period T4 with reference to FIGS. 6D and 5.

In the fourth period T4, as shown in FIG. 5, the first driving voltage VDD, the control signal Vc, all the scan signals and the data voltage Data are maintained at the low voltage L. Also, the second driving voltage VSS is changed from the low voltage L to the high voltage H. As a result, the voltage on the first node N1 is raised by the second storage capacitor CPst2 and the voltage on the second node N2 is raised by the first storage capacitor CPst1 and a coupling phenomenon. This coupling phenomenon results from a parasitic capacitor formed between the gate electrode and source electrode of the driving transistor Tr_D. Accordingly, the driving transistor Tr_D is kept turned on. The second driving voltage VSS of the high voltage H is supplied to the third node N3 through the turned-on driving transistor Tr_D, so that a voltage resulting from the subtraction of a threshold voltage Vth of the driving transistor Tr_D from the second driving voltage VSS of the high voltage H is stored on the third node N3. On the other hand, provided that the voltage on the second node N2 is adequately high, the second driving voltage VSS of the high voltage H will be directly supplied to the third node N3 through the turned-on driving transistor Tr_D.

Next, a description will be given of an operation in a fifth period T5 with reference to FIGS. 6E and 5.

In the fifth period T5, as shown in FIG. 5, the first driving voltage VDD, control signal Vc and data voltage Data are maintained at the low voltage L and the second driving voltage VSS is maintained at the high voltage H, whereas all the scan signals are changed from the low voltage L to the high voltage H.

As the first scan signal SC1 rises to the high voltage H, the switching transistor Tr_S is turned on as shown in FIG. 6E. Then, the data voltage Data (the data voltage Data of the low voltage L) from the first data line DL1 is supplied to the first node N1 through the turned-on switching transistor Tr_S. As a result, the voltage on the first node N1 falls. At this time, the voltage on the second node N2 is also dropped by the first storage capacitor CPst1. The voltage drop of the second node N2 signifies a gate voltage drop of the driving transistor Tr_D. Consequently, in the fifth period T5, a gate-source voltage of the driving transistor Tr_D becomes negative, so that the driving transistor Tr_D is turned off.

Next, a description will be given of an operation in a sixth period T6 with reference to FIGS. 6F and 5.

In the sixth period T6, as shown in FIG. 5, the first driving voltage VDD, control signal Vc and data voltage Data are maintained at the low voltage L and the second driving voltage VSS is maintained at the high voltage H, whereas all the scan signals are changed from the high voltage H to the low voltage L.

Because all the scan signals including the first scan signal SC1 assume the low voltage L, the switching transistor Tr_S is turned off, as shown in FIG. 6F. As a result, the first node N1 floats again. Accordingly, the data voltage Data of the low voltage L is applied across the second node N2, thereby causing the driving transistor Tr_D to be kept turned off.

Next, a description will be given of an operation in a seventh period T7 with reference to FIGS. 6G and 5.

In the seventh period T7, as shown in FIG. 5, the first driving voltage VDD, the control signal Vc, all the scan signals and the data voltage Data are maintained at the low voltage L, whereas the second driving voltage VSS is changed from the high voltage H to the low voltage L.

As the second driving voltage VSS falls to the low voltage L, the voltage on the floating first node N1 is dropped to the low voltage L by the second storage capacitor CPst2. Also, as the voltage on the first node N1 falls to the low voltage L, the voltage on the second node N2 is dropped to the low voltage L by the second storage capacitor CPst2 and a coupling phenomenon. This coupling phenomenon results from the parasitic capacitor formed between the gate electrode and source electrode of the driving transistor Tr_D.

In this seventh period T7, the second driving voltage VSS of the low voltage L is supplied to each of the first and second nodes N1 and N2 which are unstable due to floating, so that the voltage levels of the first and second nodes N1 and N2 decrease toward the low voltage L, but the third node N3 is continuously maintained at the high voltage H.

Next, a description will be given of an operation in an eighth period T8 with reference to FIGS. 6H and 5.

In the eighth period T8, as shown in FIG. 5, the first driving voltage VDD, second driving voltage VSS, control signal Vc and data voltage Data are maintained at the low voltage L. In contrast, all the scan signals are changed from the low voltage L to the high voltage H.

Because all the scan signals including the first scan signal SC1 assume the high voltage H, the switching transistor Tr_S is turned on as shown in FIG. 6H. Then, the data voltage Data (the data voltage Data of the low voltage L) from the first data line DL1 is supplied to the first node N1 through the turned-on switching transistor Tr_S. As a result, the voltage on the first node N1 rises than in the seventh period T7. Also, the voltage on the second node N2 is raised than in the seventh period T7 by the first storage capacitor CPst1 connected between the first node N1 and the second node N2.

Next, a description will be given of an operation in a ninth period T9 with reference to FIGS. 61 and 5.

In the ninth period T9, as shown in FIG. 5, the first driving voltage VDD, second driving voltage VSS and data voltage Data are maintained at the low voltage L and all the scan signals are maintained at the high voltage H, whereas the control signal Vc is changed from the low voltage L to the high voltage H.

As the control signal Vc rises to the high voltage H, the control transistor Tr_C is turned on as shown in FIG. 61. Then, the second node N2 and the third node N3 are short-circuited to each other through the turned-on control transistor Tr_C, resulting in a short circuit being formed between the gate electrode and drain electrode of the driving transistor Tr_D. As a result, the voltage on the second node N2 and the voltage on the third node N3 are mixed with each other and the mixed voltage is equally charged on the second and third nodes N2 and N3. This mixed voltage must be set to be higher than the threshold voltage Vth of the driving transistor Tr_D. To this end, in the previous period, each of the voltage on the second node N2 and the voltage on the third node N3 was set to be higher than the threshold voltage Vth.

The driving transistor Tr_D with its gate electrode and drain electrode short-circuited is turned on to operate as a diode. At this time, the mixed voltage gradually decreases toward the threshold voltage Vth of the driving transistor Tr_D, and the driving transistor Tr_D is turned off at the moment that the mixed voltage becomes equal to the threshold voltage Vth. Consequently, at the moment that the driving transistor Tr_D is turned off, the threshold voltage Vth of the driving transistor Tr_D is stored on each of the second and third nodes N2 and N3.

In this manner, in the threshold voltage detection period D3 including the ninth period T9, the threshold voltage Vth of the driving transistor Tr_D is stored on each of the second and third nodes N2 and N3. In this threshold voltage detection period D3, the threshold voltage Vth of the driving transistor Tr_D is stored on each of the second and third nodes N2 and N3 of each of all the pixel cells PXL. Since the driving transistors Tr_D of the respective pixel cells PXL may be different in characteristic from one another depending on manufacturing environments thereof, the threshold voltages Vth stored on the second and third nodes N2 and N3 of the respective pixel cells PXL may be different in level from one another.

Next, a description will be given of an operation in a tenth period T10 with reference to FIGS. 6J and 5.

In the tenth period T10, as shown in FIG. 5, the first driving voltage VDD, second driving voltage VSS and data voltage Data are maintained at the low voltage L and all the scan signals are maintained at the high voltage H, whereas the control signal Vc is changed from the high voltage H to the low voltage L.

As the control signal Vc falls to the low voltage L, the control transistor Tr_C is turned off as shown in FIG. 6J.

Next, a description will be given of an operation in an eleventh period T11 with reference to FIGS. 6K and 5.

In the eleventh period T11, as shown in FIG. 5, the first driving voltage VDD, second driving voltage VSS and control signal Vc are maintained at the low voltage L and all the scan signals are maintained at the high voltage H, whereas the data voltage Data is changed from the low voltage L to the high voltage H.

As the data voltage Data rises to the high voltage H, both the voltage on the first node N1 and the voltage on the second node N2 rise. As a result, the driving transistor Tr_D is turned on, and the second driving voltage VSS of the low voltage L is supplied to the third node N3 through the turned-on driving transistor Tr_D. Accordingly, all the third nodes N3 of all the pixel cells PXL are initialized to the same voltage level.

This eleventh period T11 is a period in which the third node N3 is pre-initialized to set up the driving of the light emitting element OLED by input of actual data.

Since the threshold voltages Vth of the driving transistors Tr_D of the respective pixel cells PXL may be different in level from one another as stated above, the voltage levels of the third nodes N3 of the respective pixel cells PXL on which these threshold voltages Vth are stored may be different from one another with respect to all the pixel cells PXL. In this connection, it is preferable to initialize all the third nodes N3 of all the pixel cells PXL to the same second driving voltage VSS by supplying data of the high voltage H to all the pixel cells PXL in the eleventh period T11.

Next, a description will be given of an operation in a twelfth period T12 with reference to FIGS. 6L and 5.

In the twelfth period T12, as shown in FIG. 5, the first driving voltage VDD, second driving voltage VSS and control signal Vc are maintained at the low voltage L and all the scan signals are maintained at the high voltage H, whereas the data voltage Data is changed from the high voltage H to the low voltage L.

As the data voltage Data falls to the low voltage L, both the voltage on the first node N1 and the voltage on the second node N2 fall. Also, the second node N2 returns to the previously set threshold voltage Vth. As a result, the driving transistor Tr_D is turned off. Consequently, the third node N3 is initialized to the second driving voltage VSS and the second node N2 stores the threshold voltage Vth.

Next, a description will be given of an operation in a thirteenth period T13 with reference to FIGS. 6M and 5.

In the thirteenth period T13, as shown in FIG. 5, the first driving voltage VDD, second driving voltage VSS and control signal Vc are maintained at the low voltage L.

Also, all the scan signals are sequentially maintained at the high voltage H for certain periods. That is, the thirteenth period T13 is the actual data input period D5 and includes (13-1)th to (13-n)th periods T13-1 to T13-n. The first to nth scan signals SC1 to SCn are sequentially maintained at the high voltage H for corresponding ones of the (13-1)th to (13-n)th periods T13-1 to T13-n. Also, data supplied to the m data lines for the thirteenth period T13 are actual data to be actually expressed, each of which is maintained at the high voltage H for the thirteenth period T13.

Only the first scan line SL1, among the plurality of scan lines, is driven in the (13-1)th period T13-1, only the second scan line SL2, among the plurality of scan lines, is driven in the (13-2)th period T13-2, only the third scan line SL3, among the plurality of scan lines, is driven in the (13-3)th period T13-3, . . . , and only the nth scan line SLn, among the plurality of scan lines, is driven in the (13-n)th period T13-n.

When each scan line is driven, all pixel cells PXL of one horizontal line connected to the corresponding scan line are driven. As a result, when one scan line is driven, actual data are supplied to pixel cells PXL of one horizontal line connected to that scan line.

A process of supplying the actual data is the same as that in the first embodiment and a description thereof will thus be omitted.

The voltage on the second node N2 of each pixel cell PXL in the thirteenth period T13 can be defined by the above-stated equation 1.

Next, a description will be given of an operation in a fourteenth period T14 with reference to FIGS. 6N and 5.

In the fourteenth period T14, as shown,in FIG. 5, the second driving voltage VSS, control signal Vc and all the scan signals are maintained at the low voltage L, whereas the data voltage Data is changed from the high voltage H to the low voltage L. Particularly, this fourteenth period T14 is the light emitting period D6 in which the light emitting elements OLED of all the pixel cells PXL emit light. To this end, in the fourteenth period T14, the first driving voltage VDD is changed from the low voltage L to the high voltage H.

As the first driving voltage VDD rises to the high voltage H, the turned-on driving transistor Tr_D of each of all the pixel cells PXL allows driving current to flow through the drain electrode and source electrode thereof. As each driving current is transmitted to the cathode electrode of the corresponding light emitting element OLED through the anode electrode thereof, the light emitting element OLED of each pixel cell PXL emits light with a brightness corresponding to the amount of the driving current supplied thereto.

At this time, the driving current supplied to each light emitting element OLED can be defined by the above-stated equation 2.

Third Embodiment

Figure 7:
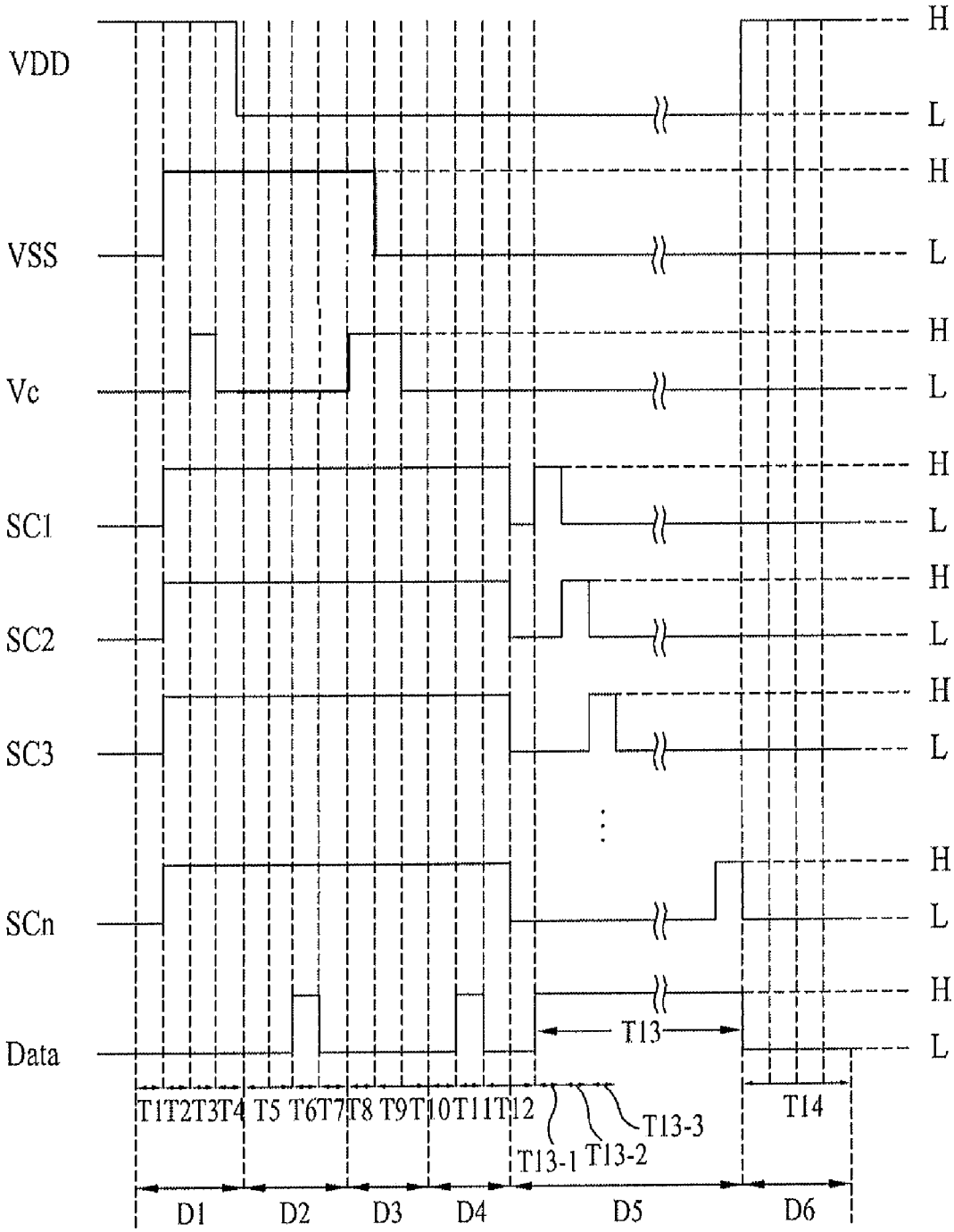
FIG. 7 is a waveform diagram of various signals which are supplied to a display panel including a plurality of pixel cells each having a structure as in FIG. 2, according to a third embodiment of the present invention.

FIG. 7 is a waveform diagram of various signals which are supplied to the display panel 100 including a plurality of pixel cells PXL each having a structure as in FIG. 2, according to a third embodiment of the present invention.

A light emitting display according to the third embodiment of the present invention includes, as shown in FIG. 7, a first initialization period D1, a threshold voltage detection setup period D2, a threshold voltage detection period D3, a second initialization period D4, an actual data input period D5, and a light emitting period D6.

The first driving voltage VDD is an AC signal having different levels of two steps, as shown in FIG. 7. That is, the first driving voltage VDD is a signal having a high voltage H of a relatively high level and a low voltage L of a relatively low level. This first driving voltage VDD periodically exhibits the low voltage L and the high voltage H.

The high voltage H of the first driving voltage VDD may be set to about 15V and the low voltage L thereof may be set to about −10V, and these values may be freely changed depending on circuit configurations.

The first driving voltage VDD is maintained at the high voltage H for the first initialization period D1 and the light emitting period D6.

The second driving voltage VSS is an AC signal having different levels of two steps, as shown in FIG. 7. That is, the second driving voltage VSS is a signal having a high voltage H of a relatively high level and a low voltage L of a relatively low level. This second driving voltage VSS periodically exhibits the low voltage L and the high voltage H.

The high voltage H of the second driving voltage VSS may be set to about 15V and the low voltage L thereof may be set to about 0V, and these values may be freely changed depending on circuit configurations.

The second driving voltage VSS is maintained at the high voltage H for a part of the first initialization period D1, the threshold voltage detection setup period D2 and a part of the threshold voltage detection period D3, and at the low voltage L for the other periods.

The control signal Vc is maintained at a high voltage H for a part of the first initialization period D1 and a part of the threshold voltage detection period D3 and at a low voltage L for the other periods, as shown in FIG. 7.

Each scan signal is maintained at a high voltage H for the first initialization period D1, threshold voltage detection setup period D2, threshold voltage detection period D3 and second initialization period D4 and also sequentially maintained at the high voltage H for the actual data input period D5. That is, as shown in FIG. 7, the first scan signal SC1 is maintained at the high voltage H for a (13-1)th period T13-1 that is a first preceding period of the actual data input period D5, the second scan signal SC2 is maintained at the high voltage H for a (13-2)th period T13-2 that is a second preceding period of the actual data input period D5, and the third scan signal SC3 is maintained at the high voltage H for a (13-3)th period T13-3 that is a third preceding period of the actual data input period D5.

The data voltage Data is maintained at a high voltage H for the threshold voltage detection setup period D2, the second initialization period D4 and the actual data input period D5 and at a low voltage L for the other periods.

The high voltages H of the aforementioned respective signals may have the same level or different levels. Similarly, the low voltages L of the respective signals may have the same level or different levels.

Hereinafter, the operations of the pixel cells PXL supplied with the above-stated signals will be described in detail.

Figure 8A:
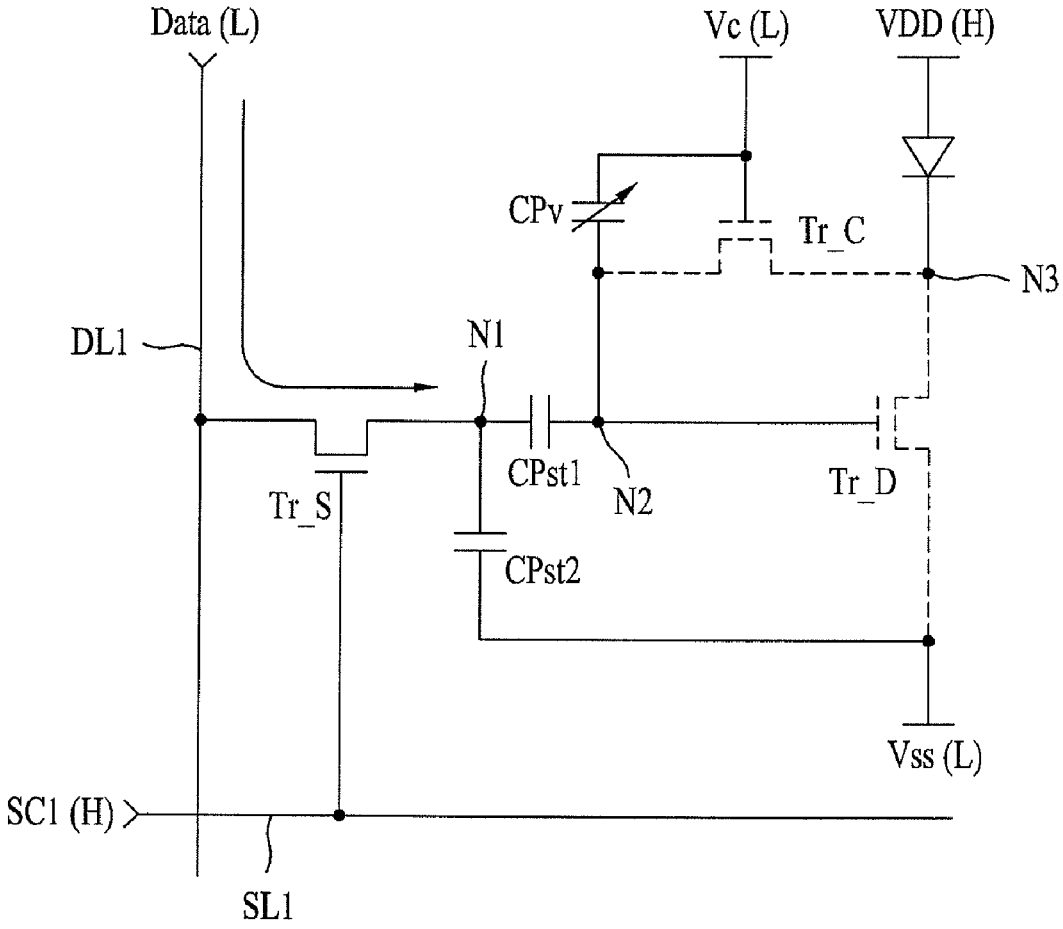
FIGS. 8A to 8N are circuit diagrams illustrating the operation of a light emitting display according to the third embodiment of the present invention.
Figure 8B:
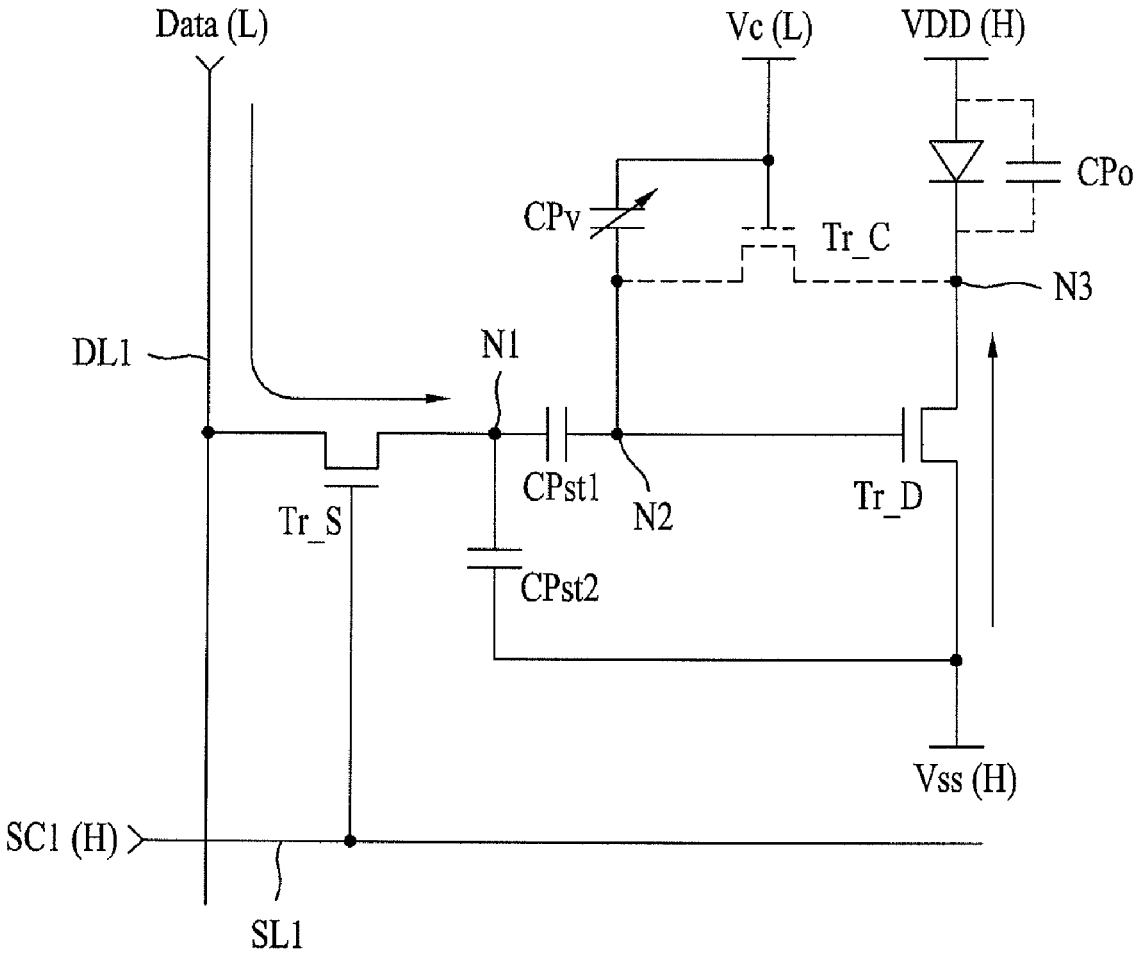
Figure 8C:
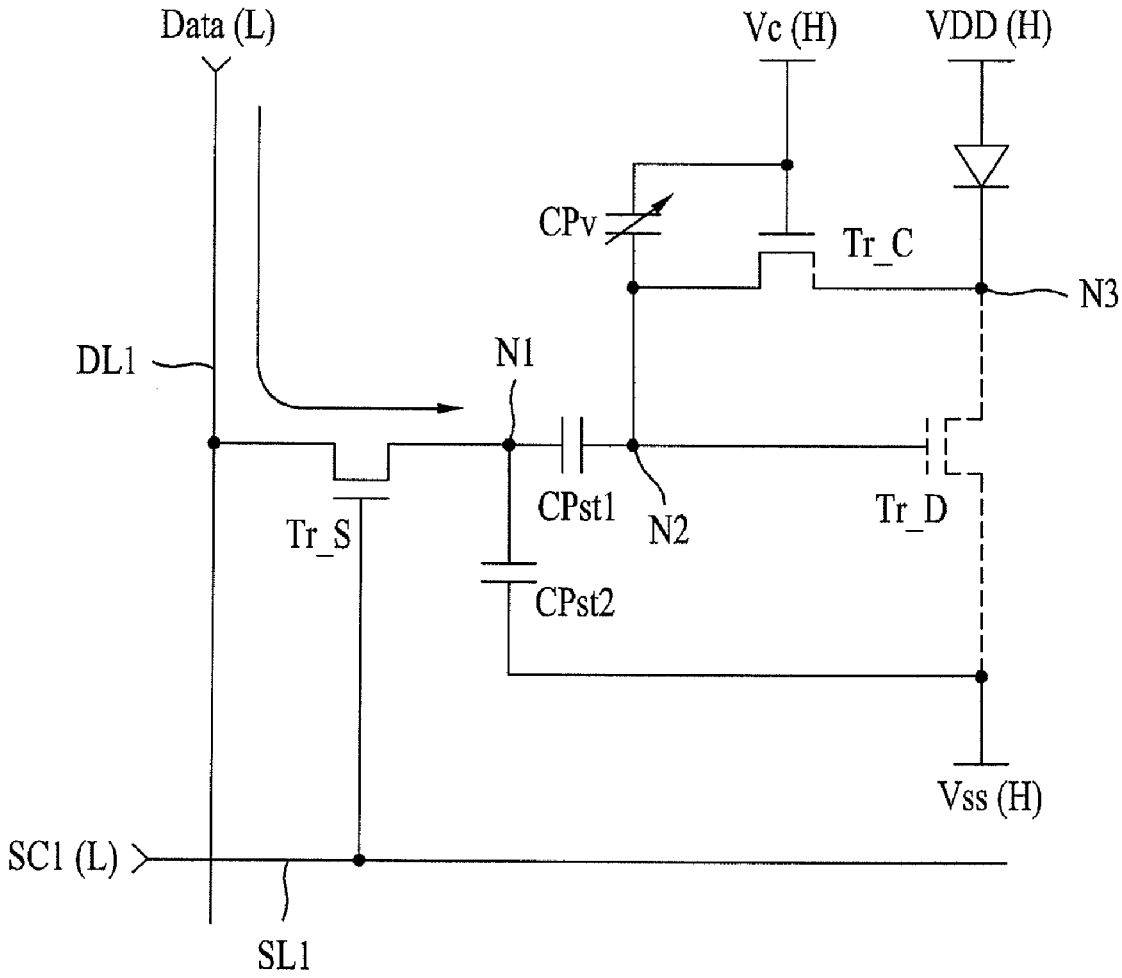
Figure 8D:
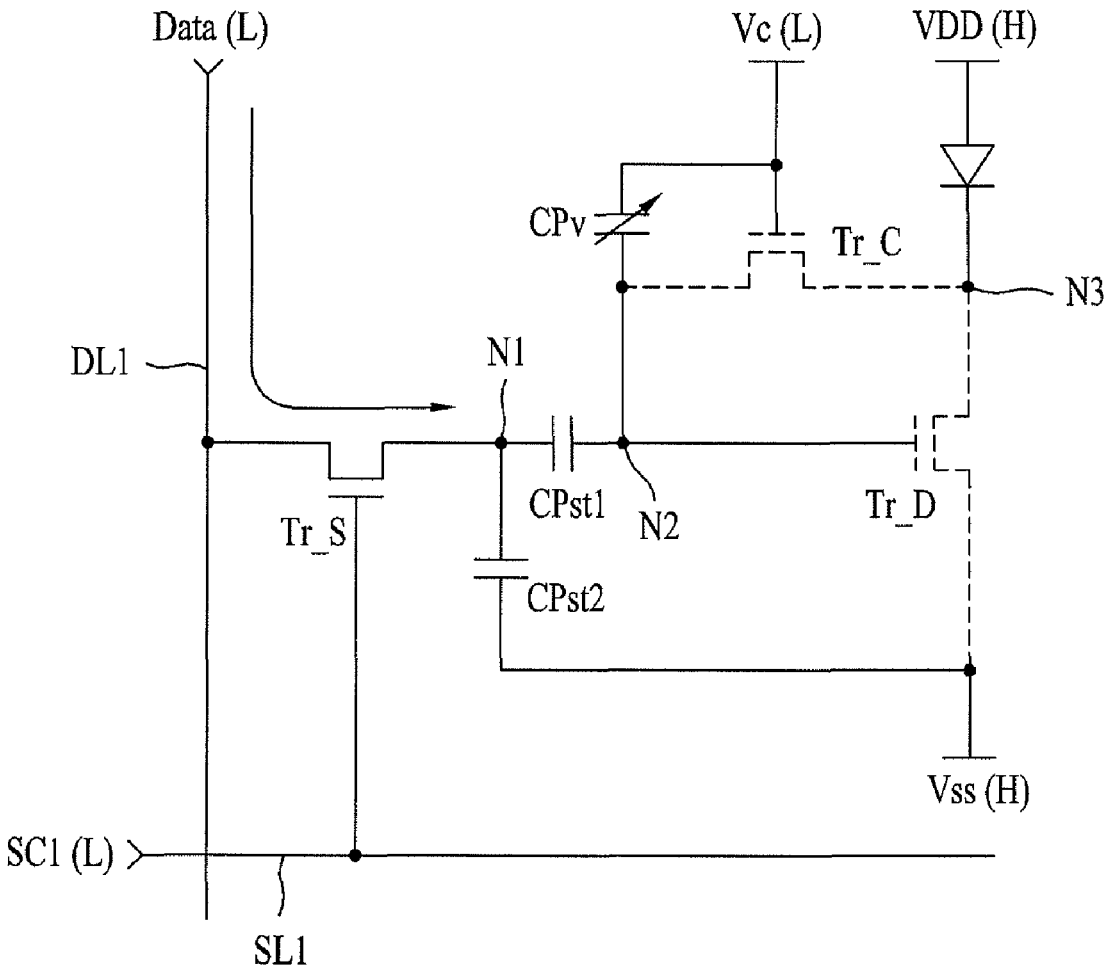
Figure 8E:
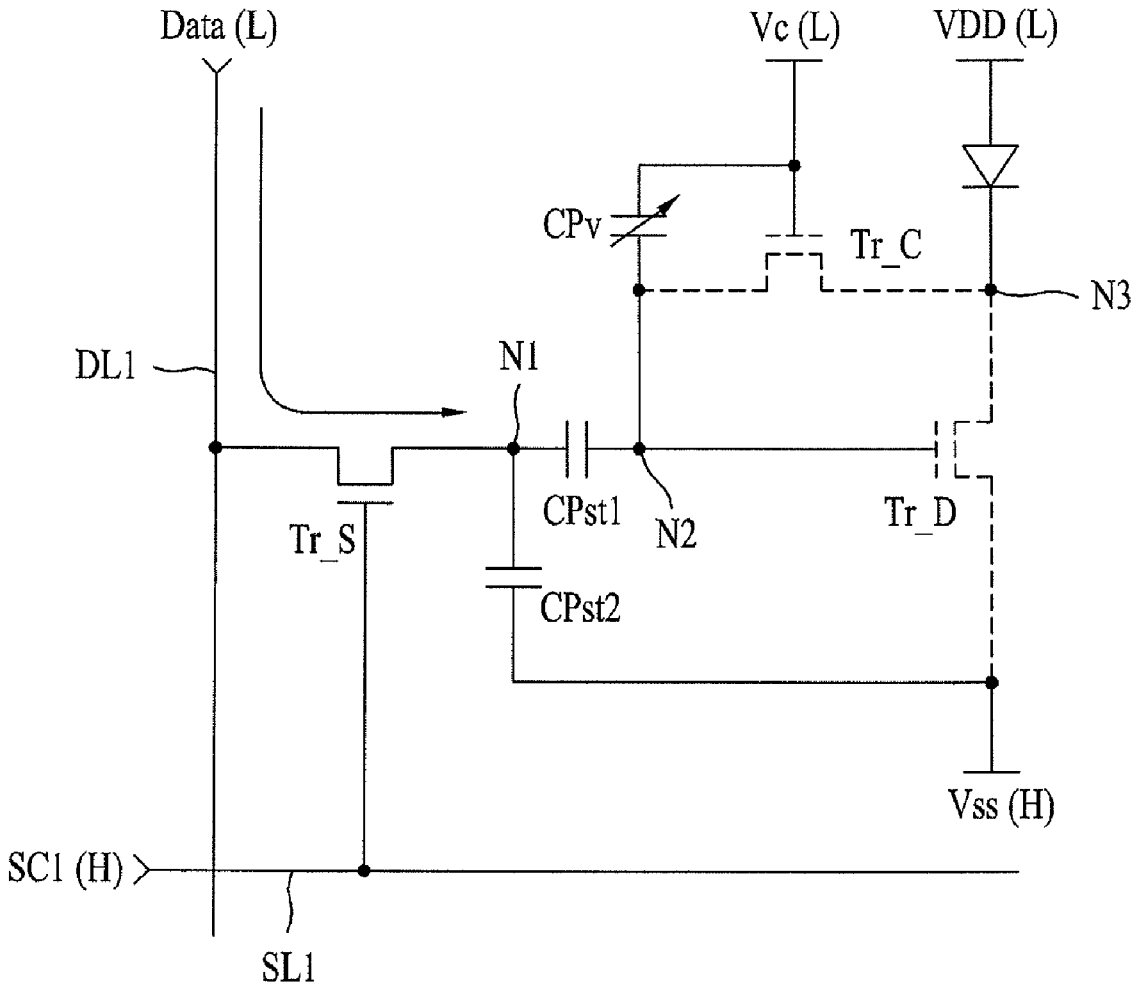
Figure 8F:
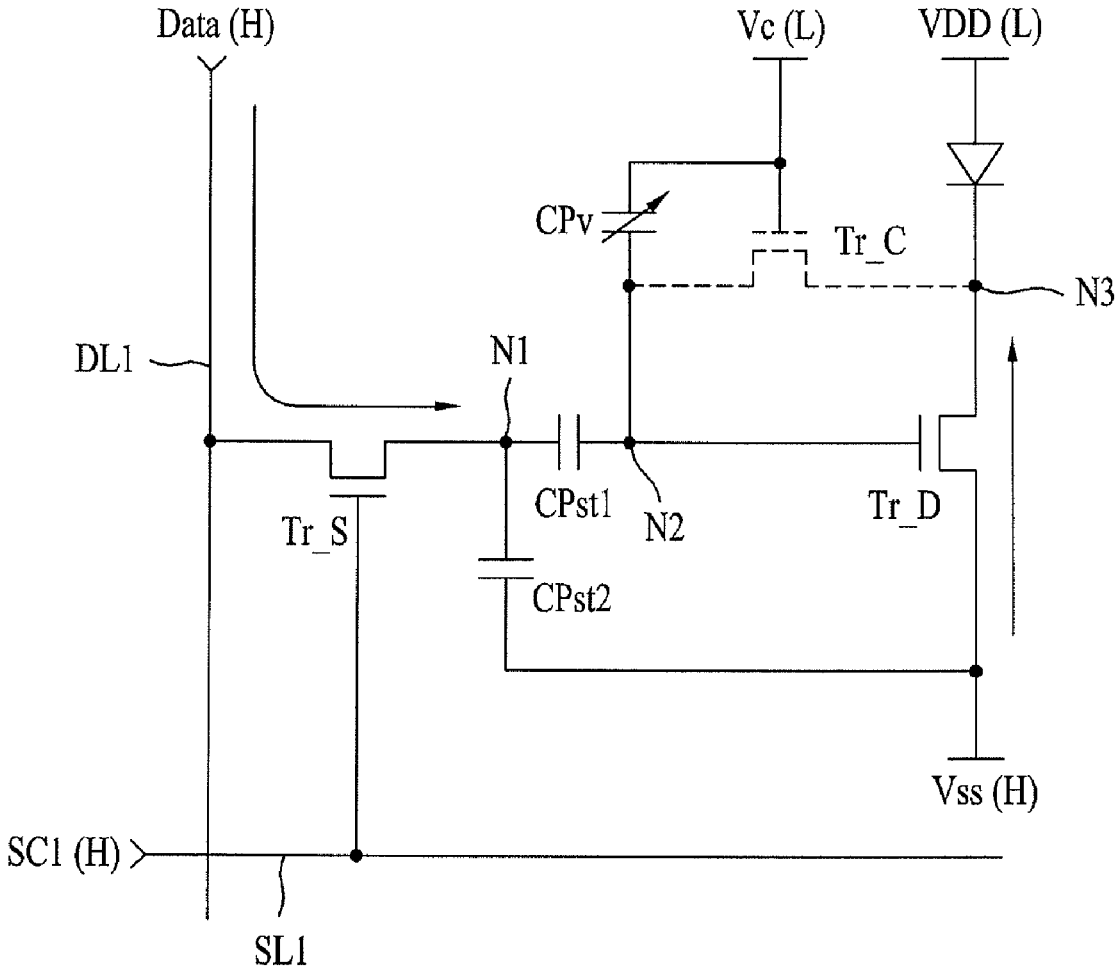
Figure 8G:
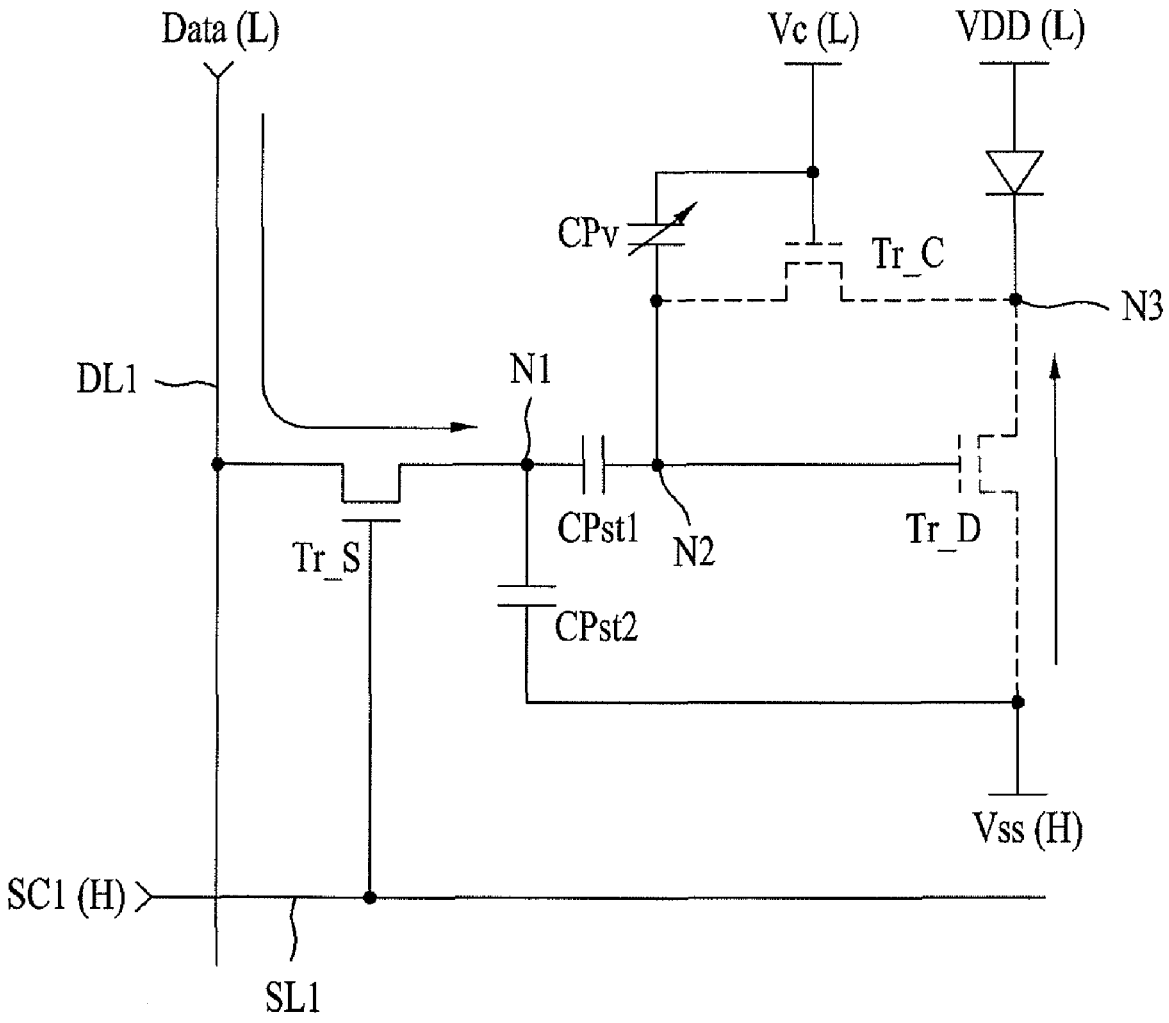
Figure 8H:
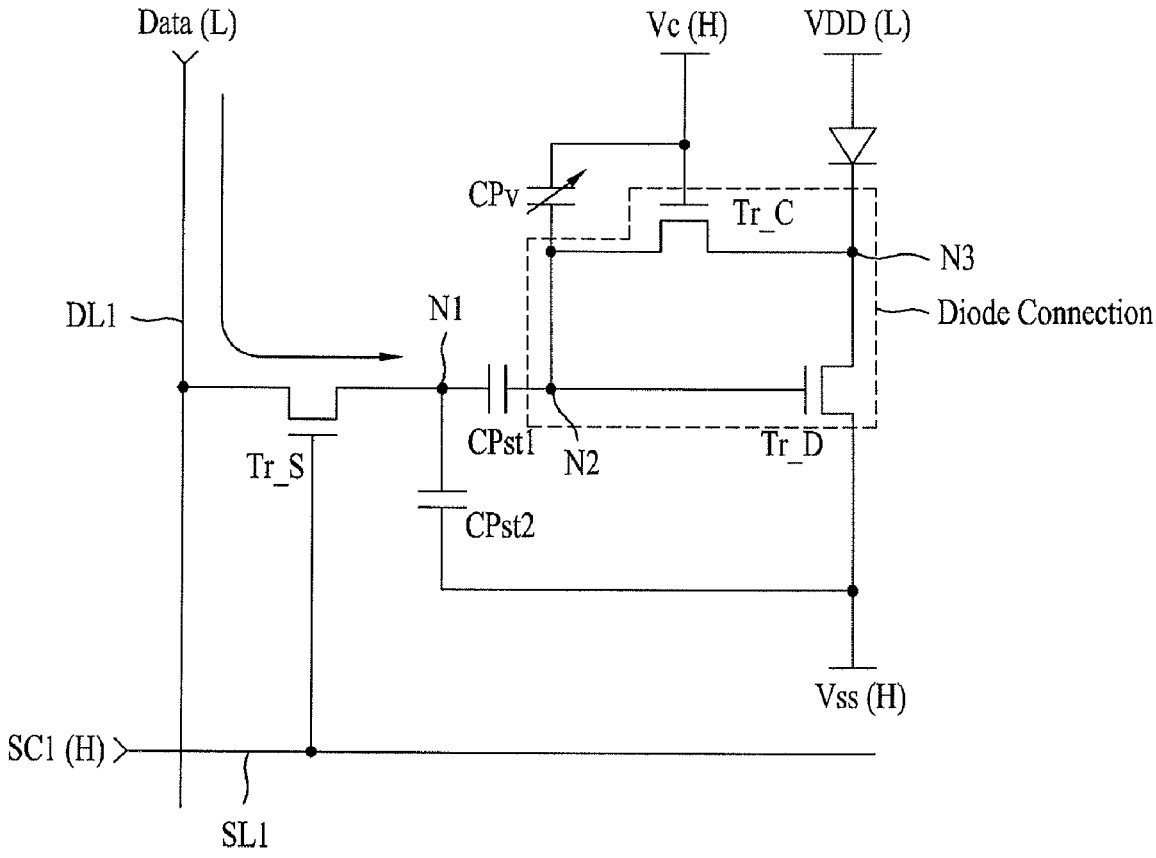
Figure 8I:
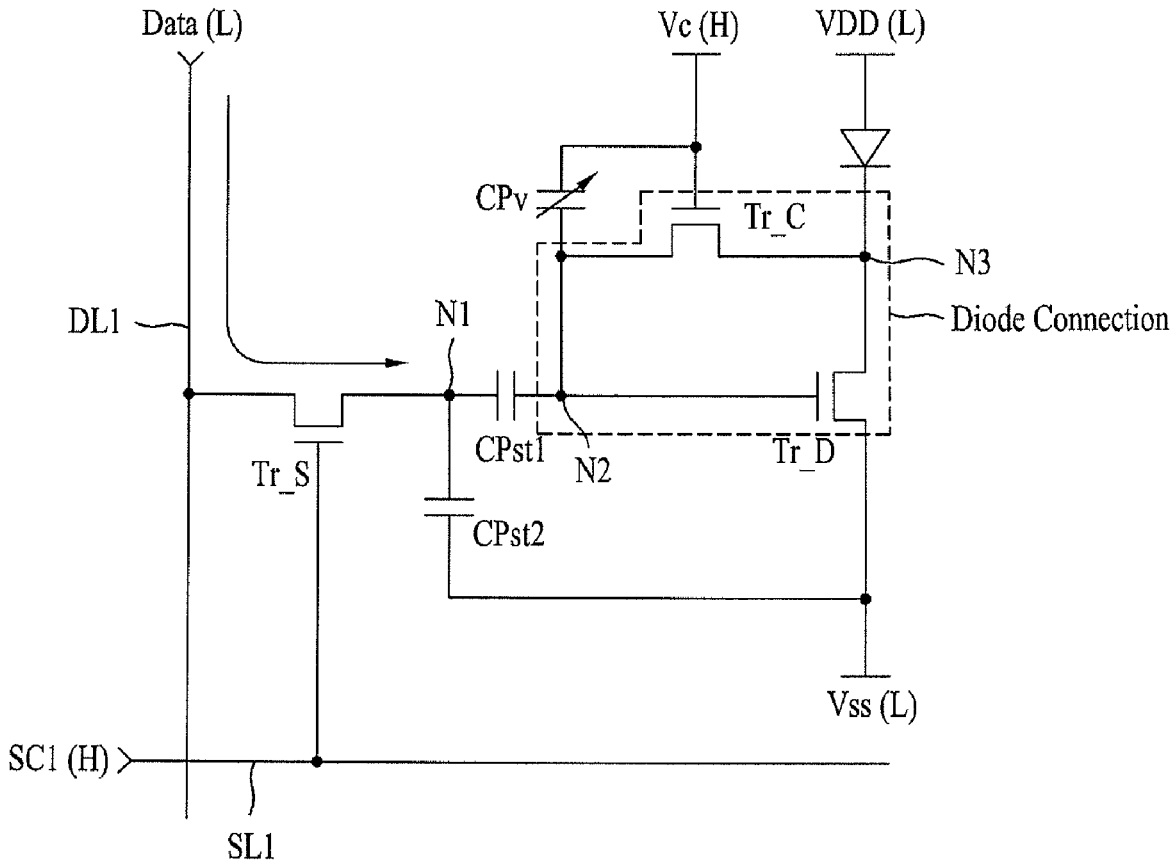
Figure 8J:
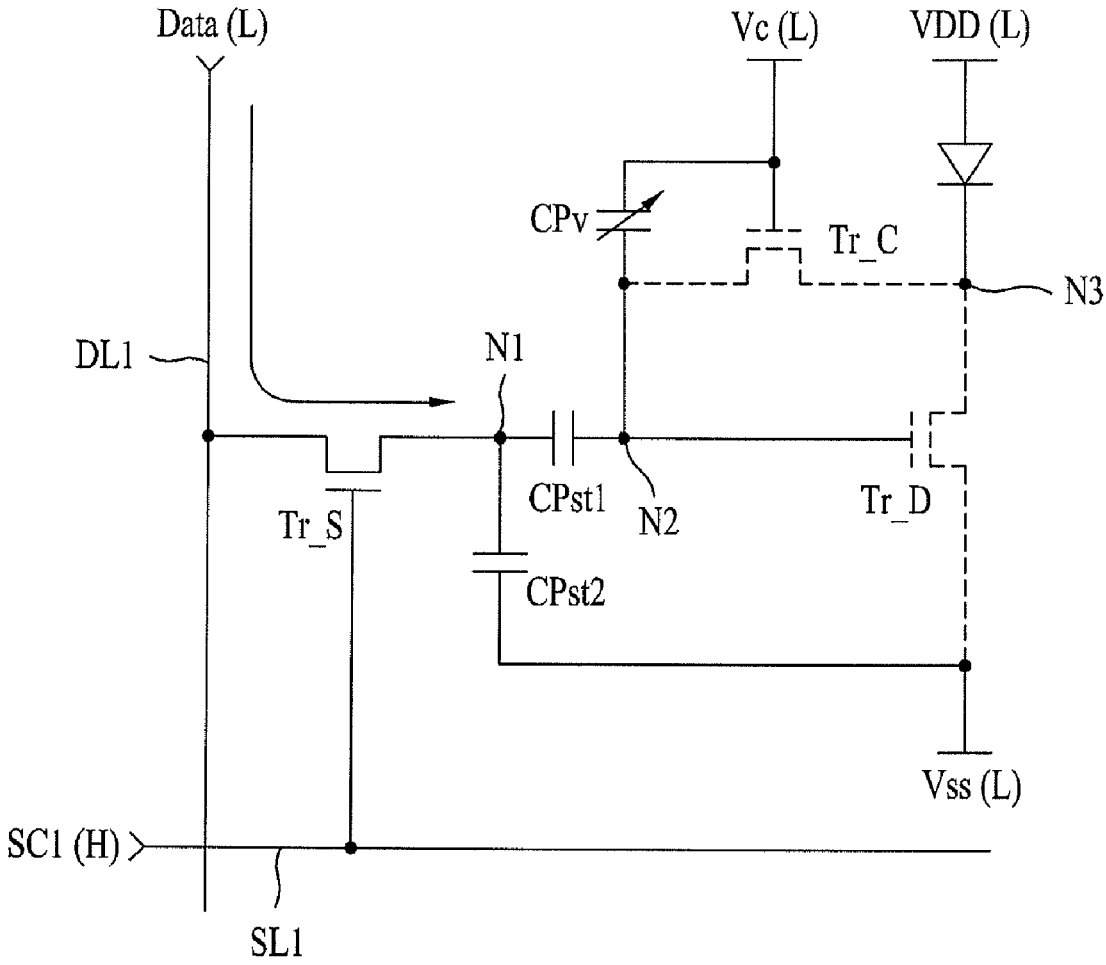
Figure 8K:
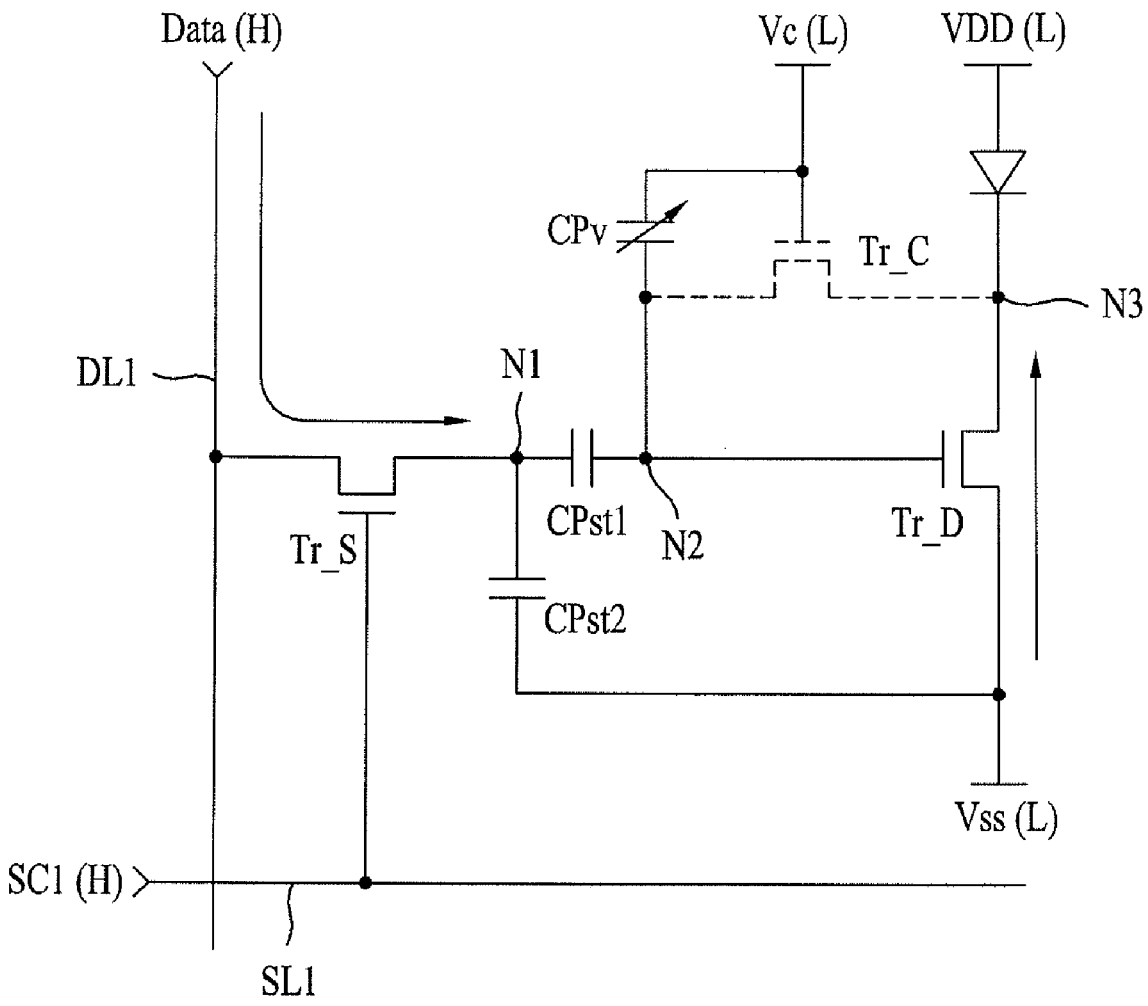
Figure 8L:
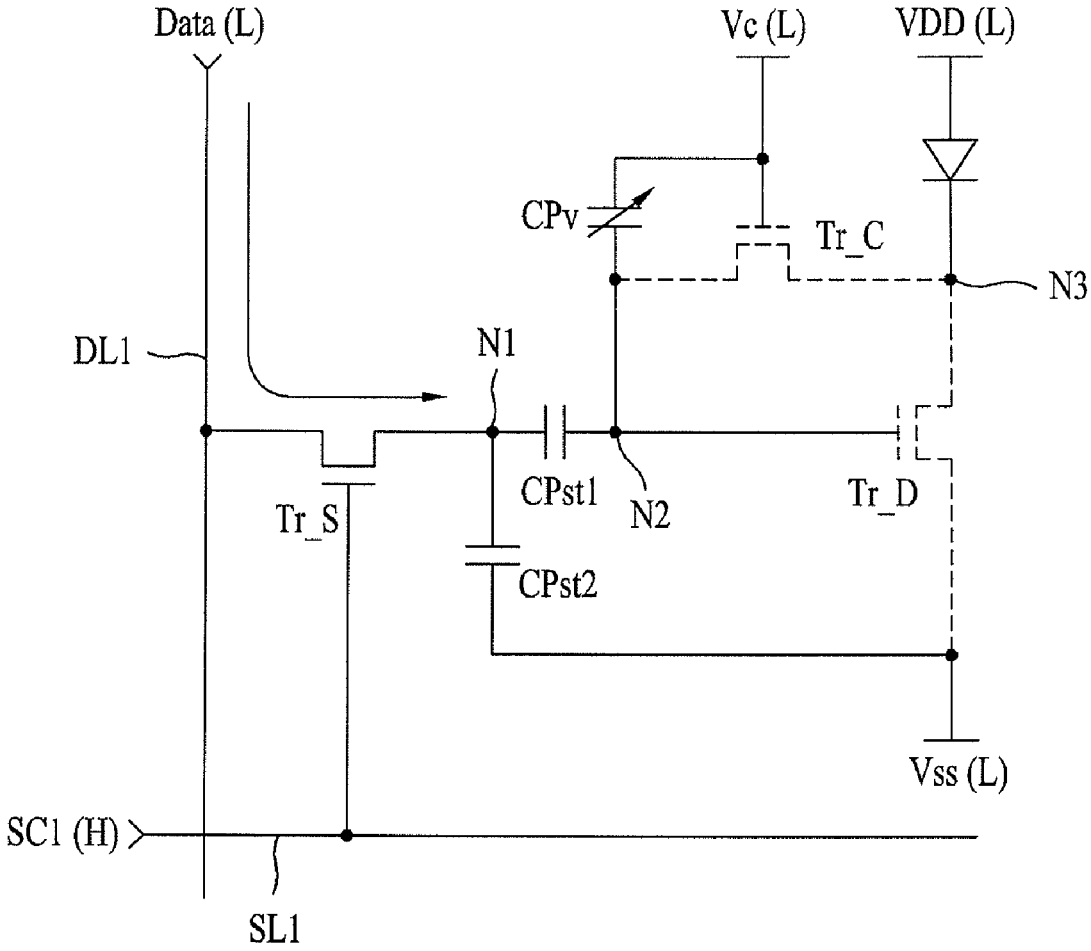
Figure 8M:
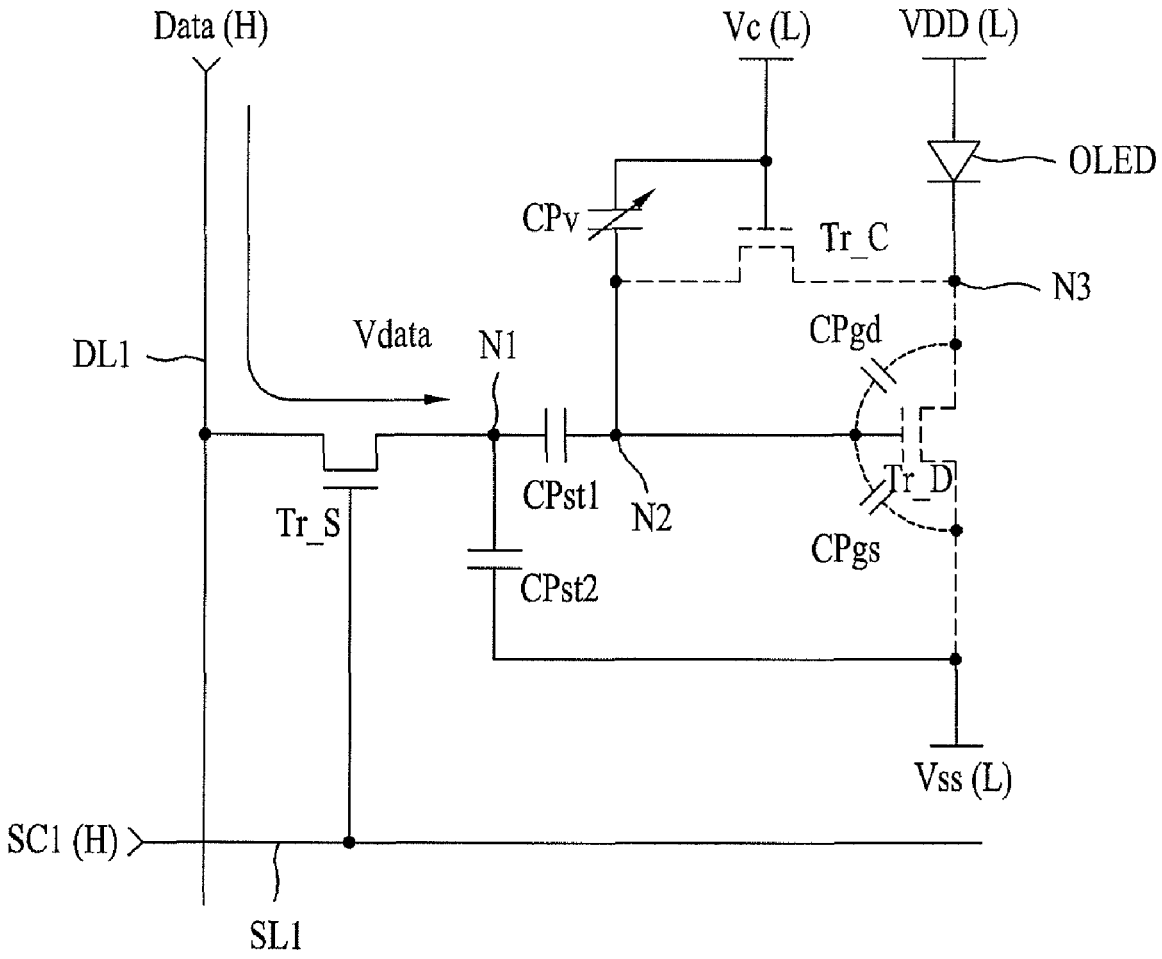
Figure 8N:
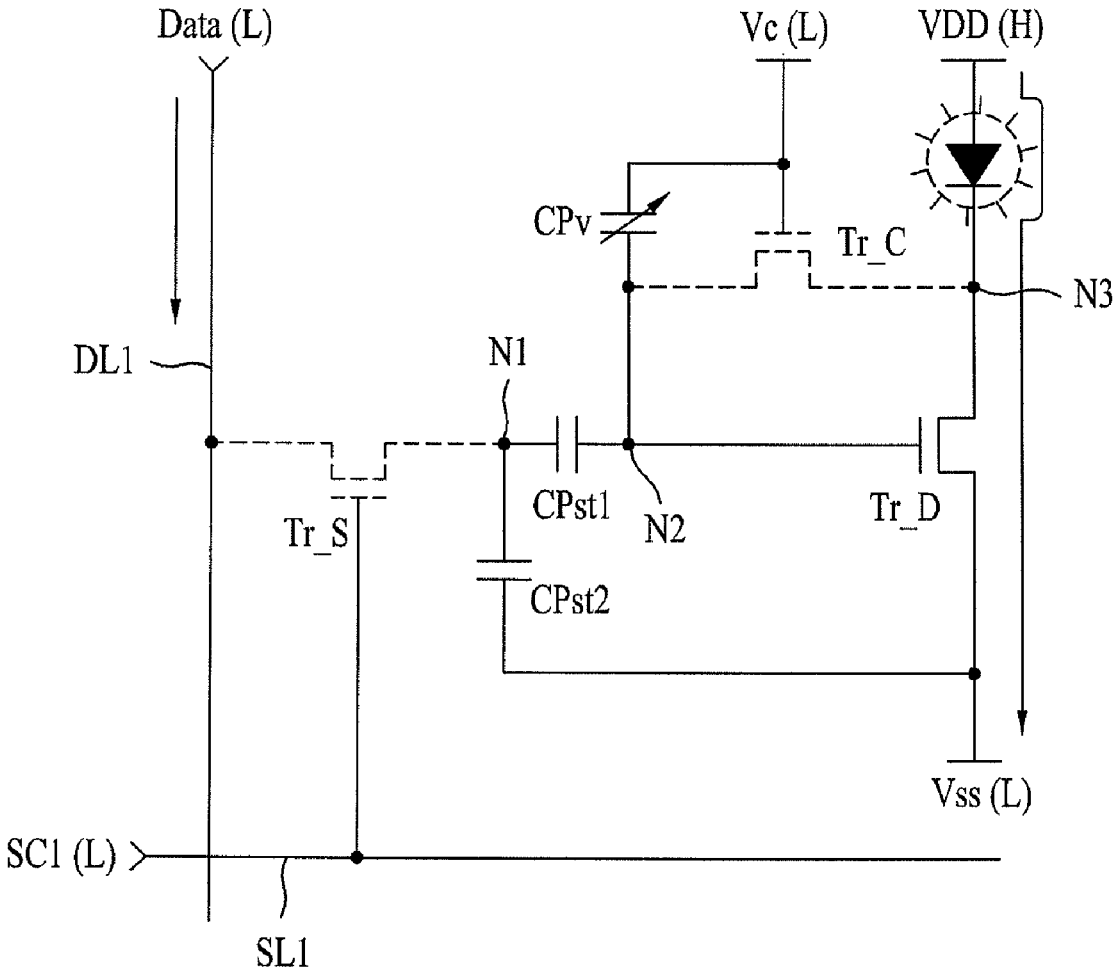

FIGS. 8A to 8N are circuit diagrams illustrating the operation of the light emitting display according to the third embodiment of the present invention.

Here, because the operations of all the pixel cells PXL are the same, the operation of the first pixel cell PXL connected to the first scan line SL1 and the first data line DL1 will be representatively described.

First, a description will be given of an operation in a first period T1 with reference to FIGS. 8A and 7.

In the first period T1, as shown in FIG. 7, the first driving voltage VDD and all the scan signals are maintained at the high voltage H. In contrast, the second driving voltage VSS, control signal Vc and data voltage Data are maintained at the low voltage L.

As the first scan signal SC1 is maintained at the high voltage H, a data signal (a data signal of the low voltage L) from the first data line DL1 is supplied to the first node N1. As a result, the first node N1 is initialized.

Next, a description will be given of an operation in a second period T2 with reference to FIGS. 8B and 7.

In the second period T2, as shown in FIG. 7, the first driving voltage VDD and all the scan signals are maintained at the high voltage H. Also, the control signal Vc and data voltage Data are maintained at the low voltage L. In contrast, the second driving voltage VSS is changed from the low voltage L to the high voltage H.

As the second driving voltage VSS rises to the high voltage H, a gate-source voltage of the driving transistor Tr_D becomes negative, thereby causing the driving transistor Tr_D to be turned off. As a result, the voltage on the third node N3 rises to a voltage close to the first driving voltage VDD. That is, the voltage on the third node N3 is raised by a parasitic capacitor of the light emitting element OLED formed between the first driving voltage line supplied with the first driving voltage VDD and the third node N3. At this time, a voltage resulting from the subtraction of a threshold voltage Vth of the light emitting element OLED from the first driving voltage VDD of the high voltage H is applied across the third node N3.

Next, a description will be given of an operation in a third period T3 with reference to FIGS. 8C and 7.

In the third period T3, as shown in FIG. 7, the first driving voltage VDD, all the scan signals and the second driving voltage VSS are maintained at the high voltage H. Also, the data voltage Data is maintained at the low voltage L. In contrast, the control signal Vc is changed from the low voltage L to the high voltage H.

As the control signal Vc rises to the high voltage H, the control transistor Tr_C is turned on as shown in FIG. 8C. Then, the second node N2 and the third node N3 are short-circuited to each other through the turned-on control transistor Tr_C, resulting in a short circuit being formed between the gate electrode and drain electrode of the driving transistor Tr_D. As a result, the voltage on the second node N2 becomes equal to the voltage on the third node N3. That is, the voltage resulting from the subtraction of the threshold voltage Vth of the light emitting element OLED from the first driving voltage VDD of the high voltage H is applied across the second node N2. In this third period T3, since the second driving voltage VSS is maintained at the high voltage H higher than the voltage on the second node N2, the gate-source voltage of the driving transistor Tr_D becomes negative, so that the driving transistor Tr_D is kept turned off.

Next, a description will be given of an operation in a fourth period T4 with reference to FIGS. 8D and 7.

In the fourth period T4, as shown in FIG. 7, the first driving voltage VDD, all the scan signals and the second driving voltage VSS are maintained at the high voltage H. Also, the data voltage Data is maintained at the low voltage L. In contrast, the control signal Vc is changed from the high voltage H to the low voltage L.

Also, in this fourth period T4, the voltage on the second node N2 and the voltage on the third node N3 are equal.

Next, a description will be given of an operation in a fifth period T5 with reference to FIGS. 8E and 7.

In the fifth period T5, as shown in FIG. 7, the second driving voltage VSS and all the scan signals are maintained at the high voltage H. Also, the data voltage Data is maintained at the low voltage L. In contrast, the first driving voltage VDD is changed from the high voltage H to the low voltage L.

As the first driving voltage VDD falls to the low voltage L, the voltage on the third node N3 is dropped by the parasitic capacitor of the light emitting element OLED. As a result, the voltage on the second node N2 becomes higher than the voltage on the third node N3, thereby causing the driving transistor Tr_D to be turned on. The second driving voltage VSS of the high voltage H is supplied to the third node N3 through the turned-on driving transistor Tr_D. Then, the driving transistor Tr_D is again turned off at the moment that the voltage on the third node N3 returns to a value corresponding to a difference voltage between the voltage on the second node N2 and a threshold voltage Vth of the driving transistor Tr_D.

Next, a description will be given of an operation in a sixth period T6 with reference to FIGS. 8F and 7.

In the sixth period T6, as shown in FIG. 7, the second driving voltage VSS and all the scan signals are maintained at the high voltage H. Also, the first driving voltage VDD is maintained at the low voltage L. In contrast, the data voltage Data is changed from the low voltage L to the high voltage H.

As the data voltage Data rises to the high voltage H, both the voltage on the first node N1 and the voltage on the second node N2 rise. As a result, the driving transistor Tr_D is turned on, and the second driving voltage VSS of the high voltage H is supplied to the third node N3 through the turned-on driving transistor Tr_D. Accordingly, the third node N3 is completely charged to the second driving voltage VSS of the high voltage H.

Next, a description will be given of an operation in a seventh period T7 with reference to FIGS. 8G and 7.

In the seventh period T7, as shown in FIG. 7, the second driving voltage VSS and all the scan signals are maintained at the high voltage H. Also, the first driving voltage VDD and the control signal VC are maintained at the low voltage L. In contrast, the data voltage Data is charged from the high voltage to the low voltage L.

As the data voltage Data falls to the low voltage L, both the voltage on the first node N1 and the voltage on the second node N2 fall. Although the voltage on the second node N2 falls than in the previous period, it is as high as ever. The voltage on the third node N3 is still maintained at the high voltage H. As a result, the driving transistor Tr_D is turned off.

Next, a description will be given of an operation in an eighth period T8 with reference to FIGS. 8H and 7.

In the eighth period T8, as shown in FIG. 7, the second driving voltage VSS and all the scan signals are maintained at the high voltage H. Also, the first driving voltage VDD and data voltage Data are maintained at the low voltage L. In contrast, the control signal Vc is changed from the low voltage L to the high voltage H.

As the control signal Vc rises to the high voltage H, the control transistor Tr_C is turned on as shown in FIG. 8H. Then, the second node N2 and the third node N3 are short-circuited to each other through the turned-on control transistor Tr_C, resulting in a short circuit being formed between the gate electrode and drain electrode of the driving transistor Tr_D. As a result, the voltage on the second node N2 becomes equal to the voltage on the third node N3, so that it assumes the high voltage H slightly higher than in the previous period. That is, the second node N2 has a voltage closer to the first driving voltage VDD than in the previous period. In this eighth period T8, since the second driving voltage VSS is maintained at the high voltage H higher than the voltage on the second node N2, the gate-source voltage of the driving transistor Tr_D becomes negative, so that the driving transistor Tr_D is kept turned off.

Next, a description will be given of an operation in a ninth period T9 with reference to FIGS. 8I and 7.

In the ninth period T9, as shown in FIG. 7, the control signal Vc and all the scan signals are maintained at the high voltage H. Also, the first driving voltage VDD and data voltage Data are maintained at the low voltage L. In contrast, the second driving voltage VSS is changed from the high voltage H to the low voltage L.

As the second driving voltage VSS falls to the low voltage L, the voltage on the second node N2 becomes higher than the second driving voltage VSS. As a result, the gate-source voltage of the driving transistor Tr_D becomes positive, thereby causing the driving transistor Tr_D to be turned on.

Also, as set in the seventh period T7, each of the voltage on the second node N2 and the voltage on the third node N3 must be set to be higher than the threshold voltage Vth of the driving transistor Tr_D. To this end, in the previous period, each of the voltage on the second node N2 and the voltage on the third node N3 was set to be higher than the threshold voltage Vth.

The driving transistor Tr_D with its gate electrode and drain electrode short-circuited is turned on to operate as a diode. At this time, the mixed voltage gradually decreases toward the threshold voltage Vth of the driving transistor Tr_D, and the driving transistor Tr_D is turned off at the moment that the mixed voltage becomes equal to the threshold voltage Vth. Consequently, at the moment that the driving transistor Tr_D is turned off, the threshold voltage Vth of the driving transistor Tr_D is stored on each of the second and third nodes N2 and N3.

In this manner, in the threshold voltage detection period D3 including the ninth period T9, the threshold voltage Vth of the driving transistor Tr_D is stored on each of the second and third nodes N2 and N3. In this threshold voltage detection period D3, the threshold voltage Vth of the driving transistor Tr_D is stored on each of the second and third nodes N2 and N3 of each of all the pixel cells PXL. Since the driving transistors Tr_D of the respective pixel cells PXL may be different in characteristic from one another depending on manufacturing environments thereof, the threshold voltages Vth stored on the second and third nodes N2 and N3 of the respective pixel cells PXL may be different in level from one another.

Next, a description will be given of an operation in a tenth period T10 with reference to FIGS. 8J and 7.

In the tenth period T10, as shown in FIG. 7, the first driving voltage VDD, second driving voltage VSS and data voltage Data are maintained at the low voltage L and all the scan signals are maintained at the high voltage H, whereas the control signal Vc is changed from the high voltage H to the low voltage L.

As the control signal Vc falls to the low voltage L, the control transistor Tr_C is turned off as shown in FIG. 8J.

Next, a description will be given of an operation in an eleventh period T11 with reference to FIGS. 8K and 7.

In the eleventh period T11, as shown in FIG. 7, the first driving voltage VDD, second driving voltage VSS and control signal Vc are maintained at the low voltage L and all the scan signals are maintained at the high voltage H, whereas the data voltage Data is changed from the low voltage L to the high voltage H.

As the data voltage Data rises to the high voltage H, both the voltage on the first node N1 and the voltage on the second node N2 rise. As a result, the driving transistor Tr_D is turned on, and the second driving voltage VSS of the low voltage L is supplied to the third node N3 through the turned-on driving transistor Tr_D. Accordingly, all the third nodes N3 of all the pixel cells PXL are initialized to the same voltage level.

This eleventh period T11 is a period in which the third node N3 is pre-initialized to set up the driving of the light emitting element OLED by input of actual data.

Since the threshold voltages Vth of the driving transistors Tr_D of the respective pixel cells PXL may be different in level from one another as stated above, the voltage levels of the third nodes N3 of the respective pixel cells PXL on which these threshold voltages Vth are stored may be different from one another with respect to all the pixel cells PXL. In this connection, it is preferable to initialize all the third nodes N3 of all the pixel cells PXL to the same second driving voltage VSS by supplying data of the high voltage H to all the pixel cells PXL in the eleventh period T11.

Next, a description will be given of an operation in a twelfth period T12 with reference to FIGS. 8L and 7.

In the twelfth period T12, as shown in FIG. 7, the first driving voltage VDD, second driving voltage VSS and control signal Vc are maintained at the low voltage L and all the scan signals are maintained at the high voltage H, whereas the data voltage Data is changed from the high voltage H to the low voltage L.

As the data voltage Data falls to the low voltage L, both the voltage on the first node N1 and the voltage on the second node N2 fall. Also, the second node N2 returns to the previously set threshold voltage Vth. As a result, the driving transistor Tr_D is turned off. Consequently, the third node N3 is initialized to the second driving voltage VSS and the second node N2 stores the threshold voltage Vth.

Next, a description will be given of an operation in a thirteenth period T13 with reference to FIGS. 8M and 7.

In the thirteenth period T13, as shown in FIG. 7, the first driving voltage VDD, second driving voltage VSS and control signal Vc are maintained at the low voltage L. Also, all the scan signals are sequentially maintained at the high voltage H for certain periods. That is, the thirteenth period T13 is the actual data input period D5 and includes (13-1)th to (13-n)th periods T13-1 to T13-n. The first to nth scan signals SC1 to SCn are sequentially maintained at the high voltage H for corresponding ones of the (13-1)th to (13-n)th periods T13-1 to T13-n. Also, data supplied to the m data lines for the thirteenth period T13 are actual data to be actually expressed, each of which is maintained at the high voltage H for the thirteenth period T13.

Only the first scan line SL1, among the plurality of scan lines, is driven in the (13-1)th period T13-1, only the second scan line SL2, among the plurality of scan lines, is driven in the (13-2)th period T13-2, only the third scan line SL3, among the plurality of scan lines, is driven in the (13-3)th period T13-3, and only the nth scan line SLn, among the plurality of scan lines, is driven in the (13-n)th period T13-n.

When each scan line is driven, all pixel cells PXL of one horizontal line connected to the corresponding scan line are driven. As a result, when one scan line is driven, actual data are supplied to pixel cells PXL of one horizontal line connected to that scan line.

A process of supplying the actual data is the same as that in the first embodiment and a description thereof will thus be omitted.

The voltage on the second node N2 of each pixel cell PXL in the thirteenth period T13 can be defined by the above-stated equation 1.

Next, a description will be given of an operation in a fourteenth period T14 with reference to FIGS. 8N and 7.

In the fourteenth period T14, as shown in FIG. 7, the second driving voltage VSS, control signal Vc and all the scan signals are maintained at the low voltage L, whereas the data voltage Data is changed from the high voltage H to the low voltage L. Particularly, this fourteenth period T14 is the light emitting period D6 in which the light emitting elements OLED of all the pixel cells PXL emit light. To this end, in the fourteenth period T14, the first driving voltage VDD is changed from the low voltage L to the high voltage H.

As the first driving voltage VDD rises to the high voltage H, the turned-on driving transistor Tr_D of each of all the pixel cells PXL allows driving current to flow through the drain electrode and source electrode thereof. As each driving current is transmitted to the cathode electrode of the corresponding light emitting element OLED through the anode electrode thereof, the light emitting element OLED of each pixel cell PXL emits light with a brightness corresponding to the amount of the driving current supplied thereto.

At this time, the driving current supplied to each light emitting element OLED can be defined by the above-stated equation 2.

On the other hand, in the second embodiment and third embodiment, a period exists in which the second driving voltage VSS is set to be higher than the gate voltage of the driving transistor Tr_D. That is, this period corresponds to the fourth period T4 in the second embodiment and the second period T2 in the third embodiment. In the fourth period T4 and second period T2, when a relatively low voltage (for example, a data voltage Data of 0V) is applied to the gate electrode (second node N2) of the driving transistor Tr_D, the driving transistor Tr_D is negative-biased. The proper adjustments of times of the fourth period T4 and second period T2 can prevent the driving transistor Tr_D from being deteriorated.

Figure 9:
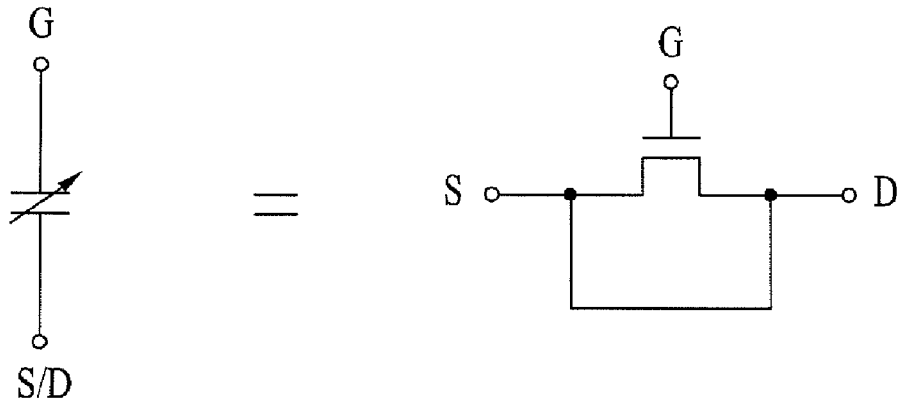
FIG. 9 is an equivalent circuit diagram of a variable capacitor of the present invention.

FIG. 9 is an equivalent circuit diagram of a variable capacitor of the present invention.

As shown in FIG. 9, the variable capacitor CPv may be expressed by a transistor having a source electrode and a drain electrode short-circuited to each other. This variable capacitor CPv has a variable capacitance designed to compensate for a voltage deviation which occurs due to the parasitic capacitances of the parasitic capacitors Cgs and Cgd. In detail, the variable capacitor CPv minimizes a voltage deviation resulting from the parasitic capacitances by offsetting them by a compensation capacitance opposite thereto.

Figure 10:
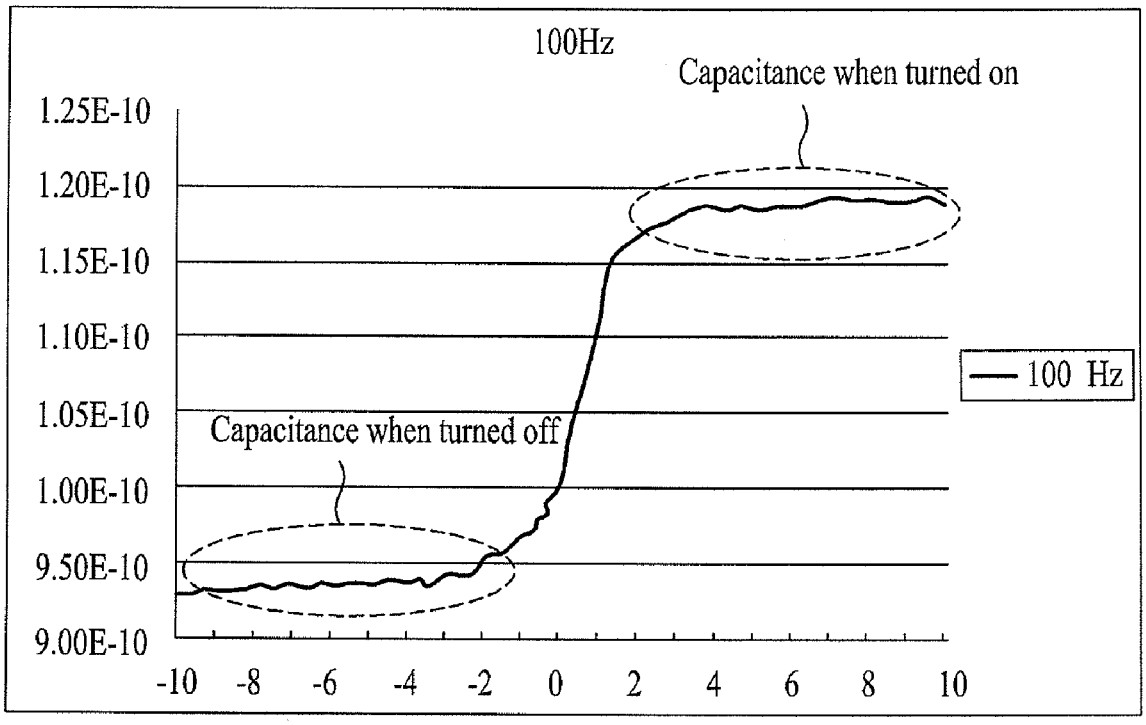
FIG. 10 is a graph illustrating a variation in capacitance of the variable capacitor of the present invention with a gate bias.

FIG. 10 is a graph illustrating a variation in capacitance of the variable capacitor of the present invention with a gate bias. The graph of FIG. 10 shows measured values of an actual element, in which the area of the element constituting the capacitance is 785,000 $\mu m^2$.

As described above, the variable capacitor CPv is used to improve the compensation capability for the threshold voltage Vth of the driving transistor Tr_D. The respective transistors Tr_S and Tr_C including the driving transistor Tr_D may be amorphous silicon (a-Si) thin film transistors (TFTs). Such an a-Si TFT basically has a bottom gate structure in which a gate electrode is formed beneath a source electrode and a drain electrode. According to this bottom gate structure, the gate electrode and the source electrode partially overlap each other and the gate electrode and the drain electrode also partially overlap each other. As a result, the capacitance of a parasitic capacitor of the a-Si TFT cannot help being large. For this reason, during a switching operation of the a-Si TFT, a coupling phenomenon occurs due to the parasitic capacitor, resulting in generation of a feed-through. Further, during the switching operation of the a-Si TFT, a channel charge variation (charge injection) occurs due to turning-on/off of the element. For this reason, even though the original threshold voltage Vth is stored on the second node N2, it becomes a distorted value in the end. In this manner, the parasitic capacitor degrades the compensation capability of the circuit.

In the present invention, a variable capacitor CPv with a metal/insulator/silicon (MIS) structure is applied to compensate for a variation deviation (a difference between a capacitance when turned on and a capacitance when turned off in FIG. 10). As shown in FIG. 10, the variable capacitor CPv of the MIS structure, where a gate electrode, an amorphous silicon and a source electrode/drain electrode are laminated, has a characteristic in which a capacitance varies with both biases. That is, when the gate voltage is a negative voltage lower than 0V, the capacitance is small because an amorphous silicon channel is not formed. In contrast, when the gate voltage increases above 0V and the channel is thus formed, the capacitance increases due to reflection of capacitance of the channel. In this manner, the aforementioned variation deviation can be compensated for by utilizing the characteristic of the variable capacitor whose capacitance varies with the gate bias.

Figure 11:
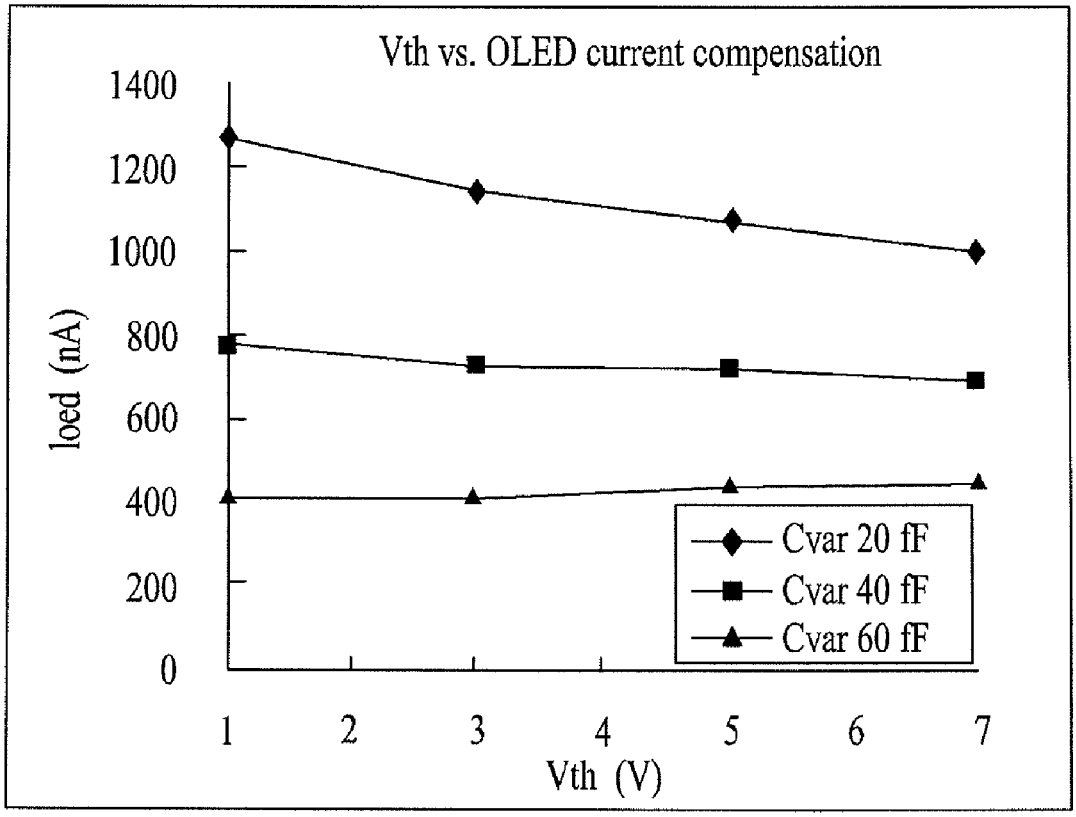
FIG. 11 is a graph illustrating measurements of a variation in current value of a light emitting element with a variation in threshold voltage of a driving transistor.
Figure 12:
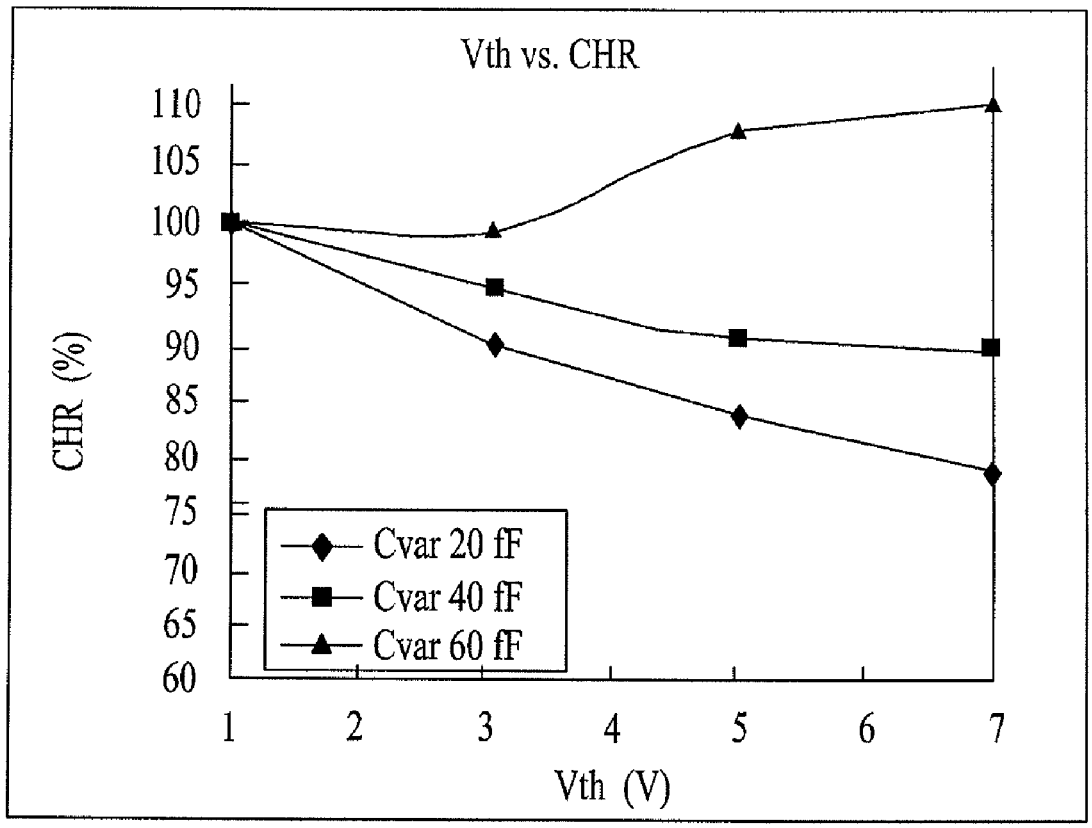
FIG. 12 is a graph illustrating an initial current value to current holding ratio measured from the results of FIG. 11.

FIG. 11 is a graph illustrating measurements of a variation in current value of a light emitting element with a variation in threshold voltage of a driving transistor, and FIG. 12 is a graph illustrating an initial current value to current holding ratio (CHR) measured from the results of FIG. 11.

FIGS. 11 and 12 show the results of a SPICE simulation carried out with respect to a proposed light emitting display.

That is, FIG. 11 shows OLED current analysis results when varying the threshold voltage Vth of the driving transistor Tr_D from 1V to 7V. Here, to vary the threshold voltage Vth from 1V to 7V signifies a driving transistor Tr_D deviation between pixel cells or a driving transistor Tr_D deterioration resulting from long-period driving.

Also, in order to see how the compensation capability varies with the application of the variable capacitor CPv, this simulation measured the capacitance of the variable capacitor CPv of the MIS structure under the condition of classifying it into three types according to the area of the capacitor. From the measurement results, it can be seen that the capacitance of the variable capacitor CPv when the channel was formed is about 20 fF, 40 fF and 60 fF. Here, the capacitance values signify capacitance values when turned on, in view of FIG. 10.

FIGS. 11 and 12 are graphs showing results regarding a light emitting display based on the structure of the first embodiment, among the above-stated first to third embodiments. FIG. 11 shows a variation in current value of the light emitting element OLED observed while varying the threshold voltage Vth of the driving transistor Tr_D, and FIG. 12 shows an initial current value to current holding ratio (CHR) calculated from the results of FIG. 11.

In the case where the capacitance is 20 fF, the current of the light emitting element OLED is 1270 nA when the threshold voltage Vth is 1V and 1000 nA when it is 7V. That is, if the threshold voltage Vth is shifted by 6V, a current deviation of about 21% occurs even though the compensation circuit is applied. In contrast, in the case where the capacitance is 40 fF, it can be seen that the current deviation is reduced to about 10% and the compensation capability is thus improved. If the capacitance is further increased to 60 fF, the current deviation exhibits a reversely increasing phenomenon. This means that there is an optimum capacitance of the variable capacitor CPv to improve the compensation capability.

Therefore, the compensation capability of the circuit can be optimized by selecting a variable capacitor with an optimum capacitance according to the circuit configuration through an experiment and applying the selected variable capacitor to the circuit.

As apparent from the above description, a light emitting display and a driving method thereof according to the present invention have effects as follows.

Firstly, threshold voltages of driving transistors in respective pixel cells can all be detected and compensated for before input of actual data by appropriately adjusting the levels of first and second driving voltages on a period basis. Therefore, it is possible to prevent a brightness difference between the pixel cells.

Secondly, a compensation characteristic can be improved by providing a variable capacitor capable of preventing a voltage variation of a second node resulting from capacitances of parasitic capacitors and a channel capacitance of a driving transistor.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

The invention claimed is:

1. A light emitting display comprising:

a pixel circuit that outputs a driving current corresponding to a data voltage from a data line using a scan signal, a first driving voltage and a second driving voltage; and a light emitting element that emits light by the driving current from the pixel circuit, wherein the pixel circuit comprises:

a switching transistor turned on/off in response to the scan signal from a scan line, the switching transistor interconnecting the data line and a first node when turned on;

a control transistor turned on/off in response to a control signal from a control signal line, the control transistor interconnecting a second node and a third node when turned on;

a driving transistor turned on/off in response to a voltage on the second node, the driving transistor interconnecting the third node and a second driving voltage line when turned on, the second driving voltage line transmitting the second driving voltage;

a first storage capacitor connected between the first node and the second node; and a second storage capacitor connected between the first node and the second driving voltage line;

wherein:

the light emitting display is driven separately in a first initialization period, a threshold voltage detection setup period, a threshold voltage detection period, a second initialization period, an actual data input period, and a light emitting period;

the first driving voltage is maintained at a low voltage for the first initialization period and the threshold voltage detection setup period, at a middle voltage from a start of the threshold voltage detection period until an end of the actual data input period, and at a high voltage for the light emitting period;

the second driving voltage is maintained at a low voltage for all the periods;

the control signal is maintained at a high voltage for a part of the threshold voltage detection period and at a low voltage for the other periods;

the scan signal is maintained at a high voltage for a part of the first initialization period, the threshold voltage detection period, the second initialization period and sequentially maintained at high voltage for the actual data input period and at a low voltage for the other periods; and the data voltage is maintained at a high voltage for "a part" the first initialization period, the second initialization period and a part of actual data input period and at a low voltage for the other periods.

2. The light emitting display according to claim 1, wherein the pixel circuit further comprises a variable capacitor connected between the control signal line and the second node.

3. A light emitting display comprising:

a pixel circuit that outputs a driving current corresponding to a data voltage from a data line using a scan signal, a first driving voltage and a second driving voltage; and a light emitting element that emits light by the driving current from the pixel circuit, wherein the pixel circuit comprises:

a switching transistor turned on/off in response to the scan signal from a scan line, the switching transistor interconnecting the data line and a first node when turned on;

a control transistor turned on/off in response to a control signal from a control signal line, the control transistor interconnecting a second node and a third node when turned on;

a driving transistor turned on/off in response to a voltage on the second node, the driving transistor interconnecting the third node and a second driving voltage line when turned on, the second driving voltage line transmitting the second driving voltage;

a first storage capacitor connected between the first node and the second node; and a second storage capacitor connected between the first node and the second driving voltage line;

wherein:

the light emitting display is driven separately in a first initialization period, a threshold voltage detection setup period, a threshold voltage detection period, a second initialization period, an actual data input period, and a light emitting period;

the first driving voltage is maintained at a low voltage for the first initialization period, while at a high voltage for the light emitting period;

the second driving voltage is maintained at a high voltage for only the threshold voltage detection setup period and at a low voltage for the other periods;

the control signal is maintained at a high voltage in the threshold voltage detection period and at a low voltage in the other periods;

the scan signal is maintained at a high voltage for a part of the first initialization period, a part of the threshold voltage detection setup period, a part of the threshold voltage detection period, second initialization period and sequentially maintained at high voltage for the actual data input period and at a low voltage for the other period; and the data voltage is maintained at a high voltage for a part of the first initialization period, a part of the second initialization period and a part of the actual data input period and at a low voltage for the other periods.

4. A light emitting display comprising:

a pixel circuit that outputs a driving current corresponding to a data voltage from a data line using a scan signal, a first driving voltage and a second driving voltage; and a light emitting element that emits light by the driving current from the pixel circuit, wherein the pixel circuit comprises:

a switching transistor turned on/off in response to the scan signal from a scan line, the switching transistor interconnecting the data line and a first node when turned on;

a control transistor turned on/off in response to a control signal from a control signal line, the control transistor interconnecting a second node and a third node when turned on;

a driving transistor turned on/off in response to a voltage on the second node, the driving transistor interconnecting the third node and a second driving voltage line when turned on, the second driving voltage line transmitting the second driving voltage;

a first storage capacitor connected between the first node and the second node; and a second storage capacitor connected between the first node and the second driving voltage line;

wherein:

the light emitting display is driven separately in a first initialization period, a threshold voltage detection setup period, a threshold voltage detection period, a second initialization period, an actual data input period, and a light emitting period;

the first driving voltage is maintained at a high voltage for the first initialization period and the light emitting period;

the second driving voltage is maintained at a high voltage for a part of the first initialization period, the threshold voltage detection setup period and a part of the threshold voltage detection period and at a low voltage for the other periods;

the control signal is maintained at a high voltage for a part of the first initialization period and a part of the threshold voltage detection period and at a low voltage for the other periods;

the scan signal is maintained at a high voltage for a part of the first initialization period, threshold voltage detection setup period, threshold voltage detection period, second initialization period and sequentially maintained at high voltage for the actual data input period and at a low voltage for the other period; and the data voltage is maintained at a high voltage for a part of the threshold voltage detection setup period, a part of the second initialization period and a part of the actual data input period and at a low voltage for the other periods.

* * * * *